US010518142B2

(12) United States Patent
Gilbert et al.

(10) Patent No.: US 10,518,142 B2
(45) **Date of Patent: *Dec. 31, 2019**

(54) SET OF GOLF CLUBS

(71) Applicant: Acushnet Company, Fairhaven, MA (US)

(72) Inventors: Peter J. Gilbert, Pinehurst, NC (US); Helene Hipp, Norman, OK (US); Eduardo Mendoza, Keller, TX (US); Adrian L. Stanescu, La Canada-Flintridge, CA (US); Douglas C. Jorgensen, San Diego, CA (US); Scott A. Knutson, Escondido, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/049,596

(22) Filed: Jul. 30, 2018

(65) Prior Publication Data

US 2018/0333619 A1 Nov. 22, 2018

Related U.S. Application Data

(60) Continuation of application No. 15/419,857, filed on Jan. 30, 2017, now Pat. No. 10,035,053, which is a division of application No. 14/306,194, filed on Jun. 16, 2014, now Pat. No. 9,555,296, which is a continuation of application No. 12/974,292, filed on (Continued)

(51) Int. Cl.

| | |
|---|---|
| ***A63B 53/04*** | (2015.01) |
| ***A63B 60/54*** | (2015.01) |
| *A63B 53/00* | (2015.01) |

(52) U.S. Cl.
CPC ..... *A63B 53/047* (2013.01); *A63B 53/0475* (2013.01); *A63B 60/54* (2015.10); *A63B 2053/005* (2013.01); *A63B 2053/0416* (2013.01); *A63B 2053/0433* (2013.01); *A63B 2053/0454* (2013.01); *A63B 2053/0458* (2013.01); *A63B 2209/00* (2013.01); *A63B 2209/10* (2013.01)

(58) Field of Classification Search
USPC ..... 473/324–350
See application file for complete search history.

(56) References Cited

U.S. PATENT DOCUMENTS

| | | | |
|---|---|---|---|
| 1,945,844 | A | 2/1934 | Young |
| 3,845,955 | A | 11/1974 | Solheim |

(Continued)

FOREIGN PATENT DOCUMENTS

| | | |
|---|---|---|
| JP | 4241883 | 8/1992 |
| JP | 6154368 | 6/1994 |
| JP | 7236714 | 9/1995 |
| JP | 8038658 | 2/1996 |
| JP | 9215792 | 8/1997 |
| JP | 10263122 | 10/1998 |

(Continued)

OTHER PUBLICATIONS

Jackson, Jeff, "The Modern Guide to Golf Clubmaking", Ohio: Dynacraft Golf Products, Inc., Copyright 1994, p. 236.

*Primary Examiner* — Alvin A Hunter
(74) *Attorney, Agent, or Firm* — Randy K. Chang

(57) ABSTRACT

A set of golf clubs including golf club heads having improved mass distribution characteristics. The set includes golf club heads having a club head main body including a hitting face and a face support, a muscle back shell and a weight insert.

19 Claims, 37 Drawing Sheets

Related U.S. Application Data

Dec. 21, 2010, now Pat. No. 8,753,219, which is a continuation-in-part of application No. 12/639,031, filed on Dec. 16, 2009, now abandoned, which is a continuation-in-part of application No. 12/346,473, filed on Dec. 30, 2008, now Pat. No. 8,157,673, which is a continuation-in-part of application No. 12/099,244, filed on Apr. 8, 2008, now Pat. No. 8,147,353, which is a continuation-in-part of application No. 11/854,689, filed on Sep. 13, 2007, now Pat. No. 8,062,150.

(56) References Cited

U.S. PATENT DOCUMENTS

| | | | |
|---|---|---|---|
| 3,897,065 | A | 7/1975 | Solheim |
| 4,313,607 | A | 2/1982 | Thompson |
| 4,645,207 | A | 2/1987 | Teramoto et al. |
| 4,754,969 | A | 7/1988 | Kobayashi |
| 4,824,110 | A | 4/1989 | Kobayashi |
| 4,836,550 | A | 6/1989 | Kobayashi |
| 4,854,580 | A | 8/1989 | Kobayashi |
| 5,048,835 | A | 9/1991 | Gorman |
| 5,282,625 | A | 2/1994 | Schmidt et al. |
| 5,326,105 | A | 7/1994 | Fenton, Jr. |
| 5,409,229 | A | 4/1995 | Schmidt et al. |
| 5,447,311 | A | 9/1995 | Viollaz et al. |
| 5,472,203 | A | 12/1995 | Schmidt et al. |
| 5,492,327 | A | 2/1996 | Biafore, Jr. |
| 5,549,296 | A | 8/1996 | Gilbert |
| 5,605,511 | A | 2/1997 | Schmidt et al. |
| D389,540 | S | 1/1998 | Mendenhall |
| 5,704,849 | A | 1/1998 | Schmidt et al. |
| 5,749,795 | A | 5/1998 | Schmidt et al. |
| 5,800,281 | A | 9/1998 | Gilbert |
| 5,830,084 | A | 11/1998 | Kosmatka |
| 5,833,551 | A | 11/1998 | Vincent et al. |
| D404,453 | S | 1/1999 | Wozny et al. |
| D404,780 | S | 1/1999 | Long |
| 5,971,868 | A | 10/1999 | Kosmatka |
| 6,030,293 | A | 2/2000 | Takeda |
| 6,030,295 | A | 2/2000 | Takeda |
| 6,042,486 | A | 3/2000 | Gallagher |
| 6,080,069 | A | 6/2000 | Long |
| D429,511 | S | 8/2000 | Adams et al. |
| D438,584 | S | 3/2001 | Adams et al. |
| D438,925 | S | 3/2001 | Adams et al. |
| D438,926 | S | 3/2001 | Adams et al. |
| 6,210,290 | B1 | 4/2001 | Erickson et al. |
| 6,315,678 | B1 | 11/2001 | Teramoto |
| D453,949 | S | 2/2002 | Helmstetter et al. |
| 6,379,263 | B2 | 4/2002 | Erickson et al. |
| 6,440,010 | B1 | 8/2002 | Deshmukh |
| 6,471,601 | B1 | 10/2002 | McCabe et al. |
| 6,554,722 | B2 | 4/2003 | Erickson et al. |
| D476,708 | S | 7/2003 | Wahl et al. |
| 6,595,870 | B2 | 7/2003 | Stites et al. |
| 6,602,147 | B2 | 8/2003 | Shiraishi |
| 6,623,374 | B1 | 9/2003 | Helmstetter et al. |
| 6,645,085 | B2 | 11/2003 | McCabe et al. |
| D489,106 | S | 4/2004 | Wahl et al. |
| 6,719,641 | B2 | 4/2004 | Dabbs et al. |
| 6,769,998 | B2 | 8/2004 | Clausen et al. |
| 6,814,674 | B2 | 11/2004 | Clausen et al. |
| D500,350 | S | 12/2004 | Schweigert et al. |
| D500,351 | S | 12/2004 | Schweigert et al. |
| 6,830,519 | B2 | 12/2004 | Reed et al. |
| 6,832,962 | B2 | 12/2004 | Stites et al. |
| 6,835,144 | B2 | 12/2004 | Best |
| D501,035 | S | 1/2005 | Wahl et al. |
| 6,855,069 | B2 | 2/2005 | Nagai et al. |
| D505,466 | S | 5/2005 | Lang et al. |
| 6,896,627 | B2 | 5/2005 | Hou |
| 6,902,495 | B2 | 6/2005 | Pergande et al. |
| 6,923,732 | B2 | 8/2005 | Stites et al. |
| 6,932,717 | B2 | 8/2005 | Hou et al. |
| D510,115 | S | 9/2005 | Lang et al. |
| 6,981,924 | B2 | 1/2006 | Deshmukh |
| 6,984,180 | B2 | 1/2006 | Hasebe |
| 6,991,559 | B2 | 1/2006 | Yabu |
| 7,004,853 | B2 | 2/2006 | Deshmukh |
| D517,625 | S | 3/2006 | Sanchez et al. |
| D518,539 | S | 4/2006 | Cleveland et al. |
| 7,083,531 | B2 | 8/2006 | Aguinaldo et al. |
| 7,112,148 | B2 | 9/2006 | Deshmukh |
| D530,760 | S | 10/2006 | Schweigert et al. |
| 7,126,339 | B2 | 10/2006 | Nagai et al. |
| D532,848 | S | 11/2006 | Cleveland et al. |
| 7,137,903 | B2 | 11/2006 | Best et al. |
| 7,144,336 | B2 | 12/2006 | Reyes et al. |
| 7,147,571 | B2 | 12/2006 | Best et al. |
| 7,186,187 | B2 | 3/2007 | Gilbert et al. |
| 7,186,188 | B2 | 3/2007 | Gilbert et al. |
| 7,192,361 | B2 | 3/2007 | Gilbert et al. |
| 7,192,362 | B2 | 3/2007 | Gilbert et al. |
| 7,238,119 | B2 | 7/2007 | Roach et al. |
| 7,281,989 | B2 | 10/2007 | Hou et al. |
| 7,410,424 | B2 | 8/2008 | Chen |
| 7,442,130 | B2 | 10/2008 | Ban et al. |
| 7,448,961 | B2 | 11/2008 | Lin |
| 7,476,162 | B2 | 1/2009 | Stites et al. |
| 7,530,902 | B2 | 5/2009 | Nakamura |
| 7,563,176 | B2 | 7/2009 | Roberts et al. |
| 7,591,735 | B2 | 9/2009 | Matsunaga et al. |
| 7,614,962 | B1 | 11/2009 | Clausen |
| 7,651,412 | B2 | 1/2010 | Meyer et al. |
| 7,654,914 | B2 | 2/2010 | Roach et al. |
| 7,662,051 | B2 | 2/2010 | Chen |
| 7,713,141 | B2 | 5/2010 | Yamamoto |
| 7,775,906 | B2 | 8/2010 | Kusumoto |
| 7,976,403 | B2 | 7/2011 | Gilbert et al. |
| 7,988,564 | B2 | 8/2011 | Jertson |
| 8,062,150 | B2 | 11/2011 | Gilbert et al. |
| 8,079,919 | B2 | 12/2011 | Roach et al. |
| 8,147,353 | B2 | 4/2012 | Gilbert et al. |
| 8,157,673 | B2 | 4/2012 | Gilbert et al. |
| 8,197,355 | B2 | 6/2012 | Galloway, Sr. |
| 8,206,237 | B2 | 6/2012 | Gilbert et al. |
| 8,257,198 | B2 | 9/2012 | Gilbert et al. |
| 8,647,218 | B2 | 2/2014 | Gilbert et al. |
| 8,753,219 | B2 | 6/2014 | Gilbert et al. |
| 9,259,629 | B2 | 2/2016 | Gilbert et al. |
| 10,035,053 | B2 * | 7/2018 | Gilbert ..... A63B 53/047 |
| 10,076,692 | B2 * | 9/2018 | Gilbert ..... A63B 53/047 |
| 2003/0199331 | A1 | 10/2003 | Stites, III |
| 2005/0170908 | A1 | 8/2005 | Reyes et al. |
| 2005/0239570 | A1 | 10/2005 | Best et al. |
| 2007/0129168 | A1 | 6/2007 | Matsunaga et al. |
| 2008/0242444 | A1 | 10/2008 | Park et al. |
| 2010/0093460 | A1 | 4/2010 | Gilbert et al. |

FOREIGN PATENT DOCUMENTS

| | | |
|---|---|---|
| JP | 11319153 | 11/1999 |
| JP | 2000210398 | 8/2000 |
| JP | 2001095959 | 4/2001 |
| JP | 2001170222 | 6/2001 |
| JP | 2001204863 | 7/2001 |
| JP | 2001212266 | 8/2001 |
| JP | 2001259092 | 9/2001 |
| JP | 2001299968 | 10/2001 |
| JP | 2001314535 | 11/2001 |
| JP | 2002143355 | 5/2002 |
| JP | 2003062132 | 3/2003 |
| JP | 2003245386 | 9/2003 |
| JP | 2006051366 | 2/2006 |
| JP | 2006198327 | 8/2006 |
| JP | 2006212066 | 8/2006 |
| JP | 2007275231 | 10/2007 |

* cited by examiner

Table 1

| Mode | Conventional Iron Frequency (Hz) | Embodiment A Frequency (Hz) | Embodiment B Frequency (Hz) |
|---|---|---|---|
| 1 | 3983.5 | 4998.4 | 4473.8 |
| 2 | 4887.3 | 5921.7 | 5571.6 |
| 3 | 7373.5 | 7725 | 8006.5 |
| 4 | 10195 | 10051 | 10214 |
| 5 | 10507 | 11345 | 11263 |
| 6 | 14089 | 14791 | 14664 |
| 7 | 15162 | 15455 | 15833 |
| 8 | 15813 | 17575 | 16869 |
| 9 | 17698 | 18834 | 18809 |
| 10 | 20832 | 19910 | 21753 |

FIG. 14

(Conventional Iron)

(Embodiment A)

(Embodiment B)

(Conventional Iron)

(Embodiment A)

(Embodiment B)

(Conventional Iron)

(Embodiment A)

(Embodiment B)

(Conventional Iron)

(Embodiment A)

(Embodiment B)

(Conventional Iron)

(Embodiment A)

(Embodiment B)

(Conventional Iron)

(Embodiment A)

(Embodiment B)

(Conventional Iron)

(Embodiment A)

(Embodiment B)

(Conventional Iron)

(Embodiment A)

(Embodiment B)

(Conventional Iron)

(Embodiment A)

(Embodiment B)

(Conventional Iron)

(Embodiment A)

(Embodiment B)

SET OF GOLF CLUBS

CROSS-REFERENCE TO RELATED APPLICATIONS

This application is a continuation of U.S. patent application Ser. No. 15/419,857, currently pending, filed Jan. 30, 2017, which is a divisional of U.S. patent application Ser. 14/306,194, filed Jun. 16, 2004, now U.S. Pat. No. 9,555,296, which is a continuation of U.S. patent application Ser. No. 12/974,292, filed Dec. 21, 2010, now U.S. Pat. No. 8,753,219, which is a continuation-in-part of U.S. patent application Ser. No. 12/639,031, filed Dec. 16, 2009, now abandoned, which is a continuation-in-part of U.S. patent application Ser. No. 12/346,473, filed Dec. 30, 2008, now U.S. Pat. No. 8,157,673, which is a continuation-in-part of U.S. patent application Ser. No. 12/099,244, filed Apr. 8, 2008, now U.S. Pat. No. 8,147,353, which is a continuation-in-part of U.S. patent application Ser. No. 11/854,689, filed Sep. 13, 2007, now U.S. Pat. No. 8,062,150, the contents of which are incorporated herein by reference in their entireties.

FIELD OF THE INVENTION

This invention generally relates to golf clubs, and more specifically to iron-type golf club having a lower cavity behind the hitting face.

BACKGROUND OF THE INVENTION

Typical iron club heads are solid with flat hitting faces and generally configured as either muscle back or cavity back clubs. Traditionally, all irons were configured as muscle back clubs, which are smooth at the back with low offset, a thin topline and a thin sole. Cavity back irons have a hollowed out back and the club head mass is redistributed to the sole and the perimeter of the club head, which moves the center of gravity lower to the ground and rearward. The weight distribution makes the iron launch the ball higher and increases rotational moment of inertia thereby lowering its tendency to rotate on mis-hits and enlarging the sweet spot.

Some muscle back irons have an interior hollow section, such that the club resembles a muscle back on the outside but the interior hollow section alters the club's mass characteristics. One example is U.S. Pat. No. 4,645,207 to Teramoto et al. The Teramoto patent discloses a set of iron golf clubs in which the iron club is cast by the lost wax method, and the back member is welded at the back of the face member to form a hollow section between the back and face members. As the club changes from a longer iron to a shorter iron, the hollow section is gradually decreased to zero and the sole width is gradually decreased. No support is provided to the hitting face.

Another example is U.S. Pat. No. 4,754,969 to Kobayashi. The Kobayashi patent discloses a set of golf clubs wherein each one-piece club head includes a hollow section behind the striking face. Each of the club heads is made of a stainless steel by, for example, a lost wax casting process. The material of each of the face portions of the club heads is then annealed to increase its elasticity. The striking face is thinner for long irons, but no support is provided to the hitting face.

Another example is U.S. Pat. No. 7,126,339 to Nagai et al., which discloses utility golf clubs, which generally include a hollow interior.

Previous muscle-back club heads generally have a low moment of inertia about the longitudinal axis of the shaft ("MOI-SA") because they are relatively small. Because of their size, they also tend to have a low moment of inertia about a vertical axis extending through the center of gravity ("MOI-Y"). Conversely, previous game improvement club heads have relatively higher MOI-Y, at the expense of a higher MOI-SA because they are relatively large. Generally, better players have a tendency to prefer golf clubs having a lower MOI-SA so that they can control the orientation of the club head throughout the swing with greater ease. However, because even the better player will experience imperfect ball strikes, they are often penalized by the associated lower MOI-Y of the small club heads.

There remains a need in the art for an improved iron-type golf club. In particular, there is a need for an iron-type golf club that provides a lower MOI-SA in combination with a higher MOI-Y.

SUMMARY OF THE INVENTION

The present invention is directed to iron-type golf clubs. The inventive iron-type golf club provides a club head that provides the aesthetics and smaller dimensional envelope of a muscle back iron while improving club head center of gravity disposition, increasing moment of inertia for forgiveness and enlarging the sweet spot size.

In an embodiment, a set of iron-type golf clubs comprises a golf club that includes a golf club head, a grip and a shaft interposed between, and coupled to, the golf club head and the grip. The golf club head is constructed so that a ratio of a moment of inertia about a vertical axis extending through the center of gravity of the golf club head and a moment of inertia about a longitudinal axis of the shaft is less than 2.25. The golf club has a loft less than about 28° the golf club has a length that is less than about 40 inches.

In another embodiment, a set of iron-type golf clubs comprises a golf club including a golf club head, a grip and a shaft interposed between, and coupled to, the golf club head and the grip. The golf club head includes a main body and a muscle back shell. The main body includes a face support and a partial sole and the muscle back shell is coupled to the face support and the partial sole. The golf club head has a blade length of less than 78 mm and a moment of inertia about a vertical axis extending through the center of gravity of the golf club head of at least 218 $kgmm^2$. The golf club has a loft less than about 28° and a length that is less than about 40 inches.

In a further embodiment, a golf club head comprises a club head main body, a frame, and an extension member. The club head main body comprises a hitting face that defines a forward ball-striking surface and a rear surface that is spaced from the ball-striking surface by a face thickness. The main body further comprises a face support protruding rearward from the rear surface. The frame is coupled to a lower portion of the club head main body, and comprises a sole portion, a back flange and a support extension. The sole portion of the frame forms at least a portion of a sole surface of the golf club head. The back flange extends upward from a rearward end of the sole portion, and the support extension is disposed at an upward end of the back flange. The extension member extends between the support extension of the frame and the hitting face, and abuts a portion of the face support of the hitting face so that a force is applied to the face support.

In another embodiment, a golf club head comprises a club head main body and a frame. The club head main body comprises a club head main body, a face support, and a sole portion. The hitting face defines a forward ball-striking surface and a rear surface that is spaced from the ball-striking surface by a face thickness. The face support protrudes rearward from the rear surface and the sole portion extends rearward from a lower edge of the hitting face where it forms a leading edge of the golf club head. The frame is coupled to the sole portion of the club head main body, and extends between a trailing edge of the sole portion and the face support. The frame is sized so that the frame is in compression between the sole portion and the face support to apply a force to the rear surface of the hitting face.

In another embodiment, golf club head comprises a club head main body, and a support extension. The club head main body comprises a club head main body, a face support, a sole portion, and a back flange. The hitting face defines a forward ball-striking surface and a rear surface that is spaced from the ball-striking surface by a face thickness. The face support protrudes rearward from the rear surface, the sole portion extends rearward from a lower edge of the hitting face where it forms a leading edge of the golf club head, and the back flange extends upward from the sole portion. The support extension extends between the back flange and the face support. The club head main body is constructed from a first material having a first density, and the support extension is constructed from a second material having a second density that is lower than the first density.

In another embodiment, a golf club head comprises a club head main body, a frame, and an extension member. The club head main body comprises a hitting face that defines a forward ball-striking surface and a rear surface that is spaced from the ball-striking surface by a face thickness. The frame is coupled to a lower portion of the club head main body, and comprises a sole portion, a back flange and a support extension. The sole portion of the frame forms at least a portion of a sole surface of the golf club head. The back flange extends upward from a rearward end of the sole portion, and the support extension is disposed at an upward end of the back flange. The extension member extends between the main body and the frame, and the extension member abuts a portion of the main body so that a force is applied to a rear side of the hitting face.

In a further embodiment, a golf club head comprises a club head main body, a frame and at least one extension member. The club head main body comprises a hitting face that defines a forward ball-striking surface and a rear surface that is spaced from the ball-striking surface by a face thickness. The frame is coupled to a lower portion of the club head main body, and comprises a sole portion, a back flange and a support extension. The sole portion of the frame forms at least a portion of a sole surface of the golf club head. The back flange extends upward from a rearward end of the sole portion, and the support extension is disposed at an upward end of the back flange. The at least one extension member is disposed toeward of the geometric center of the club head main body and extends between the main body and the frame. The extension member abuts a portion of the main body so that a force is applied to a rear side of the hitting face.

In a still further embodiment, a golf club head comprises a club head main body, and a frame. The club head main body comprises a hitting face and a sole, and the club head main body defines a forward ball-striking surface and a rear surface that is spaced from the ball-striking surface by a face thickness. The sole portion extends rearward from a lower edge of the hitting face where it forms a leading edge of the golf club head. The frame is coupled to the club head main body, and extends between a trailing edge of the main body and a rear side of the hitting face. The frame is sized so that the frame is in compression between the trailing edge and the rear side of the hitting face of the main body so that a force is applied to the rear side of the hitting face

BRIEF DESCRIPTION OF THE DRAWINGS

In the accompanying drawings, which form a part of the specification and are to be read in conjunction therewith and in which like reference numerals are used to indicate like parts in the various views:

FIG. 14 is a table providing the frequency values of a conventional iron-type golf club and embodiments of the iron-type golf club of the present invention for the first ten vibration modes;

DETAILED DESCRIPTION OF THE PREFERRED EMBODIMENTS

Figure 1:
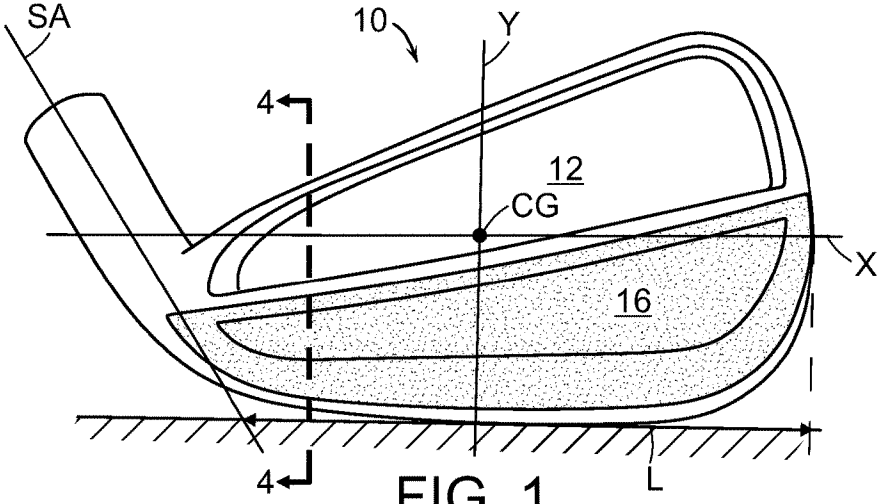
FIG. 1 is a rear view of a hollow iron-type golf club in accordance with the present invention, and illustrates the coordinate system referred to throughout the description.
Figure 2:
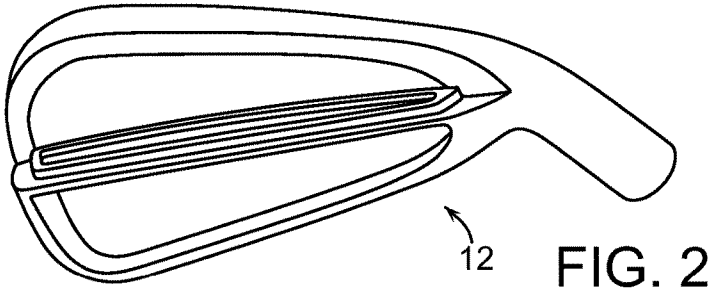
FIG. 2 is a perspective bottom view of club head main body of FIG. 1 without the muscle back shell.
Figure 3:
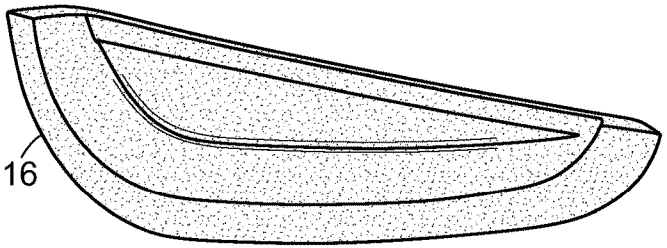
FIG. 3 is a perspective back view of muscle back shell of FIG. 1.

The present invention is directed to hollow iron-type golf clubs and can also be used with utility golf clubs. The inventive iron-type golf club provides the aesthetics and smaller dimensions of a muscle back iron at address while moving the center of gravity lower and further back, increasing moment of inertia, and enlarging sweet spot similar to a cavity back club. The inventive club can accomplish this goal by incorporating a hollow interior cavity in the muscle portion of the club, supporting a thin hitting face with a supporting member, and adding a high density rear sole portion. Additionally, weight from the upper toe can be redistributed to other portions of the club head to improve mass characteristics, and can be advantageously replaced by a vibration and sound dampener. The end result of the present invention is a club that resembles a muscle back iron that low handicap players use, but the club plays like the forgiving cavity back irons that high handicap players prefer. Several embodiments of the present invention are described below.

Referring to FIGS. 1, 2, 3 and 4, a hollow iron-type golf head 10 comprises club head main body 12 including support 14, and muscle back shell 16. Support 14 and partial sole 18 of club head main body 12 are sized and dimensioned to fit flush with muscle back shell 16.

Club head main body 12 is preferably made from a lower density material than muscle back shell 16 to move club head center of gravity lower and further back to increase moment of inertia and sweet spot size to improve the golfer's chances for effective ball-striking. Preferably, main body 12 has a density in the range of about 4 g/cm$^3$ to about 8 g/cm$^3$ and muscle back shell 16 has a density in the range of about 9 g/cm$^3$ to about 19 g/cm$^3$. Suitable materials for club head main body 12 include, but are not limited to, aluminum, stainless steel or titanium and alloys thereof. Preferably, club head main body 12 is made from titanium alloy. Suitable materials for muscle back shell 16 include, but are not limited to, lead, tungsten, gold, or silver. Preferably, muscle back shell 16 is made from tungsten or tungsten nickel alloy. These material alternatives are applicable to all of the embodiments described herein. Preferably, materials with higher density, such as stainless steel and tungsten are located below and away from the center of gravity or the geometric center to enhance mass properties, e.g., larger rotational moment of inertia and lower center of gravity.

Figure 4:
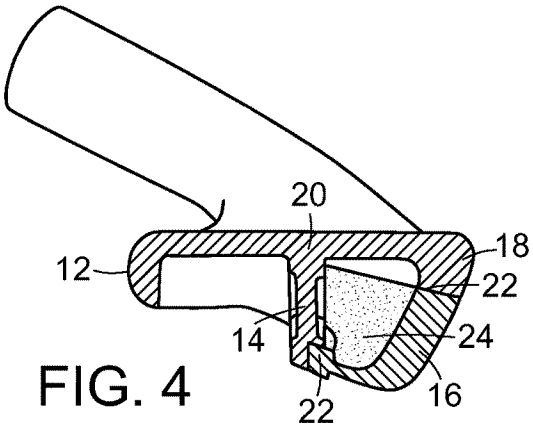
FIG. 4 is a cross-sectional view along line 4-4 of FIG. 1.

As discussed above, it is desirable to have a relatively thin hitting face so that extra mass can be redistributed. However, golf club and golf ball impacts can create a force of up to 2,000 lbs. Repeated impacts may adversely affect the structural integrity of hitting face 20. In accordance with an aspect of the present invention, support 14 is provided behind hitting face 20 to improve its mechanical integrity. While any number of supports can be deployed and the supports can be arranged in any orientation, it is preferred that a single support 14 is used and is positioned in the toe-to-heel direction. Furthermore, as best shown in FIG. 4 support 14 has an I-beam profile, which is known to have high structural integrity and resistance to bending forces while being relatively light weight. Alternatively, support 14 can have any profile including, but not limited to, square, triangular, rectangular, "X", "Y," circular, semi-circular, elliptical, etc.

Figure 1A:
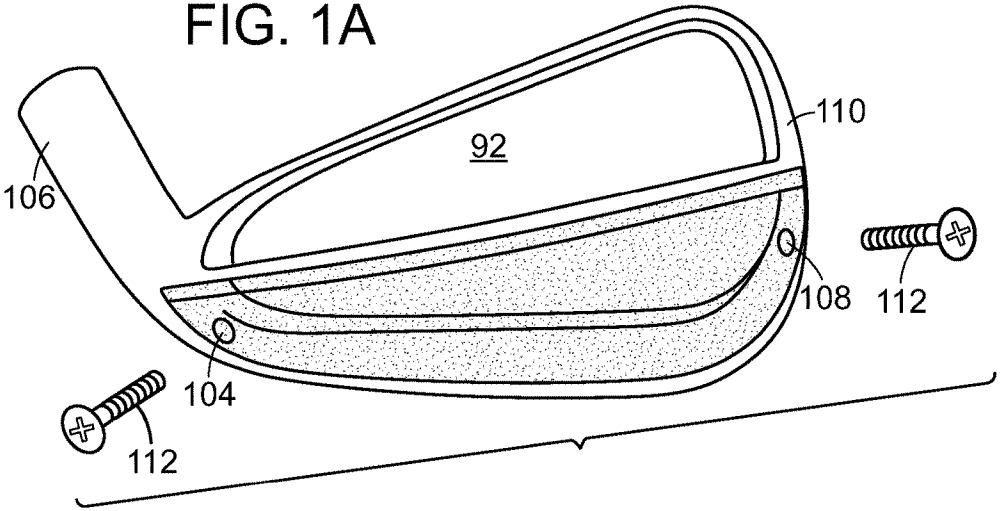
FIG. 1A is a rear view of an embodiment of the club head main body without a muscle back shell.

To assemble club head 10, muscle back shell 16 is attached to support 14 and partial sole 18 of club head main body 12 at attachment lines 22 to define an enclosed cavity 24. Preferably, attachments 22 of muscle back shell 16 to club head main body 12 are made permanent by welding or force fitting with or without adhesive. Alternatively, shell 16 can be attached via fasteners 112, such as screws and rivets, and holes 104, 108 as shown in FIG. 1A. An advantage of disposing attachments 22 away from hitting face 20 is that the high force of the golf club and golf ball impacts are less likely to cause mechanical failure of attachments 22. This advantage is applicable to all of the embodiments described herein. Preferably, plasma welding is used to attach the heel to main body 12 and laser welding is used to attach support 14 to hitting face 20 of main body 12.

Referring to FIG. 1A, an alternative embodiment comprises a bore 104 with internal threads in the heel below hosel 106 of club head main body 92, a bore 108 with internal threads in toe 110 of club head main body 92, or both. Internal threads of bores 104 and 108 fastenably mate with a fastener 112, such as a screw 112. The embodiment provides decorative aesthetics compatible with other embodiments discussed herein.

Referring to FIGS. 5 to 8A, another embodiment of golf head 10 comprises club head main body 32 including support 34 and optional toe dampener 46, and muscle back shell 36. Support 34 and partial sole 38 of club head main body 32 are sized and dimensioned to fit with muscle back shell 36. Toe dampener 46 is made from a viscoelastic material, such as urethane or other polymers, and provides weight redistribution in addition to vibration and sound attenuation when the golf club strikes a ball.

Club head main body 32 comprises upper back cavity 48, support 34 with first interlocking structure 60, recessed flange 50, partial sole 38 with second interlocking structure 62, and optional toe dampener 46 and cosmetic badge 76. In addition, club head main body 32 may have recess 52 in support 34 providing support 34 with an I-beam profile for weight redistribution to move lower and further back club head center of gravity. Support 34 is coupled to club head main body. For example, support 34 may be coupled to main body 32 by being cast or forged integral with hitting face 20 and/or club head main body 32 as a monolithic body, or support 34 may be coupled to main body 32 by being manufactured separately from a different material or the same material, such as stainless steel or carbon fiber reinforced plastics, and later attached to hitting face 20 via an attachment method such as welding, interference fitting, shrink fitting, swage fitting, applying fasteners and/or bonding, such as with epoxy.

Muscle back shell 36 comprises back flange 54 with third interlocking structure 64 and sole section 56 with fourth interlocking structure 66. In addition, muscle back shell 36 may have recess 58 in back flange 54 for weight redistribution to move lower and further back club head center of gravity.

Figure 5:
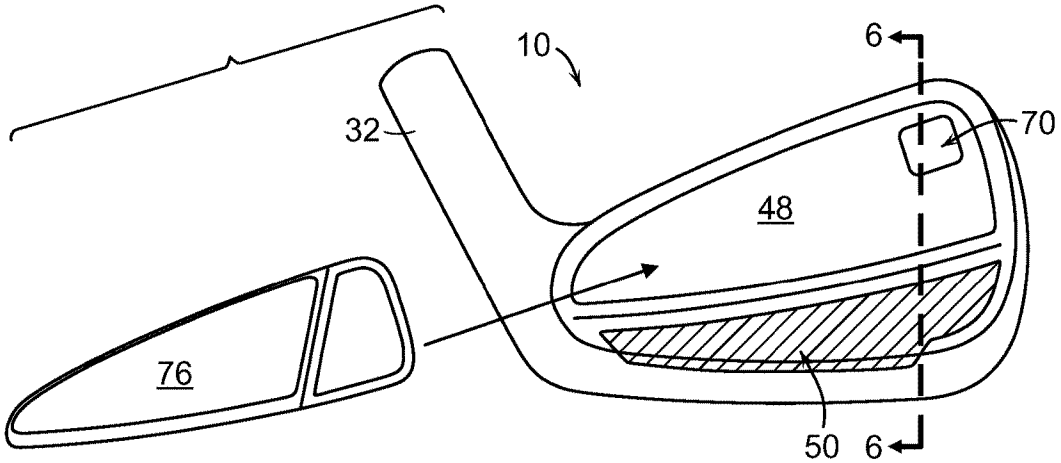
FIG. 5 is an exploded rear view of another inventive club head, optional toe dampener, muscle back shell, and optional cosmetic decal.
Figure 7:
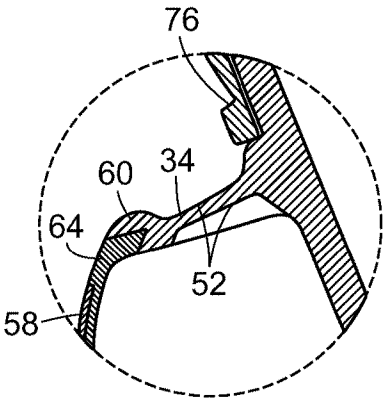
FIG. 7 is an enlarged view of the circled portion of FIG. 6.
Figure 6:
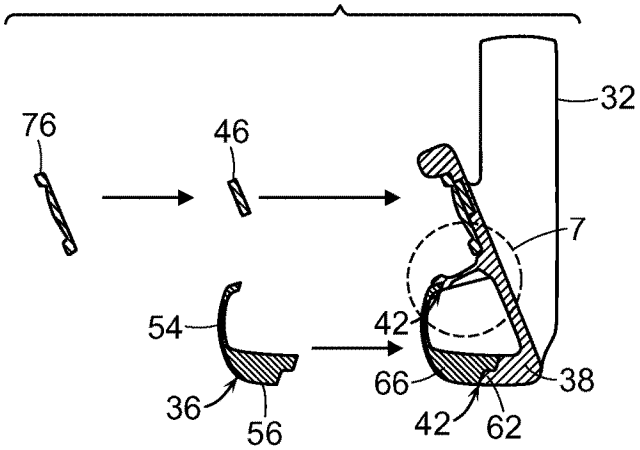
FIG. 6 is an exploded cross-sectional view along line 6-6 of FIG. 5.

First interlocking structure 60 of support 34 and second interlocking structure 62 of partial sole 38, of club head main body 32, are sized and dimensioned to mate with third interlocking structure 64 of back flange 54 and fourth interlocking structure 66 of sole section 56, of muscle back shell 36, respectively. While any number of interlocking structures can be deployed and the interlocking structures can be arranged in any orientation, it is preferred that a single notch is disposed in support 34 and partial sole 38 and is positioned in the toe-to-heel direction to mate with corresponding interlocking structures 64 and 66, as shown in FIGS. 5 and 7. Alternatively, interlocking structures 60, 62, 64, and 66 can have any profile including, but not limited to, square, triangular, rectangular, curvilinear, sine wave, serrated, etc. Depending on the shape, and in particular the profile in cross section, of the interlocking structures, both increased surface area contact and increased mechanical binding is achieved between club head main body 32 and muscle back 36 when fit together. An advantage of this embodiment is that the shape of interlocking structures 60, 62, 64, and 66 can be matched to other club decorative aesthetics, such as the hosel.

Figure 8:
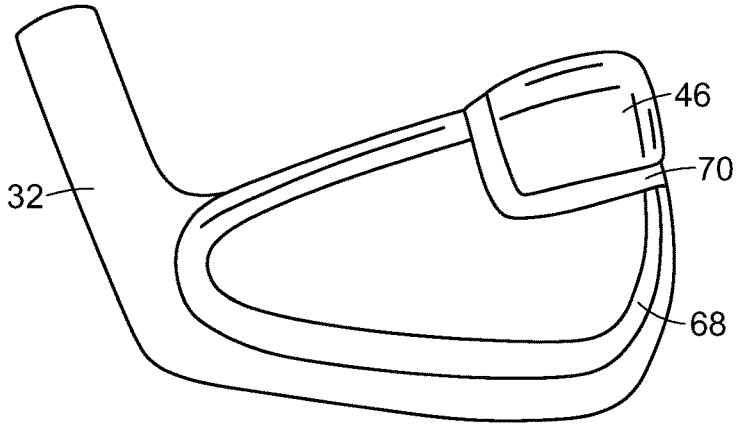
FIG. 8 is a perspective view of the toe dampener using a thinned area.
Figure 8A:
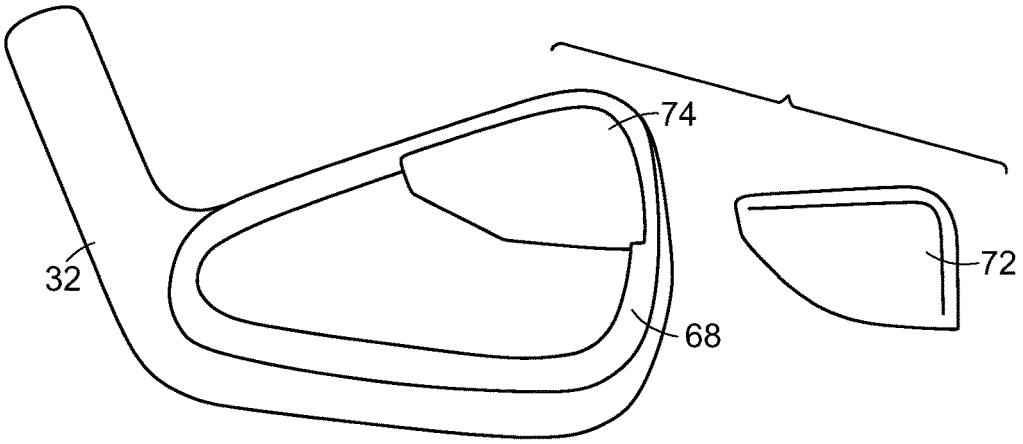
FIG. 8A is a perspective view of the toe dampener using a slot.
Figure 9:
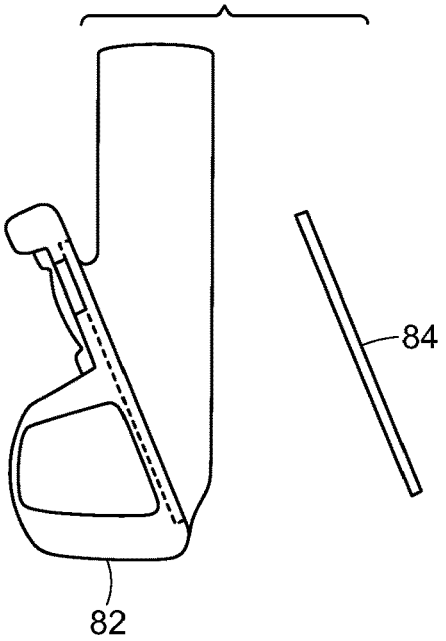
FIG. 9 is an exploded cross-sectional view of another embodiment of the hollow iron-type golf club.

Referring to FIGS. 8-9, by removing mass, in the form of titanium alloy or other suitable material as discussed above, from toe 68 of club head main body 32 and replacing the material, as toe dampener 46, with a lower density material club head center of gravity is moved lower and further back, while also providing vibration and sound attenuation when the golf ball is mis-hit on toe 68 of the golf club. Preferably, toe dampener 46 is made from a soft viscoelastic material such as thermoplastic elastomer, rubber, or polyurethane that has a density in the range of about 0.8 g/cm$^3$ to about 1.5 g/cm$^3$ and Shore A40-A90 hardness rating. Preferably, toe dampener 46 is created by thinning an area 70 in toe 68 on the back of club head main body 32, as shown in FIG. 8. Alternatively, thinned area 70 is in upper back cavity 48. In either case, thinned area 70 is replaced with viscoelastic toe dampener 46. An alternative embodiment comprises a lightweight member 72 made of viscoelastic material that is inserted into a slot 74 created in toe 68 of club head main body 32, as shown in FIG. 8A. Slot 74 can also be formed in the middle of the topline of the club head. Alternatively, a combination of thinned areas and slots may be used to add viscoelastic material to club head main body 12.

Toe dampener 46 viscoelastic material provides vibration attenuation that reduces the distance and off-line penalties, and unpleasant sensation radiating up the shaft into the hands and arms of the golfer when a ball is mis-hit on toe 68 of club head main body 32. Furthermore, golf balls mis-hit on high toe 68 cause a low frequency ("bass"), high amplitude ("loud") noise. The viscoelastic material in toe dampener 46 provides sound attenuation that generates an aesthetically pleasing sound when a golf club strikes a ball. Additionally, the number of high toe mis-hits is statistically low therefore less metal is required at that location and the metal can be replaced with lower density polymers.

Finally, optional cosmetic badge 76 adheres to the upper back cavity 48 of the club head main body 32. If toe dampener 46 is produced by thinning an area 70 as shown in FIG. 8, then cosmetic badge 76 holds toe dampener 46 captive against back of club head main body 32. In addition to the current embodiment, toe dampener 46 and cosmetic badge 76 are applicable to all the embodiments discussed herein.

To assemble club head 10, muscle back shell 36 is attached to support 34 and partial sole 38 of club head main body 32. Preferably, attachments 42 of muscle back 36 to club head main body 32 are made permanent by welding, fasteners or force fitting with or without adhesive, as discussed above.

Referring to FIG. 9, another embodiment of club head 10 comprises a separate face plate 84 that is coupled to club head main body 82 by being attached to club head main body 82 by an attachment operation rather than being made integral with club head main body 82. For example, face plate 84 may be attached to club head main body 82 by welding, interference fitting, shrink fitting, swage fitting, and/or bonding, such as with epoxy. An advantage of this embodiment is that the style and/or density of face plate 84 can be changed without modifying the rest of club head 10.

Figure 10:
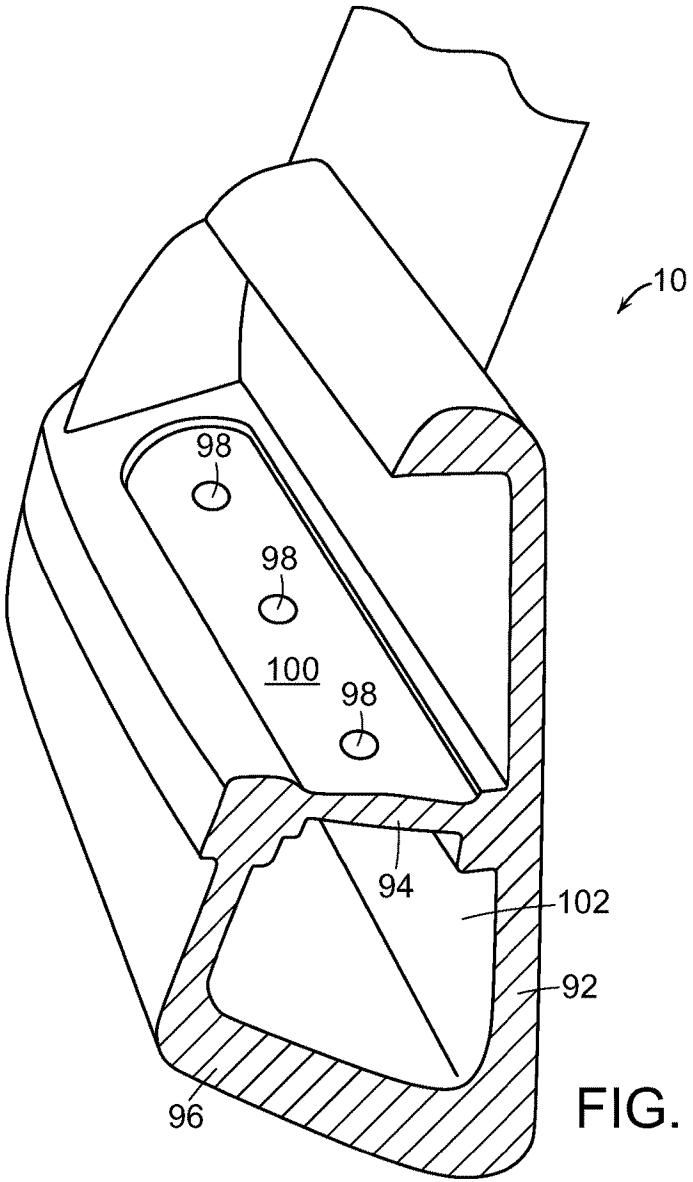
FIG. 10 is an enlarged cross-sectional view of another embodiment of the hollow iron-type golf club.

Referring to FIG. 10, another embodiment of golf head 10 comprises holes or openings 98 on top surface 100 of support 94 of club head main body 92. Internal cavity 102 formed by club head main body 92 and muscle back shell 96 can be filled with material including, but not limited to, foamed or un-foamed polyurethane, or other substance, to prevent water, or other material, from entering otherwise hollow cavity 102. The material can be transparent or translucent, clear or colored, and may have multiple colors exposed through openings 98. Hollow cavity 102 can be filled through openings 98. While any number of holes can be deployed and the holes can be arranged in any orientation, it is preferred that three holes 98 are used and are positioned in the toe-to-heel direction. Alternatively, holes can have any arrangement including, but not limited to, diamond, oval, etc. An advantage of using filling material is to increase the dampening effect and to provide additional aesthetics to the club head, allowing the user to look into the muscle back. Hollow cavity 102 may not be filled completely. Instead, a material can be added into hollow cavity 102 to bring the club head to any desired weight during manufacturing. For example, up to 6 grams of mass can be added to bring the weight of the club head to regulation weight. Suitable added mass includes, but is not limited to an adhesive commonly known in the art as rat glue or hot melt.

Top surface 100 can be a recessed surface, as illustrated in FIG. 10. The recess can be filled with a three-dimensional insert, which can be a filler or can serve as a badge carrying marketing indicia or a bridge. The insert can have any shape and can have an L-shape. The insert can also be functional, e.g., to dampen vibration from impacts with golf balls. Suitable dampening materials include, but are not limited to, soft polymers having hardness value from Shore A30 to Shore A90, preferably from Shore A35 to Shore A60 and more preferably from Shore A35 to Shore A70. The functional insert can carry sensors and or electronics to measure location of impacts on the hitting face. In one embodiment, the sensors are located on or proximate to the hitting face and the electronics including memory, such as EEPROM and other memory storage devices, is located proximate to the grip of the club to minimize vibration to the sensitive electronics.

Figure 11:
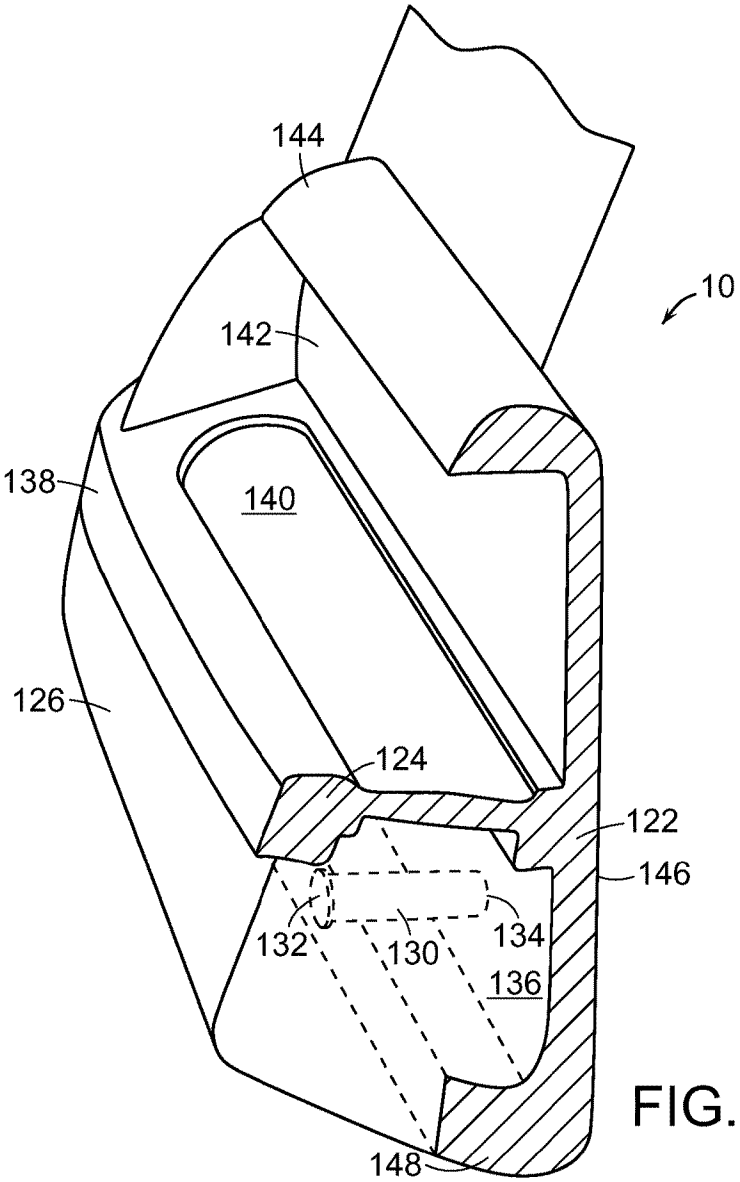
FIG. 11 is an enlarged cross-sectional view of another embodiment of the hollow iron-type golf club.
Figure 11A:
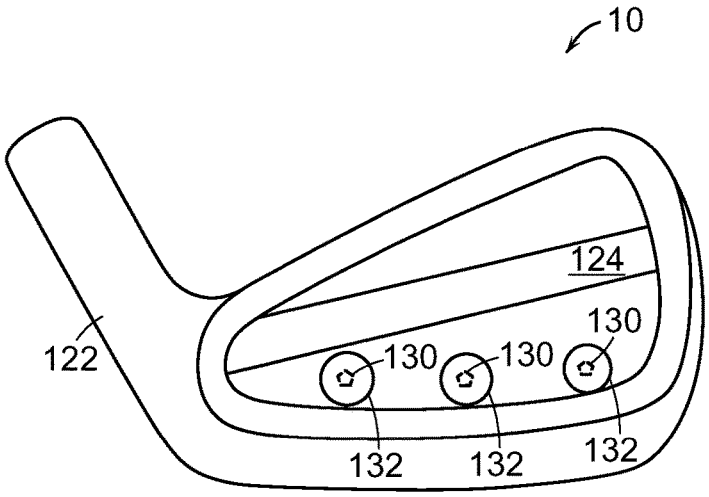
FIG. 11A is a perspective rear view of the club head main body.

Referring to FIGS. 11-11A, another embodiment of club head 10 comprises posts 130 projecting from back 136 of club head main body 122. Posts 130 comprise enlarged heads 132 that provide mounting attachments, or anchors, for muscle back solid 126 disposed on top of posts 130 and support 124 projecting from back 136 of main body 122. Suitable materials for posts 130 include, but are not limited to, lead, tungsten, gold, or silver. Preferably, posts 130 are made from tungsten nickel alloy. Posts 130 are custom milled, as needed, for weight distribution, to move the center of gravity lower and further back. Preferably, enlarged heads 132 have a disk shape as shown in FIGS. 11-13A, or any other suitable shape, such as cube, octahedron, sickle, boat anchor, etc. Whereas suitable material for making translucent overcast of muscle back solid 126 may include, but is not limited to, polyurethane, or similar substance, made into any color, design, logo, etc.

Figure 12:
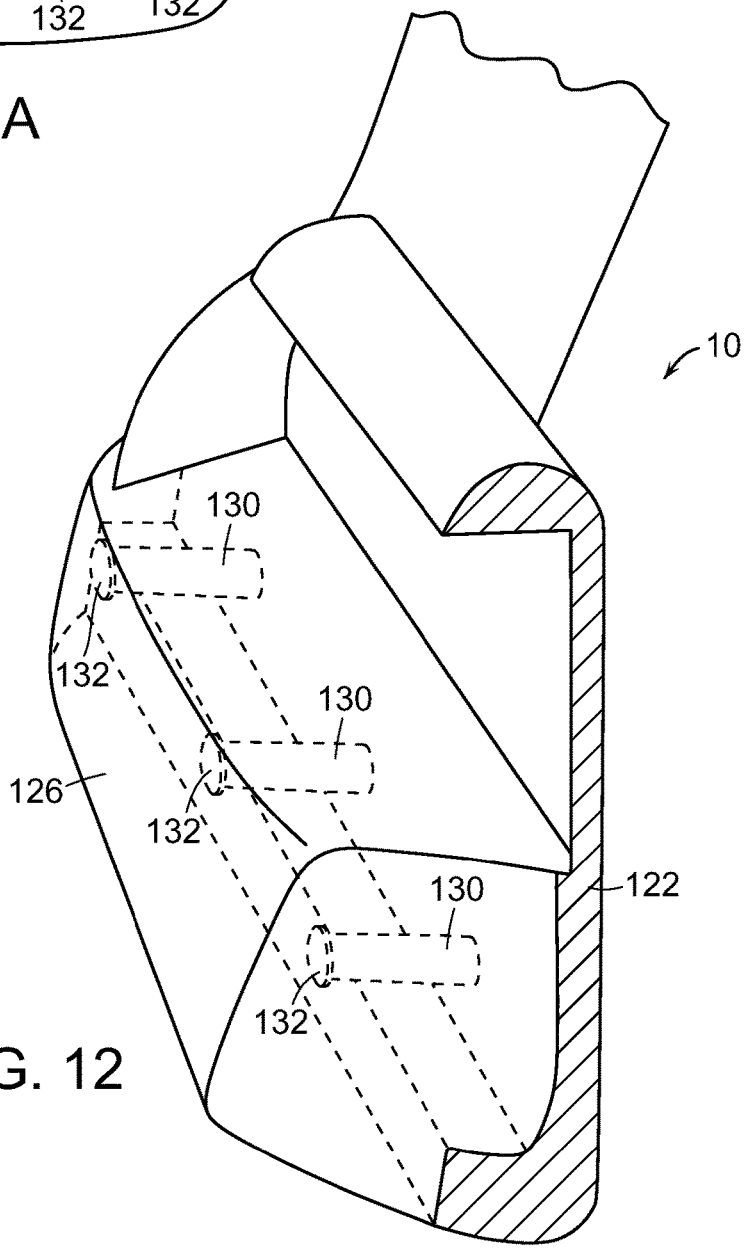
FIG. 12 is an enlarged cross-sectional view of another embodiment of the hollow iron-type golf club.

To assemble club head 10, posts 130 are attached to back 136 of club head main body 122 at attachment lines 134. Preferably, attachments 134 of posts 130 to club head main body 122 are made permanent by welding, fasteners or adhesive. Then, the mold for making muscle back solid 126 is created with club head main body 122 forming a part of the mold. Main body 122 connects with a half-mold that would create muscle back 126. While any number of posts can be deployed and the posts can be arranged in any orientation, it is preferred that three posts 130 are used and are positioned in the toe-to-heel direction to move the center of gravity low to the ground. Alternatively, posts can have any arrangement including, but not limited to, square, triangular, rectangular, curvilinear, diamond, oval, etc. An alternative embodiment comprises no support as shown in FIG. 12.

Figure 13A:
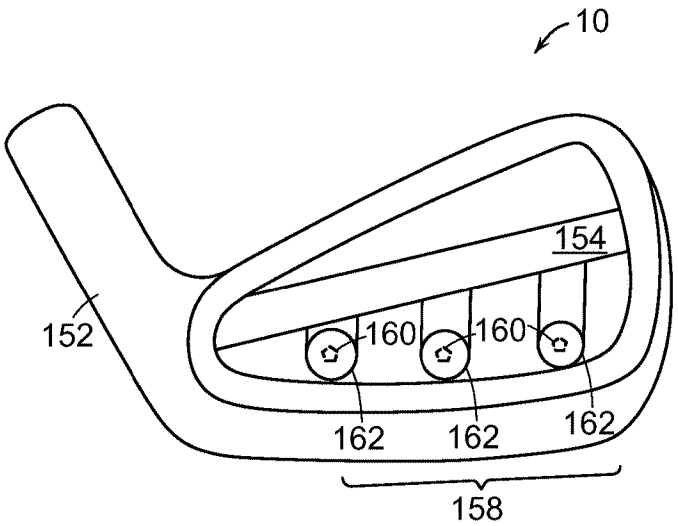
FIG. 13A is a perspective rear view of the club head main body.
Figure 13:
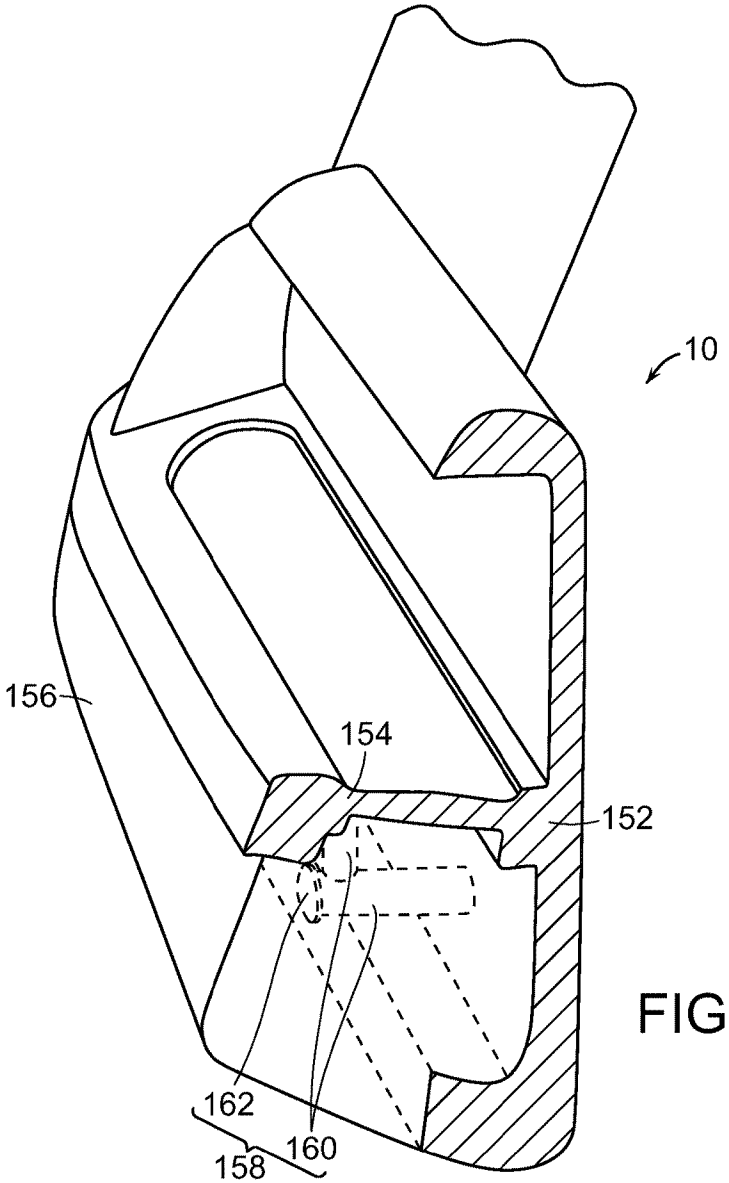
FIG. 13 is a cross-sectional exploded view of another embodiment of the hollow iron-type golf club.

Referring to FIGS. 13-13A, another alternative embodiment comprises a honeycomb system 158 of many interconnected anchors 160 and enlarged heads 162 attached to support 154 and back of club head main body 152. Muscle back solid 156 is a translucent overcast disposed on top of honeycomb system 158. In manufacturing club head 10, honeycomb system 158 of club head main body 152 is part of the mold, as discussed above.

Figure 25:
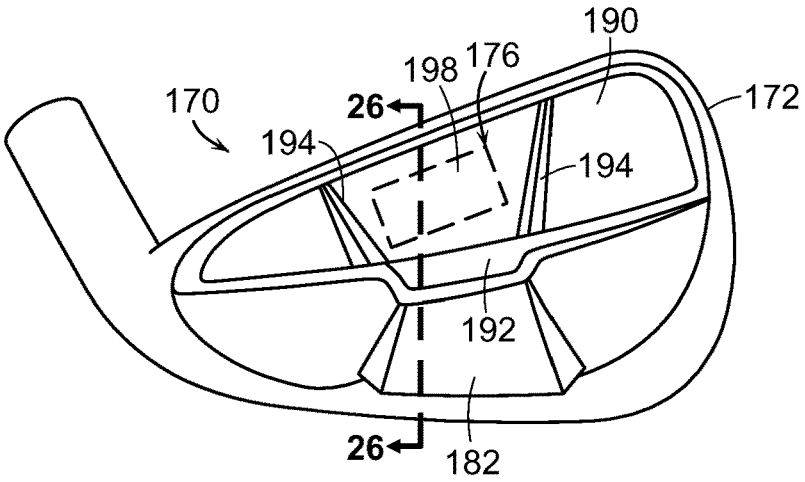
FIG. 25 is a rear view of a hollow iron-type golf club in accordance with the present invention.
Figure 26:
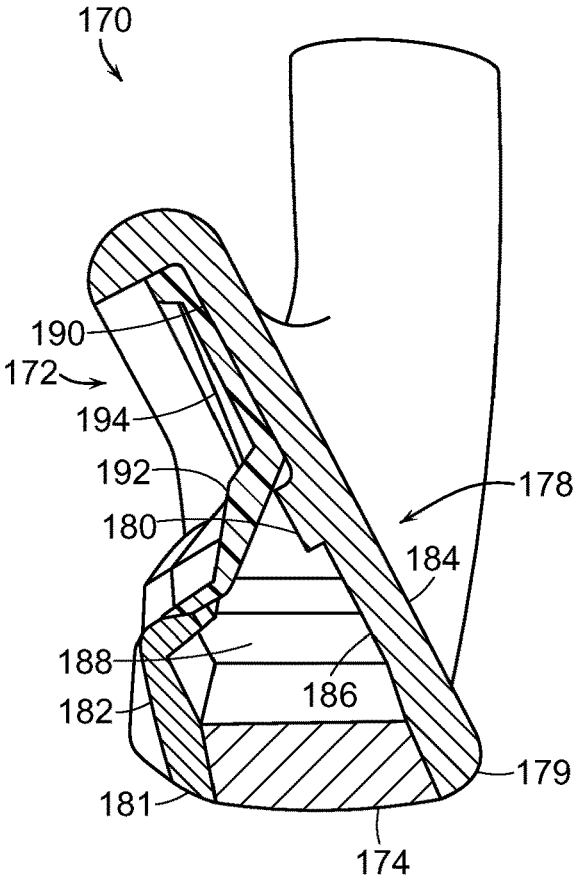
FIG. 26 is a cross-sectional view along line 26-26 of FIG. 25.

Referring to FIGS. 25-26, another embodiment of a golf club head 170 includes a main body 172, a sole insert 174 and a back plate 176. Main body 172 includes a hitting face 178, a face support 180 and a back flange 182. Hitting face 178 includes a front, ball-striking surface 184 and a rear surface 186 that is opposite the ball-striking surface 184. Face support 180 extends from rear surface 186 generally toward back flange 182. In the present embodiment, face support 180 extends only a portion of the distance between hitting face 178 and back flange 182 so that there is a gap between face support 180 and back flange 182.

A portion of a sole surface of club head 170 is provided by sole insert 174 that extends between a lower portion of hitting face 178 and a lower portion of back flange 182. As shown, the lower portion of hitting face 178 provides a leading edge 179 of club head 170 and the lower portion of back flange 182 provides a trailing edge 181 of club head 170 and the majority of the sole surface is provided by sole insert 174.

Sole insert 174 may be configured to provide desired weight concentration. For example, in the present example, sole insert 174 is constructed of tungsten or a tungsten alloy and includes increased thickness portions, such as step 188 located at the heel end of sole insert 174 to concentrate mass toward the heel of club head 170. An additional step may be included at a toe end of sole insert 174 to concentrate mass toward the toe of club head 170. Such mass concentrations may be utilized to alter the moment of inertia value and the center of gravity location of club head 170. Sole insert 174 may be constructed of any material, but is preferably constructed from a material having a greater density than the material of main body 172. Sole insert 174 may be coupled to main body 172 by any attachment method such as, for example, welding, force fitting, swaging or utilizing mechanical fasteners.

Back plate 176 includes a plate 190, a support extension 192 and optional bumpers 194. Plate 190 is coupled to a rear surface of an upper back cavity of main body 172 and, in the present embodiment, is generally sized to overlap a majority of surface area of the rear surface of the upper back cavity. Plate 190 may be constructed from metal, polymer or a combination of metal and polymer. Preferably, plate 190 is constructed so that it provides vibration damping. Plate 190 is coupled to the rear surface using any attachment method and is preferably coupled using a vibration damping adhesive or double-sided tape.

Plate 190 may also include indicia 198, such as one or more logos, and one or more bumpers 194 may be provided to protect indicia 198 and the outer surface of plate 190. For example, when golf clubs are carried in a bag the heads of the golf clubs often impact each other, which can result in damage. Bumper 194 extends rearward from a rear, outer surface of plate 190 so that bumper 194 is impacted by adjacent club heads rather than the outer surface of plate 190. Bumper 194 is preferably constructed from a material having a lower durometer value than plate 190 that is resistant to damage caused by impact. In an example, a plurality of bumpers 194 are provided that are constructed from polyurethane or another soft material, preferably with a durometer value in a range of Shore A30 to Shore A110.

Support extension 192 of back plate 176 extends from plate 190 and covers at least a portion of the gap between face support 180 and back flange 182. As shown, support extension 192 extends across the gap from face support 180 to back flange 182. Preferably, support extension 192 is constructed from a material having a density lower than the material of main body 172 so that mass from the middle of main body 172 may be moved to lower the center of gravity and/or to increase the moment of inertia of club head 170. In embodiments utilizing a steel main body 172, materials that may be used for a lower density support extension 192 include plastics, carbon fiber composites, aluminum, magnesium, titanium, etc.

Figure 27:
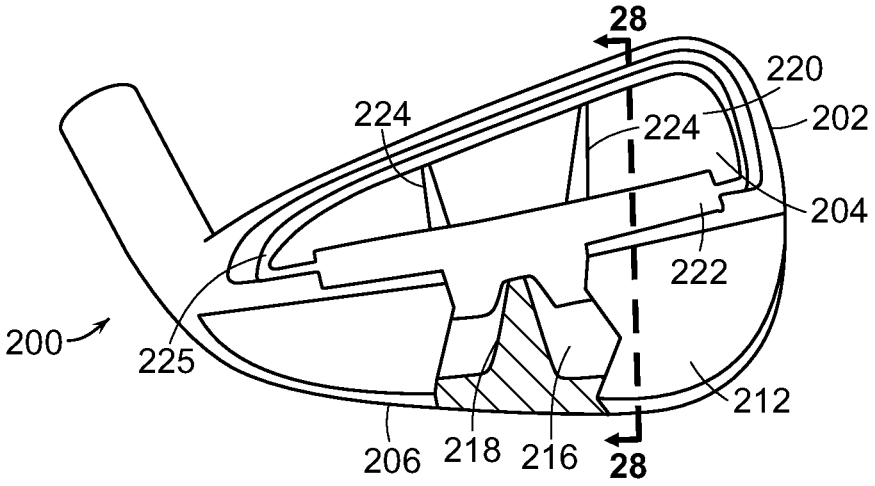
FIG. 27 is a rear view of a hollow iron-type golf club in accordance with the present invention.
Figure 28:
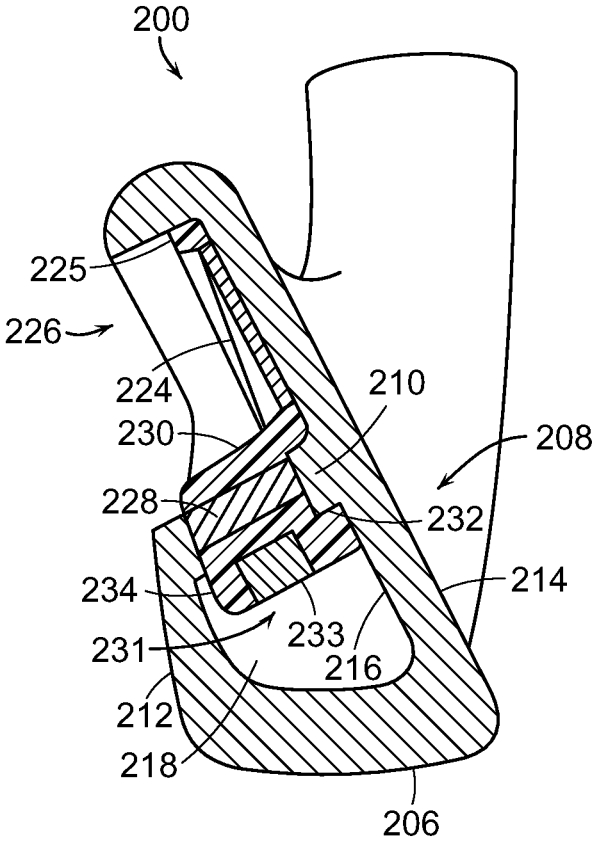
FIG. 28 is a cross-sectional view along line 28-28 of FIG. 27.

Another embodiment of the golf club head of the present invention is illustrated in FIGS. 27 and 28. Golf club head 200 includes a main body 202 and a back plate 204. Main body 202 includes a sole 206, a hitting face 208, a face support 210 and a back flange 212. Hitting face 208 includes a front, ball-striking surface 214 and a rear surface 216 that is opposite the ball-striking surface 214. Face support 210 extends from rear surface 216 generally toward back flange 212. Face support 210 extends a distance between hitting face 208 and back flange 212 so that there is a gap between face support 210 and back flange 212. Main body 202 also includes a rib 218 that extends between hitting face 208, back flange 212 and sole 206. Rib 218 extends upwardly from sole 206 approximately to face support 210. The heel to toe dimension of rib 218 is preferably 0.04-0.50 inch and the height of rib 218 from an upper surface of sole 206 is preferably 0.1-1.5 inch. Rib 218 may form a partition that divides a lower cavity of club head 200.

Back plate 204 includes a plate 220, a support extension 222, optional bumpers 224 and a ring member 225. Plate 220 is coupled to a rear surface of an upper back cavity 226 of main body 202 and is generally sized to overlap a majority of surface area of the rear surface of upper back cavity 226. Plate 220 may be constructed from metal, polymer or a combination of metal and polymer. Preferably, plate 220 is constructed so that it provides vibration damping and may include indicia. Plate 220 is coupled to the rear surface using any attachment method and is preferably coupled using a vibration damping adhesive or double-sided tape. One or more bumpers 224 may be provided to protect outer surface of plate 220. Additionally, ring member 225 is provided on a perimeter edge of plate 220 and may extend to a rear surface of plate 220. Ring member 225 and bumpers 224 are constructed from a soft material, such as thermoplastic polyurethane, thermoplastic rubber, rubber, and/or thermoplastic elastomer having a durometer value in a range of Shore A30 to Shore A110, and preferably approximately Shore A60, so that bumpers 224 provide protection and so that ring member 225 forms to the shape of main body 202. Ring member 225 is preferably co-molded with plate 220.

Support extension 222 of back plate 204 extends from plate 220 and covers at least a portion of the gap between face support 210 of main body 202 and back flange 212. In particular, support extension 222 extends across and into the gap between face support 210 and back flange 212 generally from face support 210 of main body 202 to back flange 212 and includes a multi-material construction. The multi-material construction provides numerous advantages, which include the ability to fine tune the structural support provided by the back flange to the hitting face, the ability to tune the vibration response of the hitting face and the ability to prevent debris and moisture from entering the lower cavity. Preferably, the interface between support extension 222, face support 210 and back flange 212 provides a seal that is adequate to prevent intrusion of water into the lower cavity when club head is submerged in greater than six inches of water at temperatures greater than 32° F. The multi-material construction is utilized to increase the rigidity of the softer material used in the support while still being capable of sealing against the support of the main body and the back flange. In particular, support extension 222 includes an insert in the form of bar 228 that is at least partially embedded in a body 230.

Bar 228 may be inserted into a cavity of body 230, co-molded with body 230, or attached to an outer surface of body 230. Preferably, bar 228 is co-molded with body 230 so that in the assembled club head 200 bar 228 generally extends between face support 210 and back flange 212 while body 230 maintains bar 228 in that orientation and location. Bar 228 is preferably constructed from a material that is more rigid than the material of body 230. For example, bar 228 may be constructed from aluminum, titanium, steel, magnesium and/or carbon fiber composite; while body 230 is constructed from polyurethane, thermoplastic elastomer, rubber, etc. Bar 228 may be solid or it may be formed as a truss, or framework. The material of bar 228 and body 230 may also be selected to provide different weights so that the overall weight of club head 200 may be maintained within a predetermined weight tolerance or to provide a golf club with a desired swing weight. Furthermore, one or more cavities 231 configured to receive one or more weight inserts 233 so that the overall weight of club head 200 may be easily adjusted. The insert may be constructed from a loaded polymer, such as tungsten loaded polyurethane, or a metal, such as tungsten, stainless steel, carbon steel, titanium, etc.

In the present embodiment, body 230 includes a channel 232 that receives and seals against face support 210 of main body and an abutment surface 234 that abuts and seals against an inner surface of back flange 212. The receipt of face support 210 within channel 232 and the abutment of abutment surface 234 with back flange 212 seals the lower cavity against intrusion of debris and moisture. It should be appreciated that body 230 may include a channel on the side adjacent back flange 212 that is configured to receive a feature included on back flange 212 to provide a further seal. Additionally, channel 232 may be replaced in whole or in part by an abutment surface that forcible abuts face support 210 after assembly to provide a seal.

Figure 29:
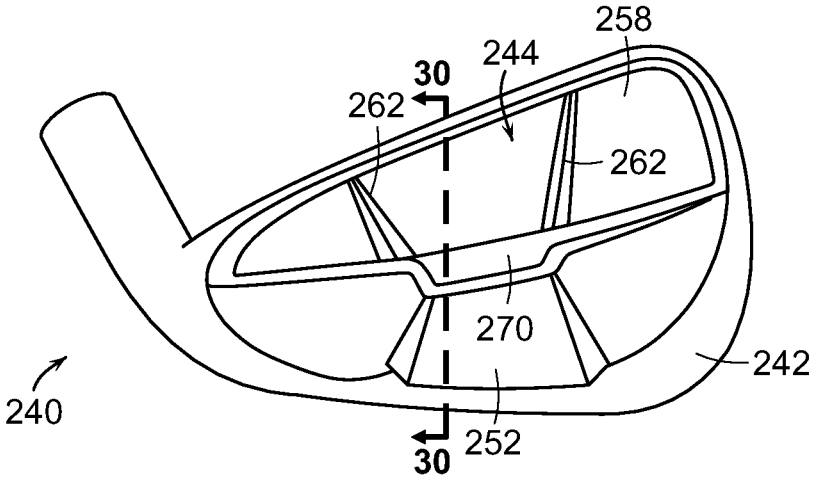
FIG. 29 is a rear view of a hollow iron-type golf club in accordance with the present invention.
Figure 30:
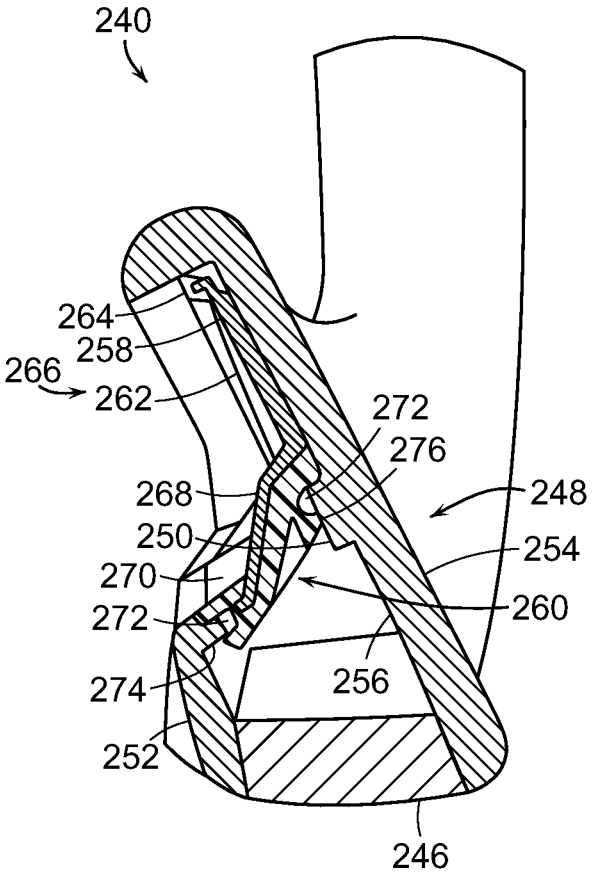
FIG. 30 is a cross-sectional view along line 30-30 of FIG. 29.

Another embodiment of the golf club head of the present invention including a back plate having a multi-material construction is illustrated in FIGS. 29 and 30. Golf club head 240 includes a main body 242, a multi-material back plate 244 and a sole insert 246. Main body 242 includes a hitting face 248, a face support 250 and a back flange 252. Hitting face 248 includes a front, ball-striking surface 254 and a rear surface 256 that is opposite the ball-striking surface 254. Face support 250 extends from rear surface 256 generally toward back flange 252. Face support 250 extends a distance between hitting face 248 and back flange 252 so that there is a gap between face support 250 and back flange 252.

Similar to previously described embodiments, back plate 244 includes a plate 258, a support extension 260, optional bumpers 262 and a ring member 264. Plate 258 is coupled to a rear surface of an upper back cavity 266 of main body 242 and is constructed from a combination of metal and polymer materials. For example, back plate 244 is constructed from an aluminum frame member 268 that is co-molded with polyurethane. Bumpers 262 are also included to protect back plate 244 from damage and ring member 264 is included so that a there is a flexible interface between the perimeter of upper back cavity 266 and back plate 244. Bumpers 262 and ring member 264 may be integrated into the co-molded construction or they may be separate components that are coupled to plate 244. In a co-molded embodiment, portions of frame 268 may include perforations that allow a softer material to flow through and to be coupled to frame 268.

Support extension 260 of back plate 244 extends from plate 258 and covers at least a portion of the gap between face support 250 of main body 242 and back flange 242 and includes a portion of frame 268 and a body 270. Support extension 260 extends across and into the gap between face support 250 and back flange 252 generally from face support 250 of main body 242 to back flange 252. A portion of frame 268 extends into support extension 260 and is at least partially embedded in support extension 260. Frame 268 is preferably constructed from a material that is more rigid than the material of body 270. For example, frame 268 may be constructed from aluminum, titanium, steel, magnesium and/or carbon fiber composite; while body 270 is constructed from polyurethane, thermoplastic elastomer, rubber, etc. Frame 268 and body 270 may be solid or formed as a truss, or framework. The materials of frame 268 and body 270 may also be selected to provide different weights so that the overall weight of club head 240 may be maintained within a predetermined weight tolerance or to provide a golf club with a desired swing weight.

Body 270 includes a channel 272 that receives and seals against a shelf 274 included on back flange 252 and an abutment surface 276 that abuts and seals against face support 250. As shown, channel 272 may extend around body 270 so that it is also located in abutment surface 276 and may be used to provide space for bonding material such as epoxy. Preferably, the interface between support extension 260, face support 250 and back flange 252 provides a seal that is adequate to prevent intrusion of water into the lower cavity when club head is submerged in greater than six inches of water at temperatures greater than 32° F.

Figure 31:
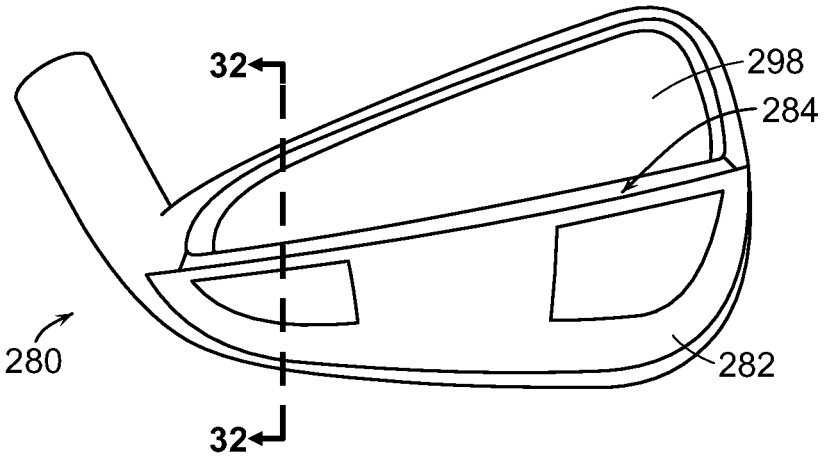
FIG. 31 is a rear view of a hollow iron-type golf club in accordance with the present invention.
Figure 32:
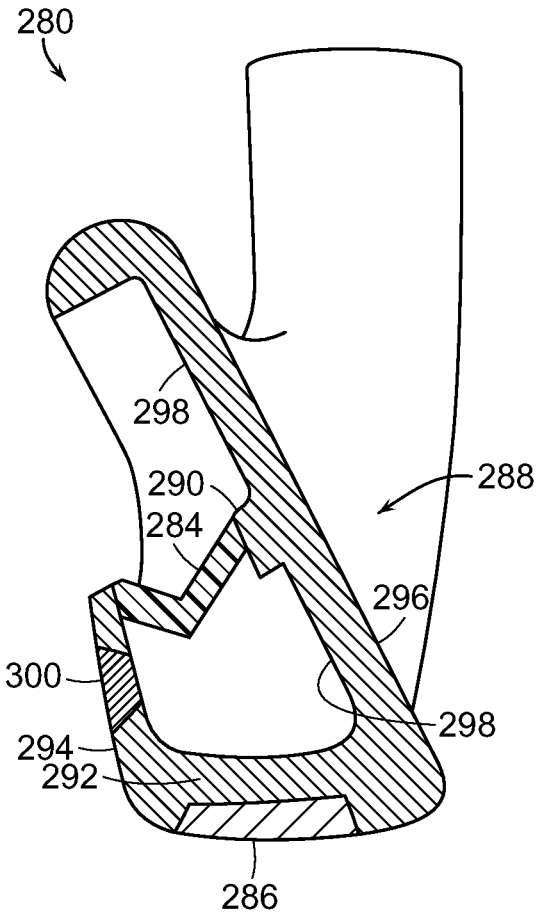
FIG. 32 is a cross-sectional view along line 32-32 of FIG. 31.

Referring to FIGS. 31 and 32, a golf club head 280 includes a main body 282, a support extension 284 and a sole insert 286. Main body 282 includes a hitting face 288, a face support 290, a sole 292 and a back flange 294. Hitting face 288 includes a front, ball-striking surface 296 and a rear surface 298 that is opposite the ball-striking surface 296. Face support 290 extends from rear surface 298 generally toward back flange 294. Face support 290 extends partially between hitting face 288 and back flange 294 so that there is a gap between face support 290 and back flange 294.

Sole 292 of main body 282 includes a recess that receives sole insert 286. Sole insert 286 is coupled to sole 292 so that there is no relative movement therebetween during use of golf club head 280. Sole insert 286 may be coupled to sole 292 using any attachment method, such as adhesive bonding, welding, brazing, swaging, etc., and sole insert 286 may be constructed of any metallic or non-metallic material. Preferably, sole insert 286 is constructed from tungsten or a tungsten alloy to concentrate mass low on the golf club head. It should be appreciated however that sole insert 286 may be constructed from a lightweight material so that mass may be concentrated toward the heel and/or toe of golf club head 280 to increase moment of inertia.

Additionally, golf club head 280 includes a plurality of back flange inserts 300. Back flange inserts 300 are coupled to back flange 294 and may be constructed from any metallic or non-metallic material and may be attached to back flange 294 by any coupling process. In an embodiment, back flange inserts 300 are constructed from tungsten or a tungsten alloy that are welded to back flange 294.

In the present embodiment, support extension 284 is provided that is a separate component rather than being a portion of a back plate. Support extension 284 extends across and into the gap between face support 290 and back flange 294 generally from face support 290 of main body 282 to back flange 294. Support extension 284 may be constructed from any metallic or non-metallic material, but is preferably constructed from a lightweight rigid material such as aluminum, titanium, magnesium and/or carbon fiber composite.

Figure 33:
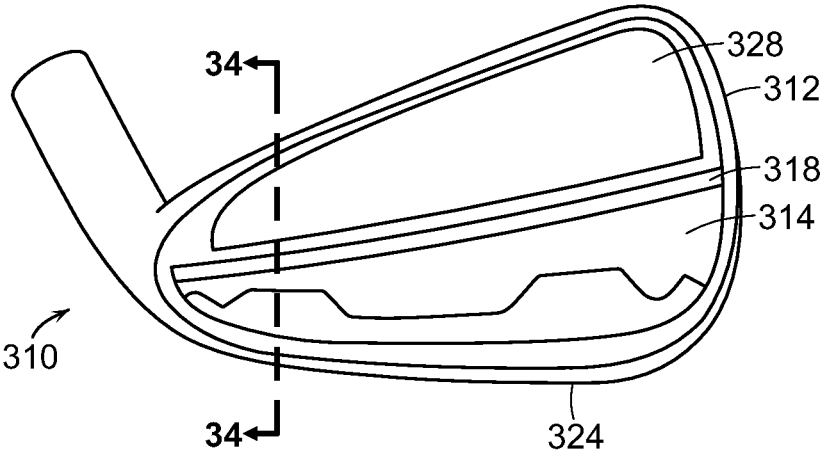
FIG. 33 is a rear view of a hollow iron-type golf club in accordance with the present invention.
Figure 34:
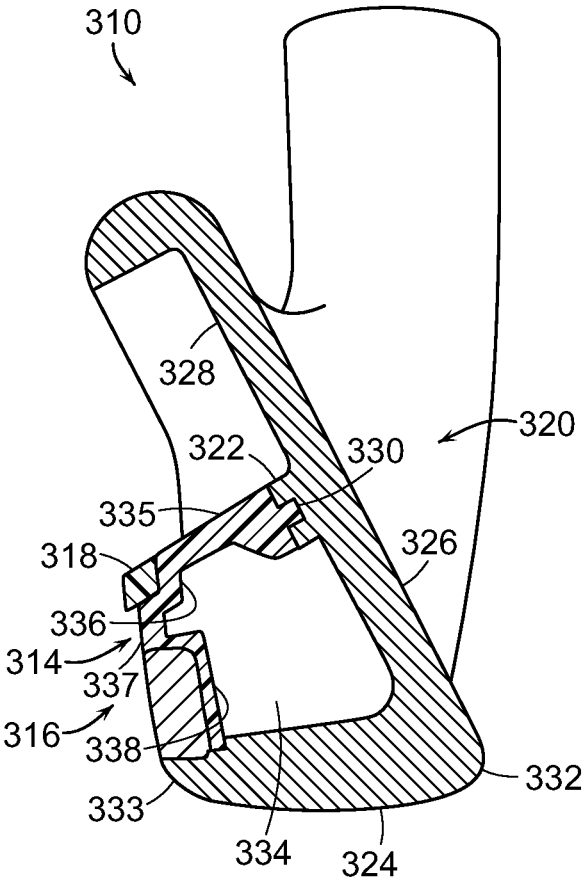
FIG. 34 is a cross-sectional view along line 34-34 of FIG. 33.

In another example, shown in FIGS. 33 and 34, golf club head 310 includes main body 312, a frame 314, a back flange insert 316 and an optional bumper insert 318. In club head 310, frame 314 forms a support extension and a back flange of the club head and supports back flange insert 316 and bumper insert 318. Main body 312 generally includes a hitting face 320, a face support 322 and a sole 324. Hitting face 320 includes a front, ball-striking surface 326 and a rear surface 328 that is opposite the ball-striking surface 326. Face support 322 extends rearward from rear surface 328 and includes a channel 330. Sole 324 extends rearward from a lower edge of hitting face 320 where it forms a leading edge 332.

Frame 314 extends from a rear end of sole 324 adjacent a trailing edge 333 to face support 322, so that it combines with main body 312 to define a lower cavity 334. Frame 314 includes a support extension portion 335 and a back flange portion 337, and is contoured so that it defines a bumper recess 336 and a back flange insert recess 338. In the present embodiment, frame 314 has a generally L-shape cross-sectional shape, as shown in FIG. 34, and bumper recess 336 is located at a rear corner of frame 314. Bumper recess 336 may extend along any portion of the heel to toe length of frame 314. Bumper insert 318 is dimensioned so that a portion of bumper insert 318 is received in bumper recess 336 and coupled to frame 314 while another portion of bumper insert 318 extends outward from an outer surface of the adjacent portions of frame 314 so that bumper insert 318 protects club head 310 from damage. Bumper insert 318 is constructed from a soft material, such as thermoplastic polyurethane, thermoplastic rubber, rubber, and/or thermoplastic elastomer having a durometer value in a range of Shore A30 to Shore A110, and preferably approximately Shore A60.

Back flange insert 316 is disposed within back flange insert recess 338 and coupled to frame 314. Back flange insert 316 is preferably constructed of a material that has a greater density than frame 314 and preferably that has a density greater than main body 312. In an example, back flange insert 316 is constructed from tungsten or a tungsten alloy and includes heel and toe weight concentrated portions.

Figure 35:
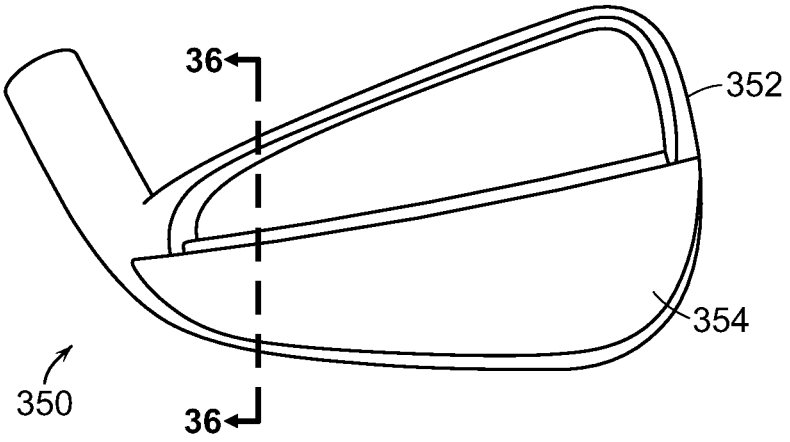
FIG. 35 is a rear view of a hollow iron-type golf club in accordance with the present invention.
Figure 36:
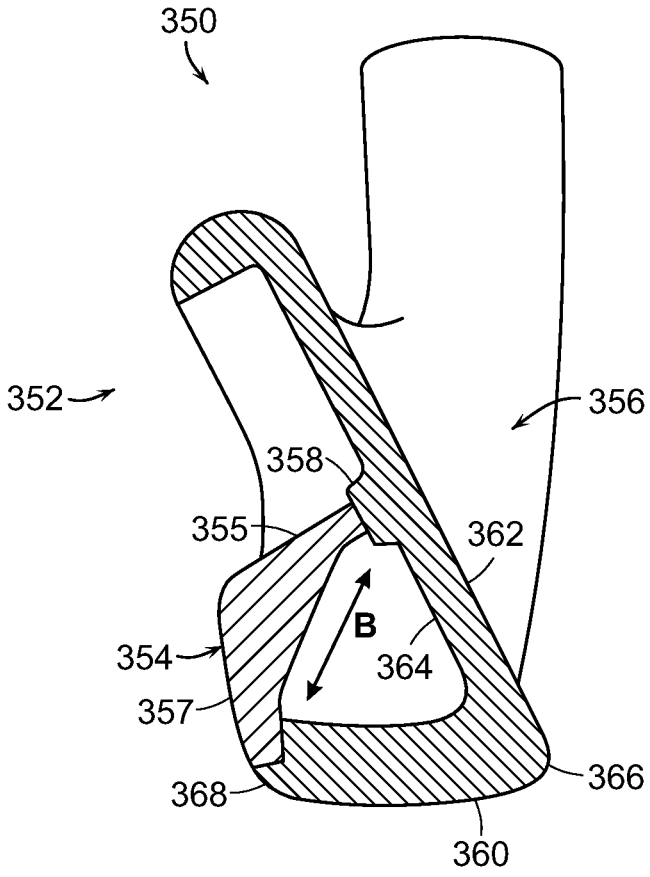
FIG. 36 is a cross-sectional view along line 36-36 of FIG. 35.

In some embodiments of the present invention, the support extension and the back flange are configured to apply a force to the rear side of the hitting face. Referring to FIGS. 35 and 36, golf club head 350 includes main body 352 and a frame 354. In club head 350, frame 354 forms a support extension 355 and a back flange 357 of the club head. Main body 352 generally includes a hitting face 356, a face support 358 and a sole 360. Hitting face 356 includes a front, ball-striking surface 362 and a rear surface 364 that is opposite the ball-striking surface 362. Face support 358 extends rearward from rear surface 364. Sole 360 extends rearward from a lower edge of hitting face 356 where it forms a leading edge 366 of golf club head 350.

During manufacture, main body 352 is cast or forged and frame 354 is subsequently attached thereto. Prior to attaching frame 354 to main body 352 a force is applied to main body 352, as shown by arrow B, so that a trailing edge 368 is spaced further from face support 358 than when main body 352 is in a free state. Frame 354 is attached between sole 360 and face support 358 while the force is applied and frame 354 is dimensioned to maintain the forced relationship between face support 358 and sole so that frame 354 is placed in compression in the assembled golf club head 350 and thereby applying a pre-load to the rear of hitting face 356.

Figure 37:
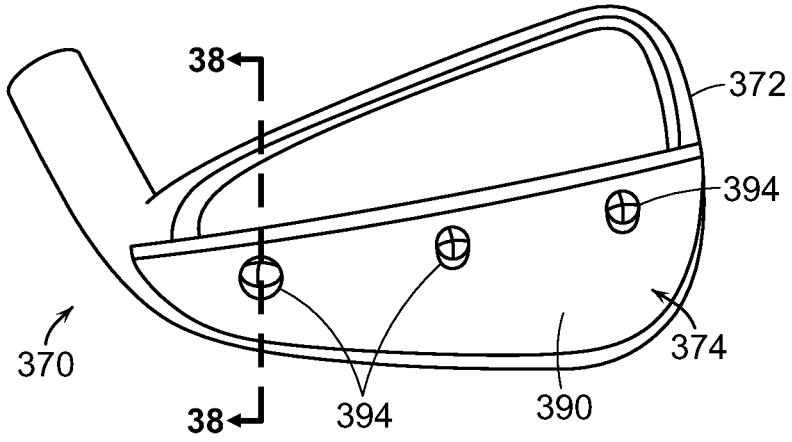
FIG. 37 is a rear view of a hollow iron-type golf club in accordance with the present invention.
Figure 38:
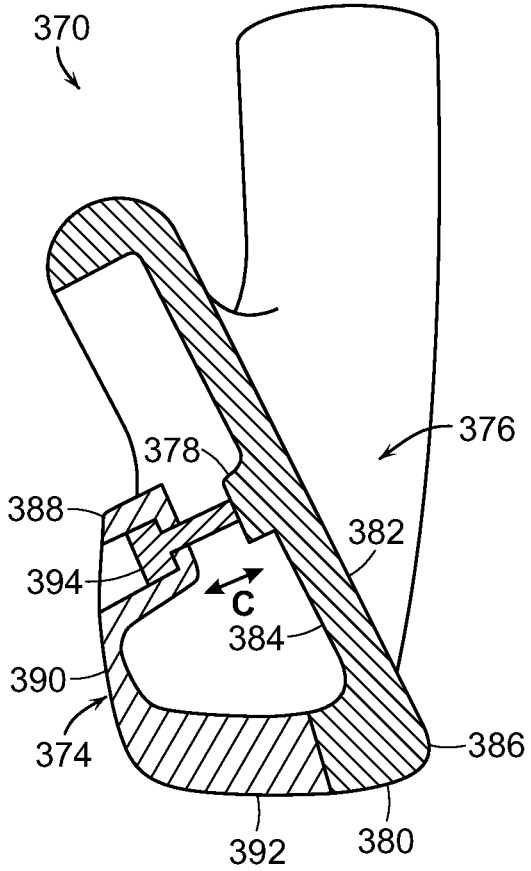
FIG. 38 is a cross-sectional view along line 38-38 of FIG. 37.

Referring to FIGS. 37 and 38, golf club head 370 includes main body 372 and a frame 374. Main body 372 generally includes a hitting face 376, a face support 378 and a sole portion 380. Hitting face 376 includes a front, ball-striking surface 382 and a rear surface 384 that is opposite the ball-striking surface 382. Face support 378 extends rearward from rear surface 384. Sole portion 380 extends rearward from a lower edge of hitting face 376 where it forms a leading edge 386 of golf club head 370.

In club head 370, frame 374 forms a support extension 388, a back flange 390 and a sole portion 392 of the club head. At least one extension member 394 is coupled to support extension 388 and abuts face support 378 so that force is applied to main body 372, as shown by arrow C. Extension member 394 is preferably movably coupled to support extension 388 so that an adjustable amount of force may be placed upon face support 378. As shown, club head 370 includes a plurality of extension members 394 that are threaded so that the force applied to face support 378 is adjustable. Frame 374 may be coupled to main body 372 using any coupling method, such as welding, brazing, adhesive bonding, etc., and the main body 372 and frame 374 may be constructed from any metallic or non-metallic material.

Figure 39:
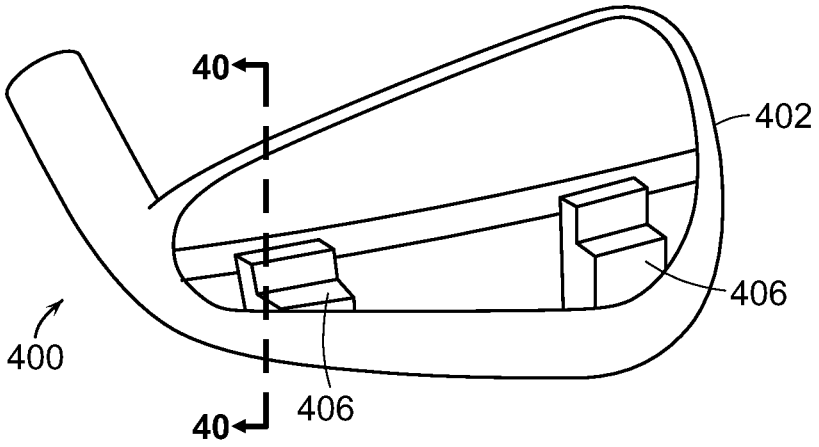
FIG. 39 is a rear view of a hollow iron-type golf club in accordance with the present invention.
Figure 40:
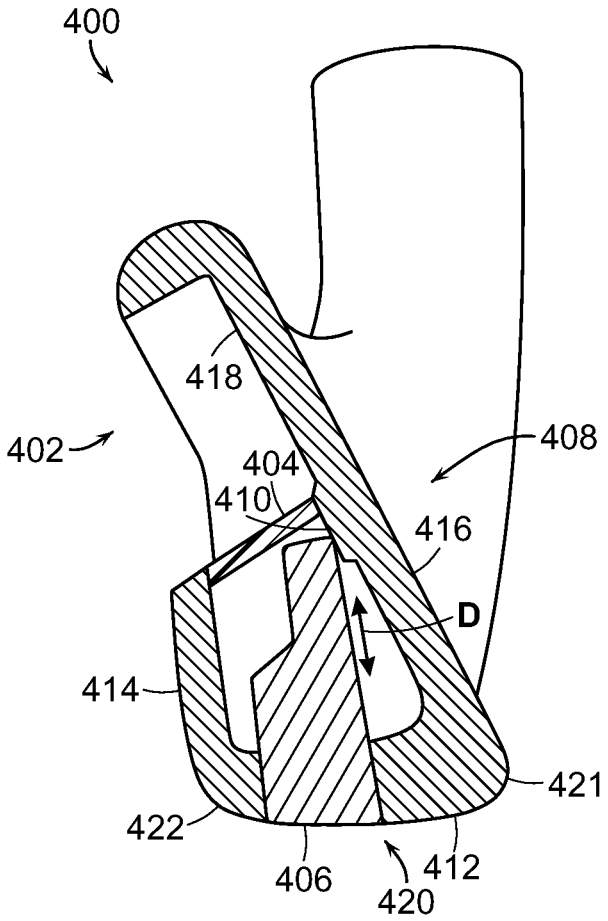
FIG. 40 is a cross-sectional view along line 40-40 of FIG. 39.

In another embodiment, shown in FIGS. 39 and 40, golf club head 400 includes main body 402, a support extension 404 and a plurality of truss inserts 406. Main body 402 generally includes a hitting face 408, a face support 410, a sole 412 and a back flange 414. Hitting face 408 includes a front, ball-striking surface 416 and a rear surface 418 that is opposite the ball-striking surface 416. Face support 410 extends rearward from rear surface 418. Sole 412 extends rearward from a lower edge of hitting face 408, where it forms a leading edge 421 of golf club head 400, to a lower end of back flange 414, where it forms a trailing edge 422 of golf club head 400.

Truss inserts 406 extend from sole 412 to face support 410 and abut face support 410 so that a force is applied in the direction shown by arrow D. As a result, each of truss inserts 406 is placed in compression. In the present embodiment, an aperture 420 is provided for each truss insert 406 that extends through sole 412 so that a lower surface of truss insert 406 is generally flush with the outer surface of sole 412. Truss insert 406 is coupled to sole 412 by any coupling method such as welding, brazing, adhesive bonding, etc. As a further feature, indicia may be provided on the lower surface of truss insert 406. Support extension 404 may extend between face support 410 and back flange 414 to provide a cover to truss inserts 406 and to enclose a lower cavity of golf club head 400.

Figure 41:
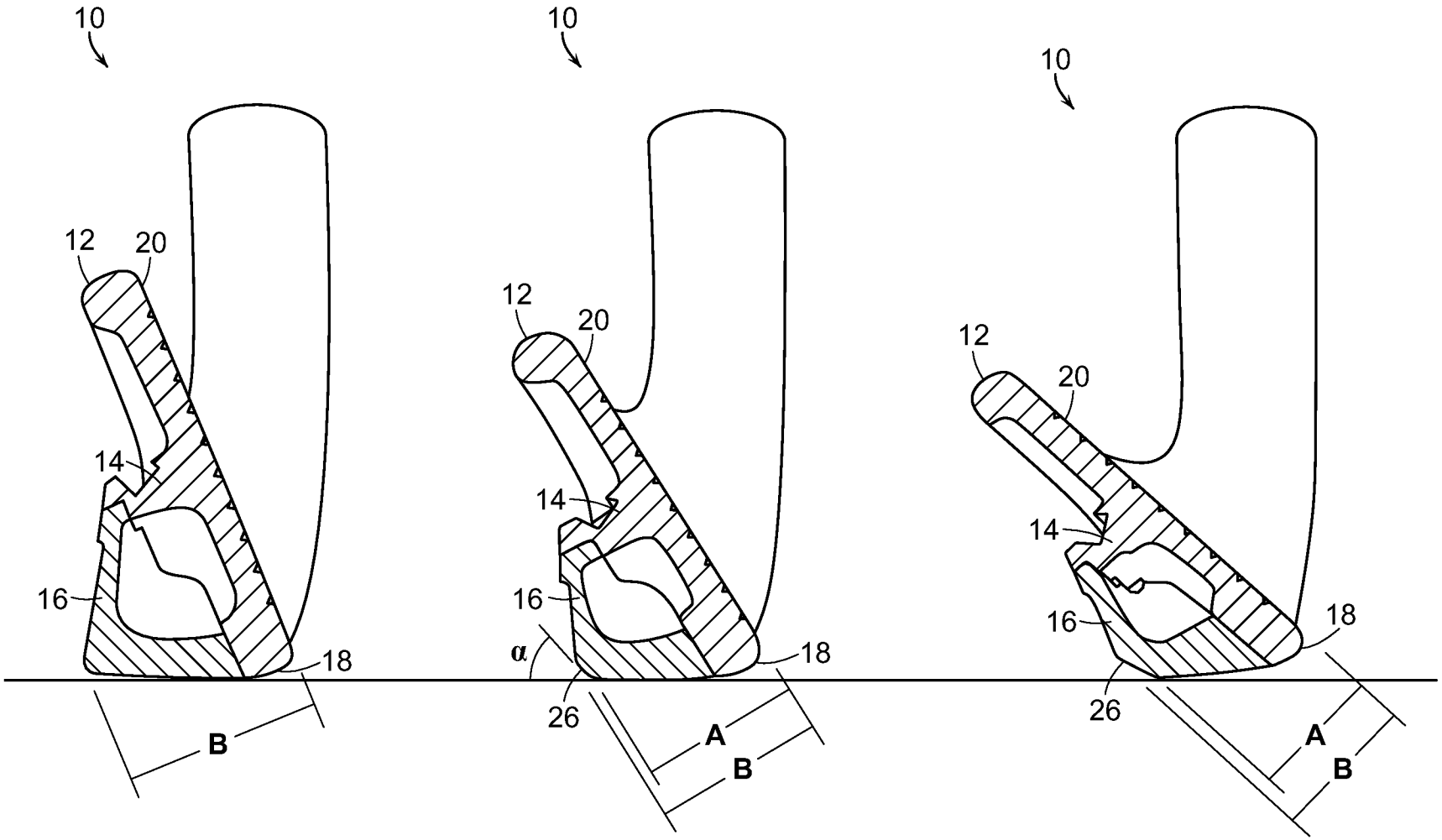
FIG. 41 illustrates cross-sectional views, generally corresponding to line 4-4 of FIG. 1, of golf club heads according to an aspect of the present invention.
Figure 42:
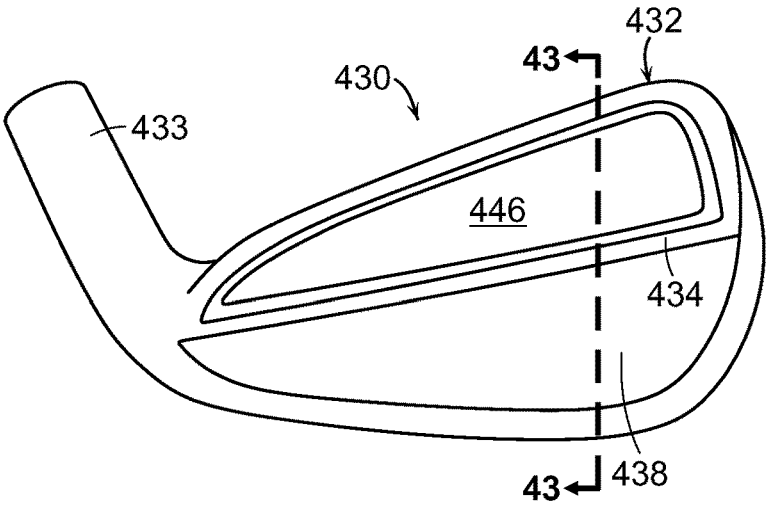
FIG. 42 is a rear view of a hollow iron-type golf club in accordance with the present invention.
Figure 43:
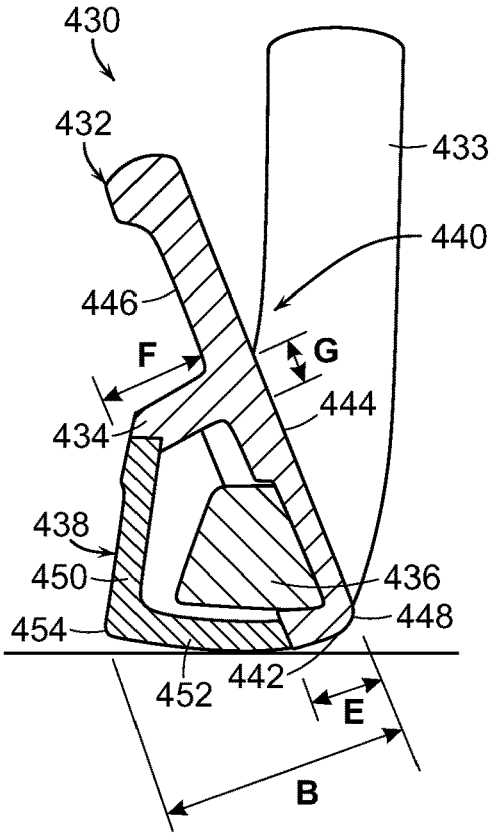
FIG. 43 is a cross-sectional view along line 43-43 of FIG. 42.
Figure 44:
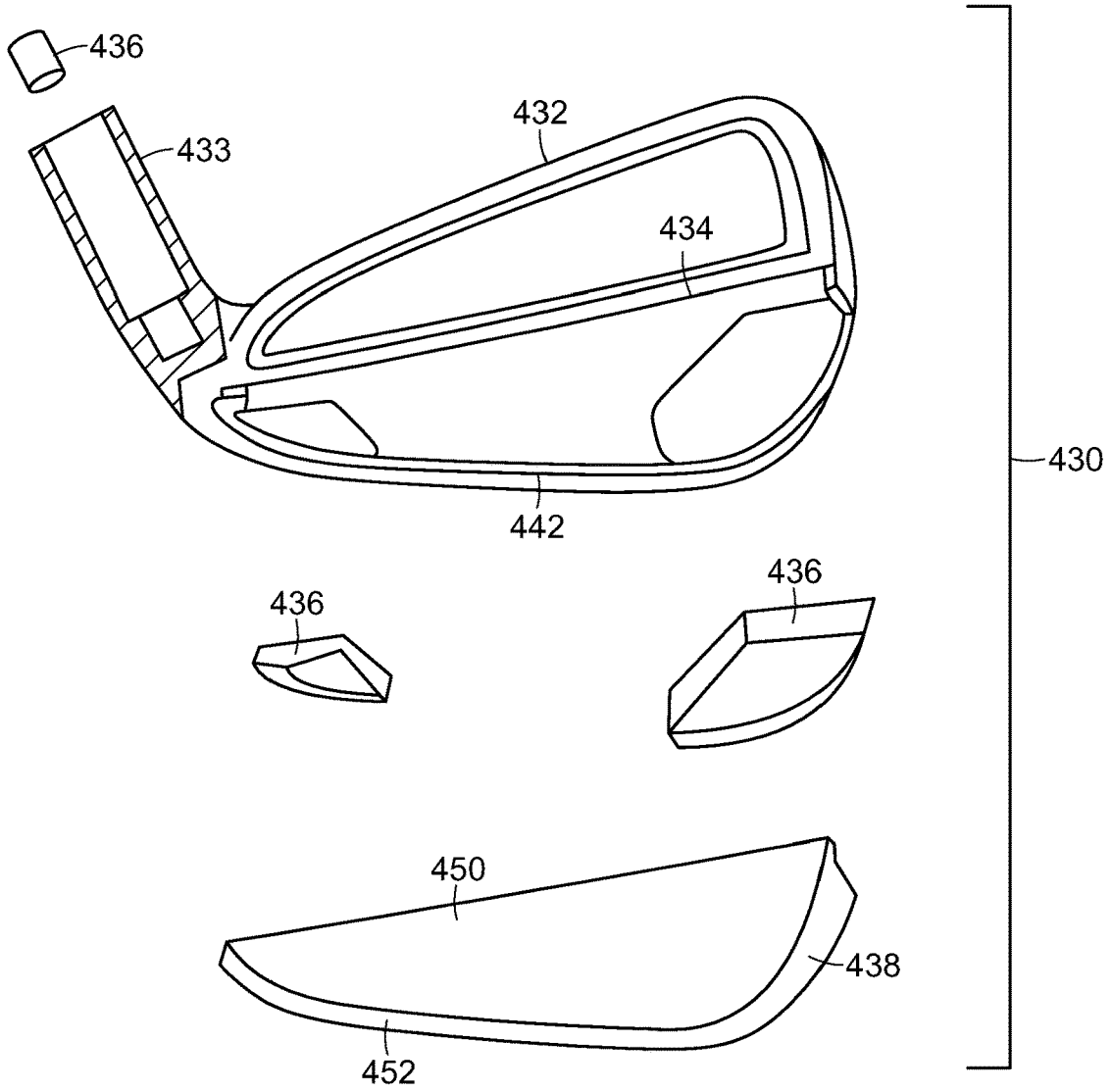
FIG. 44 is an exploded view of the golf club of FIG. 42.
Figure 45:
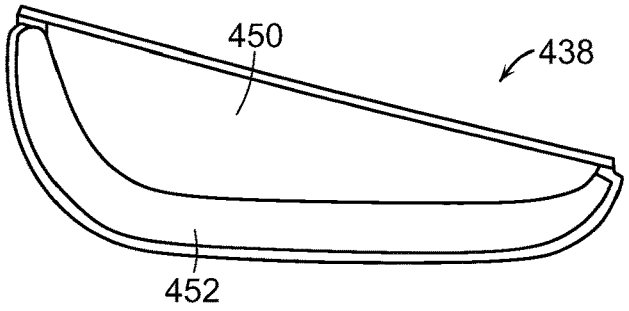
FIG. 45 is a perspective view of a muscle back shell of FIG. 42.

Referring to FIG. 41, each of the golf club heads 10 comprises club head main body 12 including support 14, and muscle back shell 16. Support 14 and partial sole 18 of club head main body 12 are sized and dimensioned to fit flush with muscle back shell 16.

Throughout an inventive set of golf clubs the location of the center of gravity may be altered to provide desired launch characteristics. For example, the height of the center of gravity is increased from the long clubs to the short clubs so that the higher ball flight caused by the increased loft angle of the short clubs may be at least partially counteracted and to provide a more efficient transfer of energy from the golf club to the golf ball during impact. The raised center of gravity may be achieved by reducing a fore-aft length (i.e., the width) of the muscle portion of the club head as measured perpendicularly from the striking face.

Golf club head 10 also includes a trailing edge sole chamfer 26 that intersects the sole and alters the width of the sole. In particular, the overall width B of the sole is altered by chamfer 26 so that the sole has an effective width A between a forward edge of chamfer 26 (i.e., an edge of chamfer 26 closest to face 20) and the leading edge of the golf club, that is shorter than the overall sole width B. In sets including golf club heads with a trailing edge sole chamfer in only a portion of the set, those clubs lacking a trailing edge sole chamfer include an overall sole width B that equals the effective sole width A.

The dimensions of the chamfer may be progressive throughout a set of golf clubs including golf club head 10 to provide a more playable sole and to provide short clubs with an effectively narrower sole. For example, the dimensions of chamfer 26 can have a predetermined change in dimension, such as width or chamfer angle, based on a ratio of the sole width or bounce, or the change may be based on a predetermined incremental change in the chamfer width dimension throughout the set, or the change may be based on a desired effective sole length. Alternatively, chamfer 26 may have a width that is kept constant and the sole width selected to provide a desired progressive effective sole width.

Additionally, the trailing edge sole chamfer defines a chamfer angle $\alpha$ relative to a 0° bounce reference plane, i.e., a theoretical non-compressible ground plane with the golf club oriented at the designed loft, for each club. The chamfer angle $\alpha$ may change throughout the set. Preferably, angle $\alpha$ is less than or equal to the complementary angle of the loft angle of a particular golf club head (i.e., $\alpha<(90-\text{loft angle})$), and more preferably angle $\alpha$ is less than about 50°. In an embodiment, the chamfer angle $\alpha$ progressively decreases from the long club to the short club in the set.

As shown in the following tables, the trailing edge sole chamfer may be varied throughout a set of iron-type golf clubs so that the long irons have the smallest, or no chamfer, and the short irons have the largest chamfer. In alternative embodiments, the golf club heads have sole width that are sized progressively through the set so that they get progressively smaller through the set from the long irons to short irons, and in such a set the trailing edge chamfer may be held constant throughout to provide the desired progressive sole characteristics. The measurements below display the effective sole width A, the overall sole width B and the chamfer width C of various inventive golf club sets; and correspond to measurements taken in a plane extending through the face center location on the golf club head in a fore-aft direction.

TABLE 1

Sole Chamfer-Mid Size Sole

| | Mid Size 1 | | | Mid Size 2 | | | Mid Size 3 | | |
|---|---|---|---|---|---|---|---|---|---|
| Iron # | A | B | C | A | B | C | A | B | C |
| 2 | 0.690 | 0.690 | 0 | 0.650 | 0.690 | 0.04 | 0.660 | 0.690 | 0.03 |
| 3 | 0.685 | 0.685 | 0 | 0.645 | 0.685 | 0.04 | 0.655 | 0.685 | 0.03 |
| 4 | 0.680 | 0.680 | 0 | 0.640 | 0.680 | 0.04 | 0.650 | 0.680 | 0.03 |
| 5 | 0.655 | 0.675 | 0.02 | 0.635 | 0.675 | 0.04 | 0.635 | 0.675 | 0.04 |
| 6 | 0.650 | 0.670 | 0.02 | 0.630 | 0.670 | 0.04 | 0.630 | 0.670 | 0.04 |
| 7 | 0.645 | 0.665 | 0.02 | 0.625 | 0.665 | 0.04 | 0.625 | 0.665 | 0.04 |
| 8 | 0.630 | 0.660 | 0.03 | 0.620 | 0.660 | 0.04 | 0.610 | 0.660 | 0.05 |
| 9 | 0.625 | 0.655 | 0.03 | 0.615 | 0.655 | 0.04 | 0.605 | 0.655 | 0.05 |
| P | 0.610 | 0.650 | 0.04 | 0.610 | 0.650 | 0.04 | 0.590 | 0.650 | 0.06 |
| W | 0.605 | 0.645 | 0.04 | 0.605 | 0.645 | 0.04 | 0.585 | 0.645 | 0.06 |

TABLE 2

Sole Chamfer-Over Size Sole

| | Over Size 1 | | | Over Size 2 | | | Over Size 3 | | |
|---|---|---|---|---|---|---|---|---|---|
| Iron # | A | B | C | A | B | C | A | B | C |
| 2 | 0.800 | 0.800 | 0 | 0.760 | 0.800 | 0.04 | 0.770 | 0.800 | 0.03 |
| 3 | 0.792 | 0.792 | 0 | 0.752 | 0.972 | 0.04 | 0.762 | 0.792 | 0.03 |
| 4 | 0.784 | 0.784 | 0 | 0.744 | 0.784 | 0.04 | 0.754 | 0.784 | 0.03 |
| 5 | 0.756 | 0.776 | 0.02 | 0.736 | 0.776 | 0.04 | 0.736 | 0.776 | 0.04 |
| 6 | 0.748 | 0.768 | 0.02 | 0.728 | 0.768 | 0.04 | 0.728 | 0.768 | 0.04 |
| 7 | 0.740 | 0.760 | 0.02 | 0.720 | 0.768 | 0.04 | 0.720 | 0.760 | 0.04 |
| 8 | 0.722 | 0.752 | 0.03 | 0.712 | 0.752 | 0.04 | 0.702 | 0.752 | 0.05 |
| 9 | 0.714 | 0.744 | 0.03 | 0.704 | 0.744 | 0.04 | 0.694 | 0.744 | 0.05 |
| P | 0.696 | 0.736 | 0.04 | 0.696 | 0.736 | 0.04 | 0.676 | 0.736 | 0.06 |
| W | 0.688 | 0.728 | 0.04 | 0.688 | 0.728 | 0.04 | 0.668 | 0.728 | 0.06 |

It is also desired to provide a construction that allows for alteration of the moment of inertia of the club head about axes extending through the center of gravity without affecting the size, the overall weight or the location of the center of gravity of the club head. Such a club head provides the same ball flight as previous embodiments after an ideal, on-center, ball strike, but provides a reduced deviation from that ball flight on off-center strikes. As a result, there is less of a penalty for imperfect ball strikes while there is little difference in ball flight when the ball is struck properly. Various embodiments, of such a construction of a club head will be described. The construct provides a golf club head that is unique because it provides a small, workable golf club head that has a moment of inertia that is increased relative to previous heads of the same size to provide greater forgiveness for off-center ball strikes.

An embodiment of the small yet forgiving golf club head is shown in FIGS. 42-45. A club head 430 includes main body 432, a face support 434, a plurality of weight inserts 436 and a muscle back shell 438. The dimensions of muscle back shell 438 and weights 436 are selected so that the location of the center of gravity is maintained in approximately the same location as the embodiment of FIGS. 1-4, while the moment of inertia about the vertical axis extending through the center of gravity may be significantly increased.

Main body 432 generally includes a hosel 433, a hitting face 440, face support 434, and a partial sole 442. Hitting face 440 includes a front, ball-striking surface 444 and a rear surface 446 that is opposite the ball-striking surface 444. Hosel 433 extends from a heel end of main body 432 and is configured to receive, and to be coupled to, a golf club shaft.

Face support 434 is a member that extends rearward from rear surface 446 in a direction generally perpendicular to hitting face 440 a distance D from ball-striking surface 444. Face support 434, is preferably elongate and extends across main body 432 in a generally heel to toe direction and is preferably located within 10 mm of the geometric face center of hitting face 440. More preferably, face support 434 extends generally behind the geometric face center of hitting face 440. The configuration of face support 434 is selected to provide a desired stiffness in the central portion of hitting face 440 so that the vibration behavior of golf club head 430 may be tuned and so that weight may be removed from portions of the face away from the desired impact location. In the present embodiment, the ratio of cross-sectional width, F (i.e., the distance from a rear surface of the face to the furthest aft location on face support 434), to cross-sectional height, G (i.e., the distance in the direction of the striking surface across face support 434), is between about 1:1 and about 4:1, but it is more preferably about 2:1. Additionally, the width F is preferably between about 6 mm and about 15 mm. Height G is preferably between about 1 mm and about 5 mm, but more preferably between about 2 mm and about 3 mm.

Partial sole 442 extends rearward from a lower edge of hitting face 440, where it combines with hitting face 440 to form a leading edge 448 of golf club head 430. Partial sole 442 preferably extends rearward from ball-striking surface 444 a distance E. The distance E is preferably between about 4 mm and about 10 mm. Additionally, distance E is preferably less than about 45% of the overall sole width B of the golf club head. More preferably, distance E is less than about 40% of the overall sole width, and even more preferably less than about 35% of the overall sole width of the club head.

Muscle back shell 438 generally extends between face support 434 and partial sole 442 of main body 432. In particular, it includes a back flange 450 that is coupled to face support 434 and a sole flange 452 that is coupled to partial sole 442. Back flange 450 forms a rearmost portion of club head 430 and extends downward to a trailing edge 454. Sole flange 452 extends rearward from partial sole 442 to trailing edge 454, and provides the majority of the sole, or bounce, surface of club head 430. Preferably, sole flange 452 provides at least about 55% of the bounce surface, and more preferably at least about 60%. Additionally, it is preferable that the lowest point of the bounce surface of club head 430 be located toward trailing edge 454 from the interface between sole flange 452 and partial sole 442. Sole flange 452 is shaped to provide any desired sole contour, such as bounce angle, camber, rails and/or depressions. Additionally, trailing edge 454 may include a beveled, or chamfered, configuration. Muscle back shell 438 is preferably a thin shell constructed from a material that may be easily welded to the material of the main body. For example, if the main body is constructed of steel, it is preferable that the muscle back shell also be constructed of steel and as thin as possible.

Weight inserts 436 are included in club head 430 to alter the physical properties of the club head. In the present embodiment, the plurality of weight inserts 436 includes a heel insert, a toe insert and a hosel insert. The heel and toe inserts are coupled to rear surface 446 of hitting face 440 on heel and toe ends, respectively, below face support 434. Preferably, the heel and toe inserts are coupled to hitting face 440 as close to partial sole 442 and as heel-ward and toe-ward as possible so that the mass is furthest away from the center of gravity of the golf club head as possible. Similarly, the hosel insert is located in the hosel 433 of main body 432 so that it is located as far from the center of gravity as possible and so that a shaft axis of the golf club head intersects the insert. The mass and dimensions of the heel, toe and hosel inserts are selected so that the center of gravity of the golf club is generally maintained at a height from the ground of between about 17.5 mm and about 19.0 mm for an iron-type club having a loft of about 24°. The weight inserts are preferably constructed from a material that has a specific weight that is greater than that of the main body material. For example, the weight inserts may be constructed from tungsten, lead, beryllium copper, tungsten-loaded polymer, etc.

Figure 46:
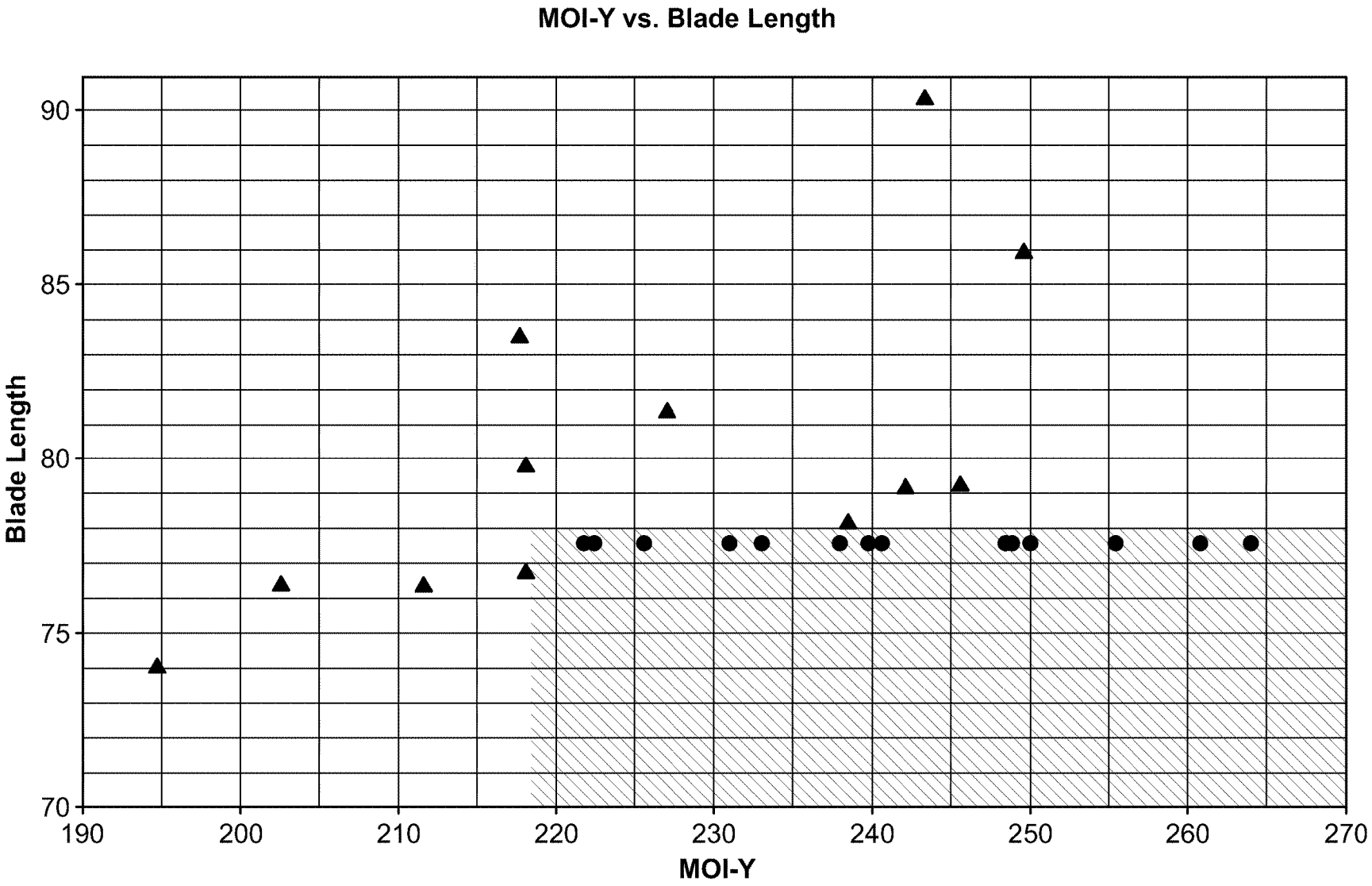
FIG. 46 is a graph illustrating a comparison of features for embodiments of the present invention and comparative examples.
Figure 47:
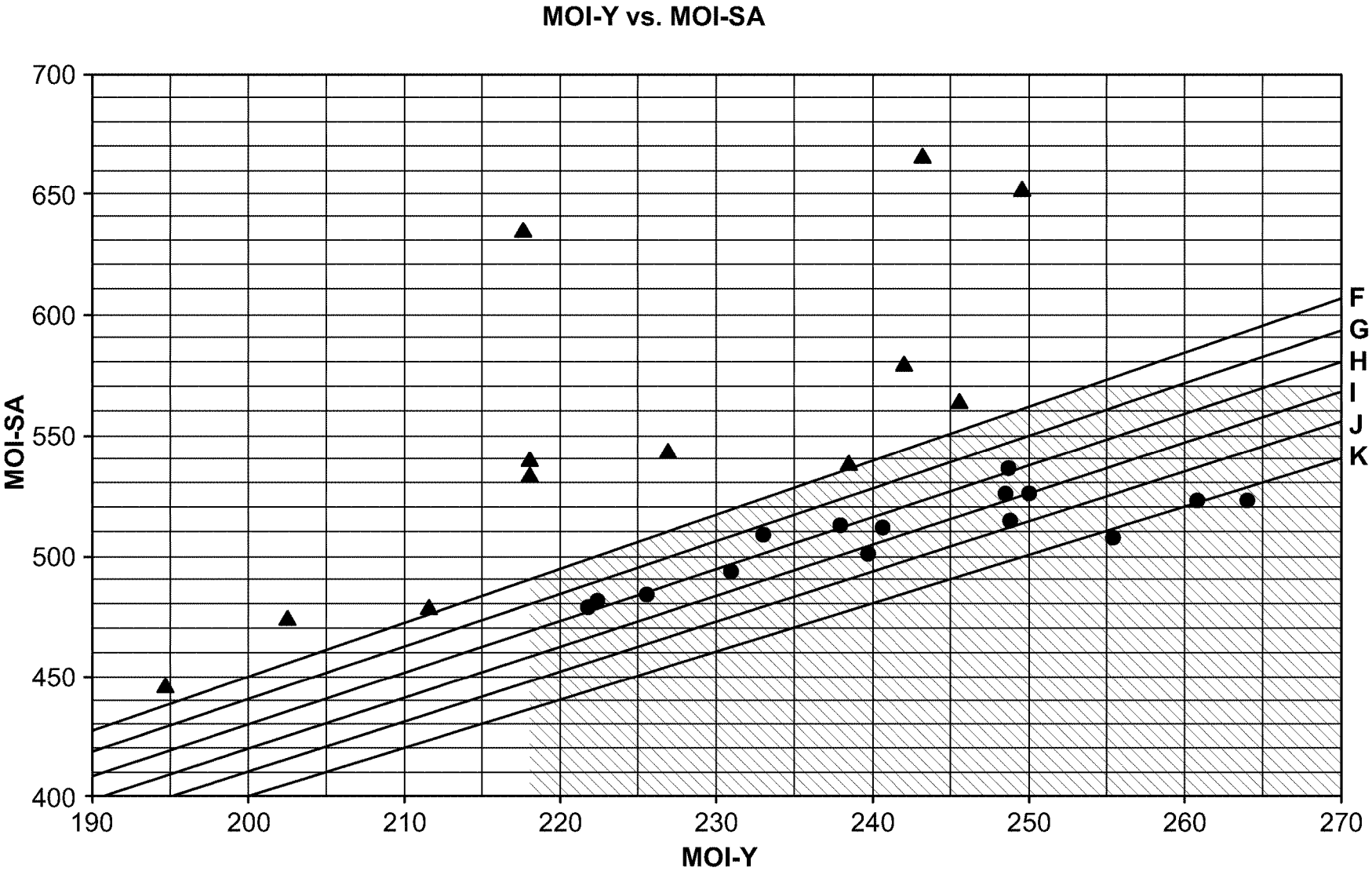
FIG. 47 is a graph illustrating a comparison of features for embodiments of the present invention and comparative examples.

Referring to FIGS. 46 and 47, graphical illustrations of a comparison between long irons, and in particular 4-irons having a loft angle of about 24°, of a plurality of comparative examples and the inventive embodiments described herein are provided, and data for those examples and embodiments is provided in Table 3 below. In both figures, comparative examples are illustrated by triangles and inventive embodiments are illustrated with circular dots. As described above, the inventive golf club provides an improved combination of forgiveness and workability. Workability is improved when the resistance to rotation of the golf club head about the shaft axis is reduced, or maintained relatively low, so that a player may easily position the club head throughout the swing to a desired orientation by rotating it about a shaft axis. By reducing that resistance to rotation about the shaft axis, it becomes easier for a player to combine a desired club head orientation with a desired swing path to create desired launch conditions of a struck golf ball, such as side spin, top spin, launch angle and horizontal aim. The blade length L and the overall weight distribution may be selected to alter the workability. For example, a short blade length will provide a reduced resistance to rotation of the club head about the shaft axis. As used herein, blade length L is the distance along the X-axis of the golf club head as measured between a vertical projection to a ground plane of the most toe-ward location on the golf club head and the intersection of a hosel axis and the ground plane when the golf club head is placed at address, as illustrated in FIG. 1. Additionally, the overall weight distribution may be selected, regardless of the blade length, to reduce the moment of inertia about the shaft axis.

Referring first to FIG. 46, a comparison between blade length and MOI-Y is illustrated. Generally speaking, in previous designs, in order to increase MOI-Y of the golf club head, the blade length was increased. In embodiments of the inventive construction, the blade length was held constant while the MOI-Y was increased. In particular, embodiments of a 4-iron golf club head utilizing the inventive construction yielded MOI-Y values in a range from about 222.4 kg mm2 to about 264.0 kg mm2 while maintaining a blade length of about 77.6 mm. The properties of the embodiments indicates that by utilizing the inventive construction, the blade length can be reduced while maintaining a high MOI-Y, such that the inventive 4-iron would have properties falling within the shaded region shown in FIG. 46.

Referring to FIG. 47, a comparison between MOI-Y and MOI-SA is illustrated, with lines F through K illustrating ratios of MOI-SA to MOI-Y ("R") ranging from 2.25 to 2.00. In particular, line F illustrates an R value of 2.25, line G illustrates an R value of 2.20, line H illustrates an R value of ratio 2.15, line I illustrates an R value of 2.10, line J illustrates an R value of 2.05, and line K illustrates an R value of 2.00. As illustrated in FIG. 47, by using the inventive construction, embodiments of a 4-iron golf club head were constructed having R values less than 2.25 while maintaining MOI-Y values generally greater than 222.4 kg mm2, as shown by the shaded region. In addition, by utilizing the inventive construction, embodiments achieved R values less than 2.15, while the lowest R value provided by the comparative examples was 2.16. Preferably, the inventive golf club of the present invention has an R value less than 2.15, more preferably less than 2.10, and even more preferably less than 2.05.

Figure 48:
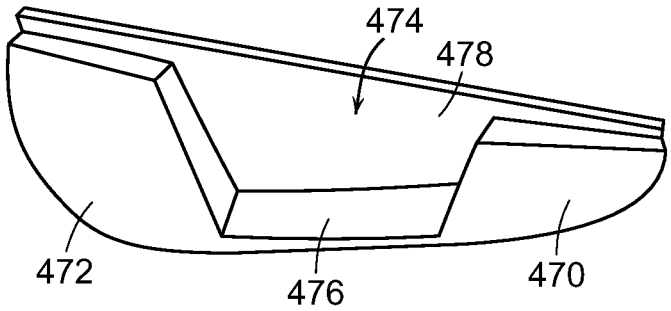
FIG. 48 is a perspective rear view of an alternative embodiment of a muscle back shell.

Referring to FIG. 48, an embodiment of a weighted muscle back shell 468 will be described. Muscle back shell 468 includes a monolithic, homogenous structure with a mass concentrated heel portion 470 and a mass concentrated toe portion 472. A central portion 474 extends between the mass concentrated portions and includes a thin sole wall 476 and a thin back flange wall. Because muscle back shell 468 is constructed as a homogeneous structure, it is constructed of a single material and the thicknesses of localized portions are selected to provide a desired mass distribution. Furthermore, the material of muscle back shell 468 is selected so that it may be easily coupled to the main body, such as by welding or brazing for example.

Figure 49:
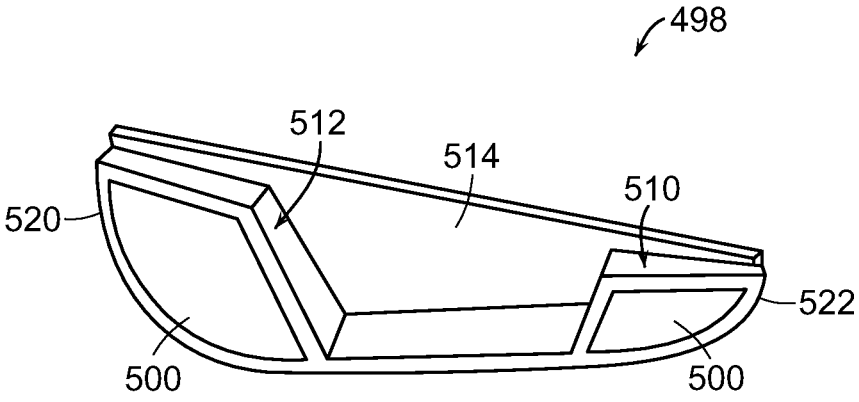
FIG. 49 is a perspective rear view of an alternative embodiment of a muscle back shell.
Figure 50:
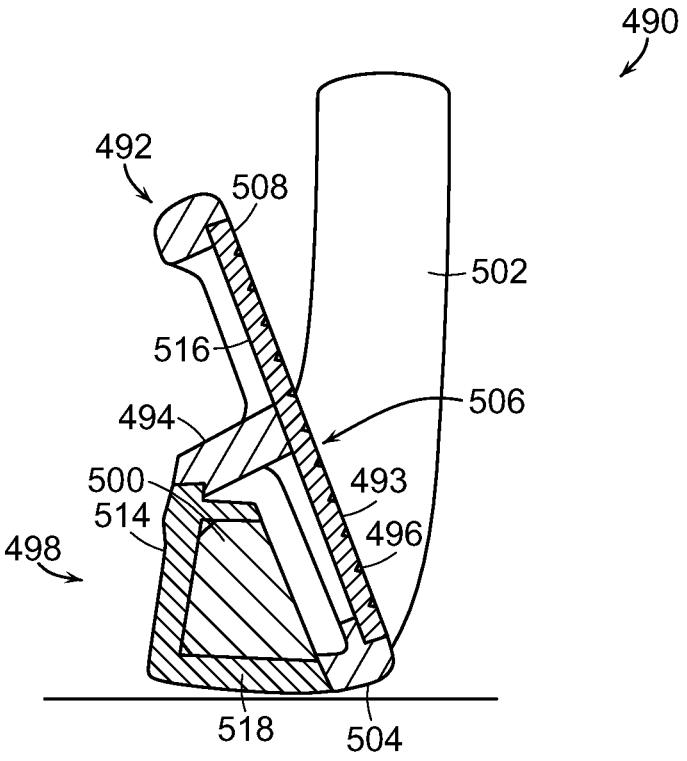
FIG. 50 is a cross-sectional view of a golf club including the muscle back shell of FIG. 49, generally taken through a toe portion of the golf club head.

The muscle back portion may alternatively have a multi-piece construction, such as by including weight inserts. An example of such a construction is included in an embodiment of the golf club head that is illustrated in FIGS. 49 and 50. Golf club head 490 includes a main body 492, a face support 494, a face insert 496, a muscle back shell 498 and a plurality of weight inserts 500. Main body 490 generally includes a hosel 502, face support 494, a partial sole 504 and a face recess 506, and defines a peripheral portion of a ball-striking surface 493 of the golf club head. Hosel 502 extends from a heel end of main body 492 and is configured to receive and to be coupled to a golf club shaft.

Face recess 506 is disposed in a front portion of main body 492 and is configured to receive and to be coupled to face insert 496. Face recess 506 includes a shoulder 508 that is recessed relative to the forward-most surface of main body 492. Shoulder 508 is generally co-planar with a forward facing surface of face support 494 so that face insert 496 may be coupled to shoulder 508 and face support 494 when the insert is inserted into face recess 506.

The muscle back portion of golf club head 490 has a multi-piece construction and includes shell 498 and integrated weight inserts 500. As shown, muscle back shell 498 includes a heel cavity 510 and a toe cavity 512 formed by walls extending from a back flange wall 514. The heel and toe cavities are sized and shaped to receive weight inserts 500 so that they may be rigidly coupled therein. In the present embodiment, weight inserts are coupled to muscle back shell 498 so that they are spaced from a back surface 516 of face insert 496, as a result weight inserts are located as far rearward as possible. Preferably, weight inserts are constructed from a material that is different than the material of muscle back shell 498. Weights 500 may be permanently coupled to muscle back shell 498 in the respective cavities by press-fitting, welding, brazing or soldering; or the weights may be semi-permanently coupled to muscle back shell 498 using an adhesive or mechanical fasteners, or combinations of the different methods.

After shell 498 and weights 500 are assembled, the assembly is coupled to main body 492. In particular, a sole flange 518 of muscle back shell 498 is fixedly coupled to partial sole 504 and back flange wall 514 is fixedly coupled to face support 494. Additionally, a toe wall 520 and a heel wall 522 of muscle back shell 498 are fixedly coupled to respective portions of main body 492. Preferably, the muscle back shell is coupled to the main body by welding, or another permanent coupling.

Figure 51:
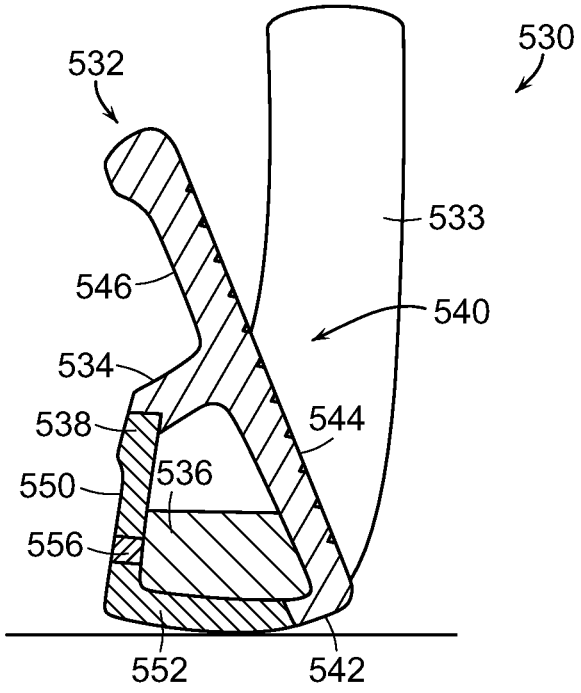
FIG. 51 is a cross-sectional view of another embodiment of a golf club including a muscle back shell, generally taken through a toe portion of the golf club head.

In another embodiment, shown in FIG. 51, a golf club head 530 includes a main body 532, a face support 534, a plurality of weight inserts 536 and a muscle back shell 538. Muscle back shell 538 extends generally between main body 532 and face support 534 to define an enclosed cavity in a muscle portion of club head 530.

Main body 532 generally includes a hosel 533, a hitting face 540, face support 534, and a partial sole 542. Hitting face 540 includes a front, ball-striking surface 544 and a rear surface 546 that is opposite the ball-striking surface 544. Hosel 533 extends from a heel end of main body 532 and is configured to receive, and to be coupled to, a golf club shaft.

Similar to previous embodiments, face support 534 is a member that extends rearward from rear surface 546 in a direction generally perpendicular to hitting face 540. Face support 534, is preferably elongate and extends across main body 532 in a generally heel to toe direction and generally behind the geometric face center of hitting face 540.

Muscle back shell 538 generally extends between face support 534 and partial sole 542 of main body 532. Muscle back shell 538 includes a back flange 550 that is coupled to face support 534 and a sole flange 552 that is coupled to partial sole 542. Back flange 550 forms a rearmost portion of club head 530 and extends downward to a trailing edge 554. Sole flange 552 extends rearward from partial sole 542 to trailing edge 554, and provides the majority of the sole, or bounce, surface of club head 530. Preferably, sole flange 452 provides greater than 50% of the bounce surface, and more preferably greater than 60%. Additionally, it is preferable that the lowest point of the bounce surface of club head 530 be located on sole flange 552, and toward trailing edge 554 from the interface between sole flange 552 and partial sole 542. Sole flange 552 is shaped to provide any desired sole contour, such as bounce angle, camber, rails and/or depressions. Additionally, trailing edge 554 may include a beveled, or chamfered, configuration. Muscle back shell 538 is preferably a thin shell constructed from a material that may be easily welded to the material of the main body. For example, if the main body is constructed of steel, it is preferable that the muscle back shell also be constructed of steel. However, it should also be appreciated other materials, such as tungsten, tantalum, molybdenum, and alloys thereof may also be utilized.

Similar to previous embodiments, weight inserts 536 are included in club head 530 to alter the physical properties of the club head. Any number of weight inserts 536 may be included, such as a heel insert, a toe insert and a hosel insert. As shown, weight insert 536 is coupled to both rear surface 546 of hitting face 540 and to a forward surface of back flange 550. In order to facilitate a method of constructing the configuration, an access port 556 is provided in back flange 550. For example, weight insert 536 may be coupled to rear surface 546 of hitting face 540 prior to attachment of muscle back shell 538 to main body 532. Next, muscle back shell 538 may be attached to main body 532. After muscle back shell 538 is attached, weld material may be inserted through port 556 so that it flows between muscle back shell 538 and weight insert 536. The weight inserts are preferably constructed from a material that has a specific weight that is greater than that of the main body material. For example, the weight inserts may be constructed from tungsten, lead, beryllium copper, tungsten-loaded polymer, alloys thereof, etc.

The construction of the present invention allows iron-type golf clubs to be constructed with a greater level of forgiveness while providing a relatively small dimensional envelope. In particular, the ratio of the moment of inertia about the hosel axis relative to the moment of inertia about a vertical axis, through the center of gravity, of the club head is significantly lower than both previously known muscle-back golf club heads and game improvement golf club heads.

TABLE 3

Physical Properties (4i)

| Construction | Loft [deg.] | MOI-Y [kgmm$^2$] | MOI-SA [kgmm$^2$] | R | CG Height [mm] | Blade Length [mm] |
|---|---|---|---|---|---|---|
| Inventive 1 | 24 | 221.8 | 478.4 | 2.16 | 18.15 | 77.6 |
| Inventive 2 | 24 | 225.6 | 484.0 | 2.15 | 18.6 | 77.6 |
| Inventive 3 | 24 | 222.4 | 480.8 | 2.16 | 18.7 | 77.6 |
| Inventive 4 | 24 | 233.0 | 508.0 | 2.18 | 18.8 | 77.6 |
| Inventive 5 | 24 | 238.0 | 512.0 | 2.15 | 18.8 | 77.6 |
| Inventive 6 | 24 | 240.6 | 511.0 | 2.12 | 18.8 | 77.6 |
| Inventive 7 | 24 | 231.0 | 493.0 | 2.13 | 18.8 | 77.6 |
| Inventive 8 | 24 | 239.8 | 500.0 | 2.09 | 18.3 | 77.6 |
| Inventive 9 | 24 | 248.8 | 514.0 | 2.07 | 18.7 | 77.6 |
| Inventive 10 | 24 | 248.7 | 536.0 | 2.16 | 18.6 | 77.6 |
| Inventive 11 | 24 | 255.4 | 507.2 | 1.99 | 18.4 | 77.6 |
| Inventive 12 | 24 | 248.5 | 525.0 | 2.11 | 18.2 | 77.6 |
| Inventive 13 | 24 | 260.8 | 522.8 | 2.00 | 18.6 | 77.6 |
| Inventive 14 | 24 | 250.0 | 525.0 | 2.10 | 17.6 | 77.6 |
| Inventive 15 | 24 | 264.0 | 522.0 | 1.98 | 18.1 | 77.6 |
| Comp. Example 1 | 24 | 194.7 | 446.4 | 2.29 | 19.7 | 74.1 |
| Comp. Example 2 | 24 | 211.6 | 478.4 | 2.26 | 18.1 | 76.2 |
| Comp. Example 3 | 23 | 202.6 | 474.0 | 2.34 | 19.0 | 76.4 |
| Comp. Example 4 | 24 | 211.6 | 478.3 | 2.26 | 19.1 | 76.4 |
| Comp. Example 5 | 23.75 | 218.1 | 540.0 | 2.48 | 19.3 | 76.8 |
| Comp. Example 6 | 24 | 238.5 | 538.1 | 2.26 | 19.3 | 78.2 |
| Comp. Example 7 | 22 | 242.1 | 579.3 | 2.39 | 21.2 | 79.2 |
| Comp. Example 8 | 24.5 | 245.6 | 563.9 | 2.30 | 21.3 | 79.3 |
| Comp. Example 9 | 24 | 218.1 | 533.7 | 2.45 | 19.2 | 79.8 |
| Comp. Example 10 | 22 | 227.0 | 543.5 | 2.39 | 19.2 | 81.4 |
| Comp. Example 11 | 24 | 217.7 | 635.2 | 2.92 | 18.2 | 83.6 |
| Comp. Example 12 | 23 | 249.6 | 651.9 | 2.61 | 17.4 | 86.0 |
| Comp. Example 13 | 24 | 243.3 | 666.3 | 2.74 | 17.5 | 90.4 |

All the main bodies of the golf head embodiments, discussed above, may be constructed from a cast or forged material, such as, for example, stainless steel 431, or 1025 carbon steel.

The present invention also includes iron-type golf clubs that provide advantageous frequency behavior over conventional iron-type golf clubs. They provide increased frequency value behavior, which provides a user of the golf clubs with better feel and sound, especially in the lower frequency modes. That improved feel and sound improves the feedback provided to the player indicating optimal ball impact with the hitting face of the golf club.

The golf clubs of the present invention include a club main body, a supporting member and a muscle back shell and vibration modes having increased frequency values over conventional iron-type golf clubs. The frequency value for the first vibration mode is preferably greater than 4000 Hz, and more preferably greater than 4400 Hz. Additionally, the frequency value for the second vibration mode is preferably greater than 5000 Hz, and more preferably greater than 5500 Hz. Still further, the frequency value for the third vibration mode is preferably greater than 7400 Hz, and more preferably greater than 7700 Hz.

Table 1, shown in FIG. 14, provides a comparison between the frequency values of the first ten vibration modes of exemplary 6-irons for a conventional iron-type golf club, such as a Titleist 704 iron-type golf club, and two embodiments of the iron-type golf club of the present invention, Embodiments A and B. Embodiment A corresponds to an iron-type golf club that includes a main body that is cast in 431 stainless steel with a supporting member that is integrally cast with the main body. Embodiment A also includes a muscle back shell constructed from a tungsten nickel alloy that is coupled to the rear portion of the main body and the supporting member to define an enclosed cavity. Embodiment B corresponds to an iron-type golf club that includes a main body that is forged from 1025 carbon steel with a supporting member that is integrally forged with the main body. Embodiment B also includes a muscle back shell constructed from a tungsten nickel alloy that is coupled to the rear portion of the main body and the supporting member to define an enclosed cavity.

As shown in Table 1, the frequency values for the majority of vibration modes of the embodiments of the present invention are significantly increased over corresponding frequency values for the conventional iron-type golf club. For example, Embodiment A provides increased frequency values for a majority of the vibration modes and Embodiment B provides greater frequency values for each of the first ten vibration modes. Both Embodiments A and B exhibit increases in frequency value for the two lowest frequency vibration modes that are greater than the frequencies exhibited by a conventional iron-type golf club by more than 10%. As a result, the embodiments provide a user with sound and feel that are significantly improved over the sound and feel of the conventional iron-type golf club.

Figure 15A:
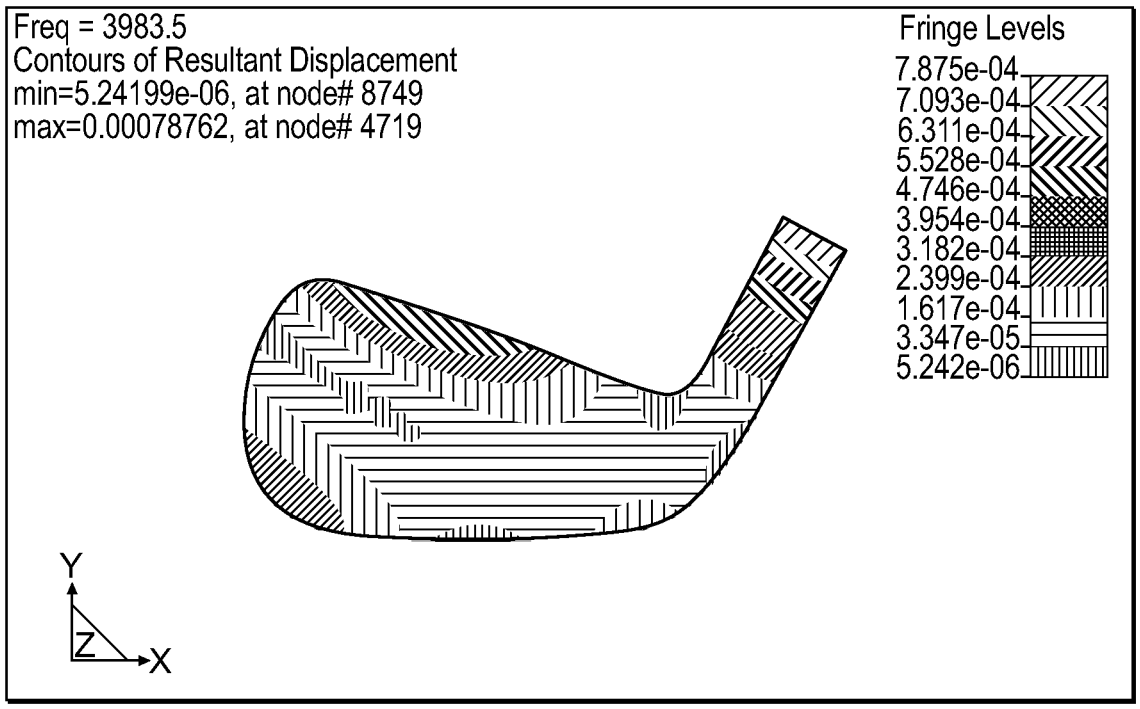
FIGS. 15A-15C illustrate first mode shapes for a conventional iron-type golf club and embodiments of the iron-type golf club according to the present invention.
Figure 15B:
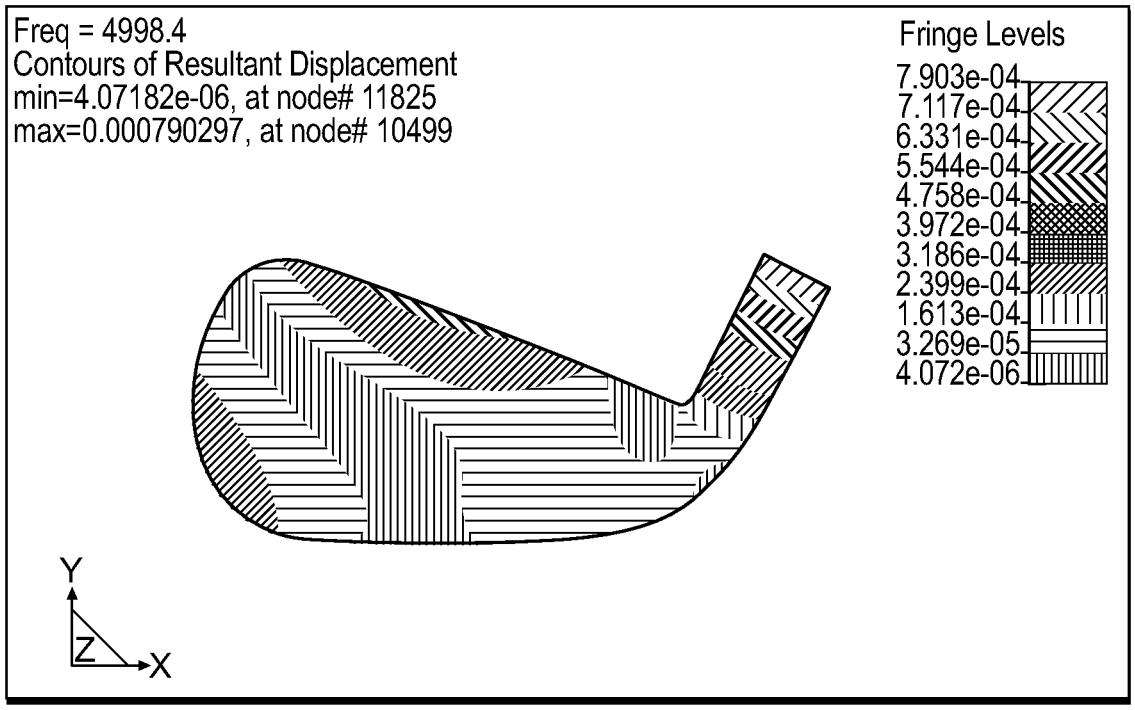
Figure 15C:
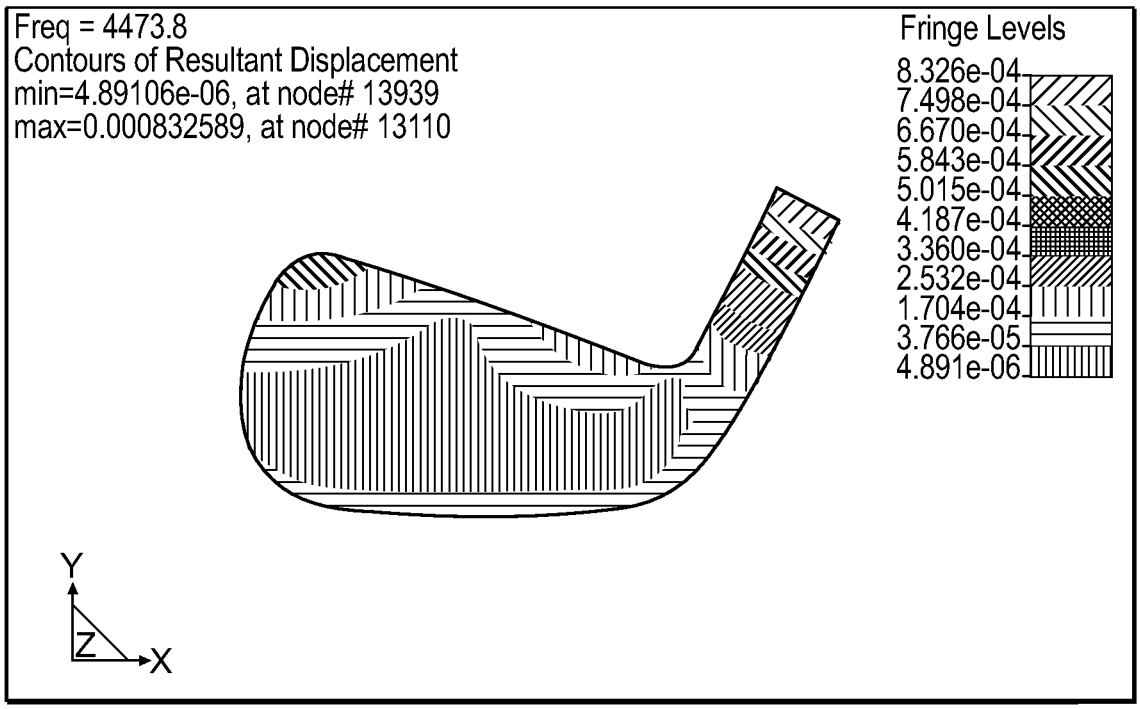

In the first vibration mode, Embodiments A and B exhibit mode shapes that are similar to the first mode shape of the conventional iron-type golf club head, as shown in FIGS. 15A-15C. However, the frequency value at which that behavior takes place is significantly increased for each of the embodiments of the present invention. In particular, Embodiment A has a first mode frequency value of approximately 4998.4 Hz, which is approximately a 26% increase over that of the conventional iron-type golf club. Embodiment B exhibits the first mode behavior at a frequency value of approximately 4473.8 Hz, which is approximately a 12% increase over the first mode frequency value of the conventional golf club at 3983.5 Hz.

Figure 16A:
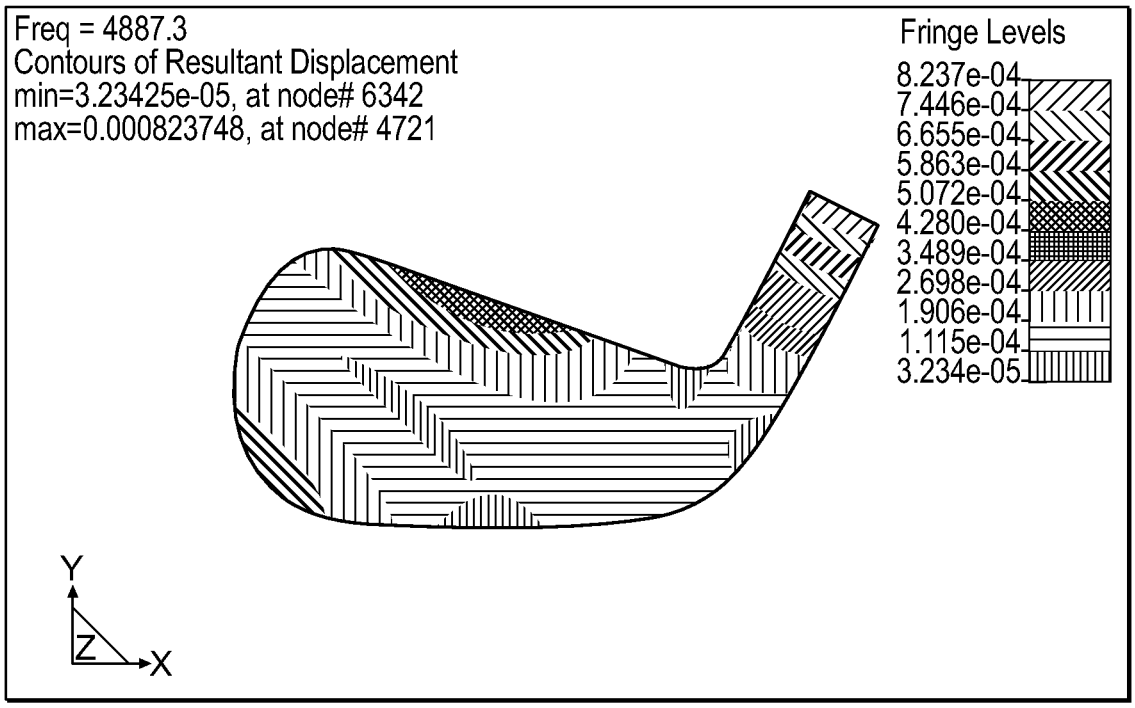
FIGS. 16A-16C illustrate second mode shapes for a conventional iron-type golf club and embodiments of the iron-type golf club according to the present invention.
Figure 16B:
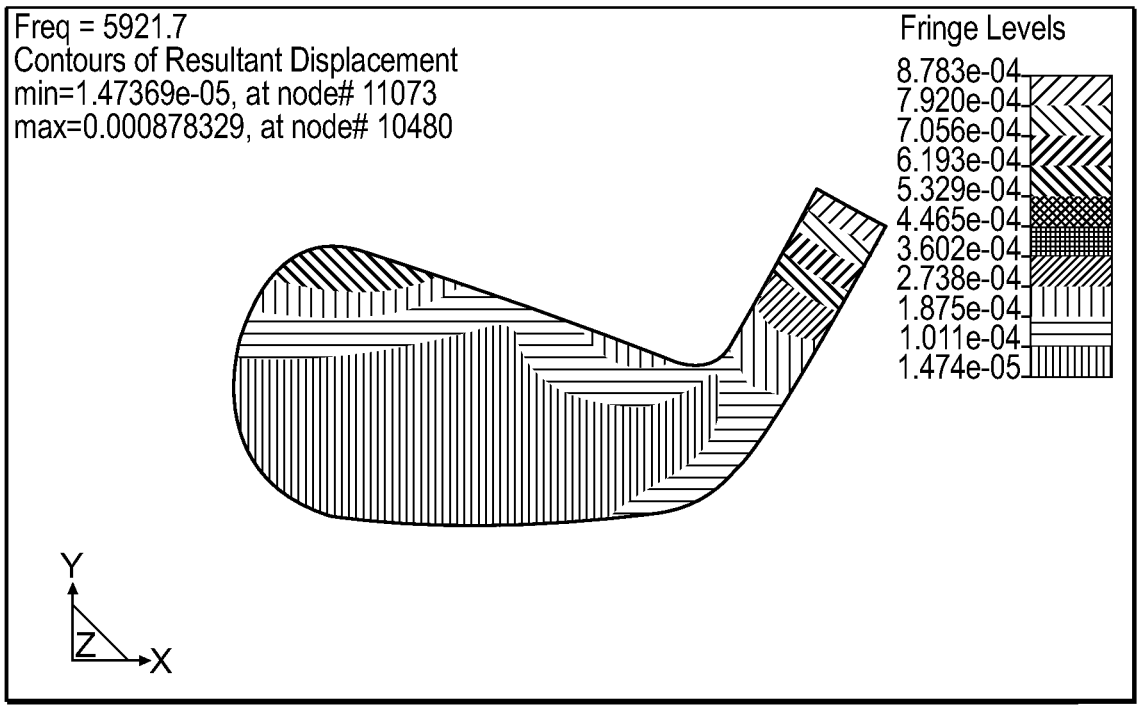
Figure 16C:
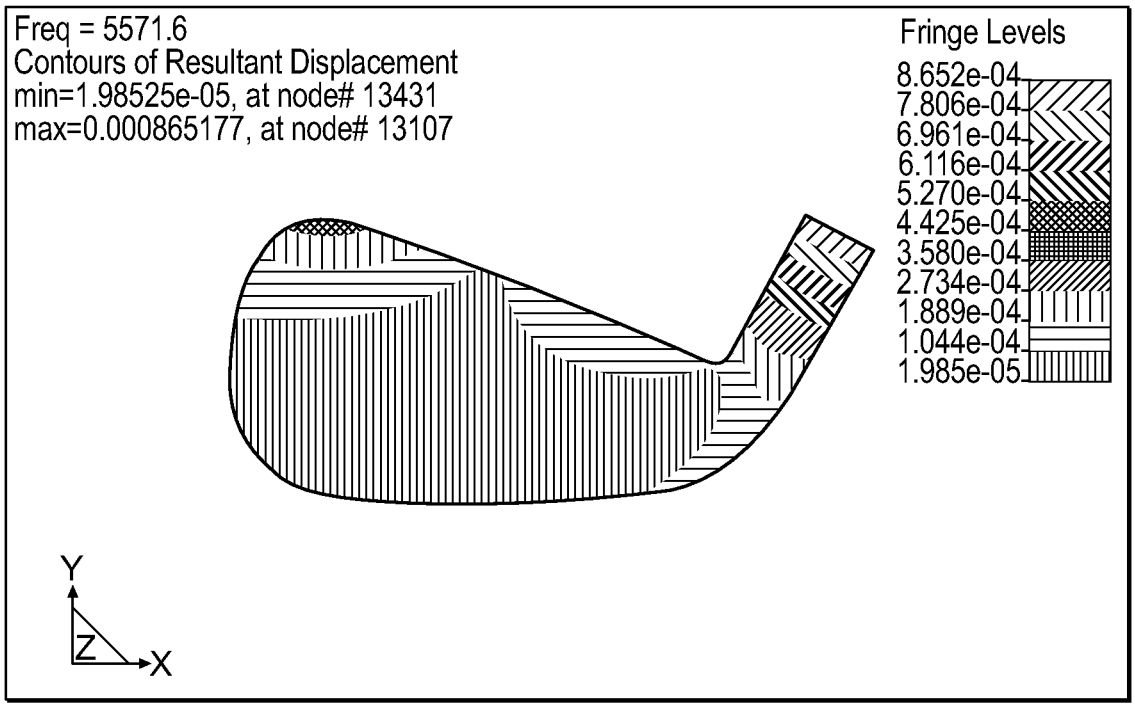

Referring to FIGS. 16A-16C, Embodiments A and B also provide second mode shapes that are similar to the second mode shape exhibited by the conventional iron-type golf club. However, the second mode frequency values of Embodiments A and B are greater than the second mode frequency value for the conventional club. In particular, Embodiments A and B have second mode frequency values of 5921.7 Hz and 5571.6 Hz, respectively, while the conventional golf club head exhibits a second mode frequency value of 4887.3 Hz.

Figure 17A:
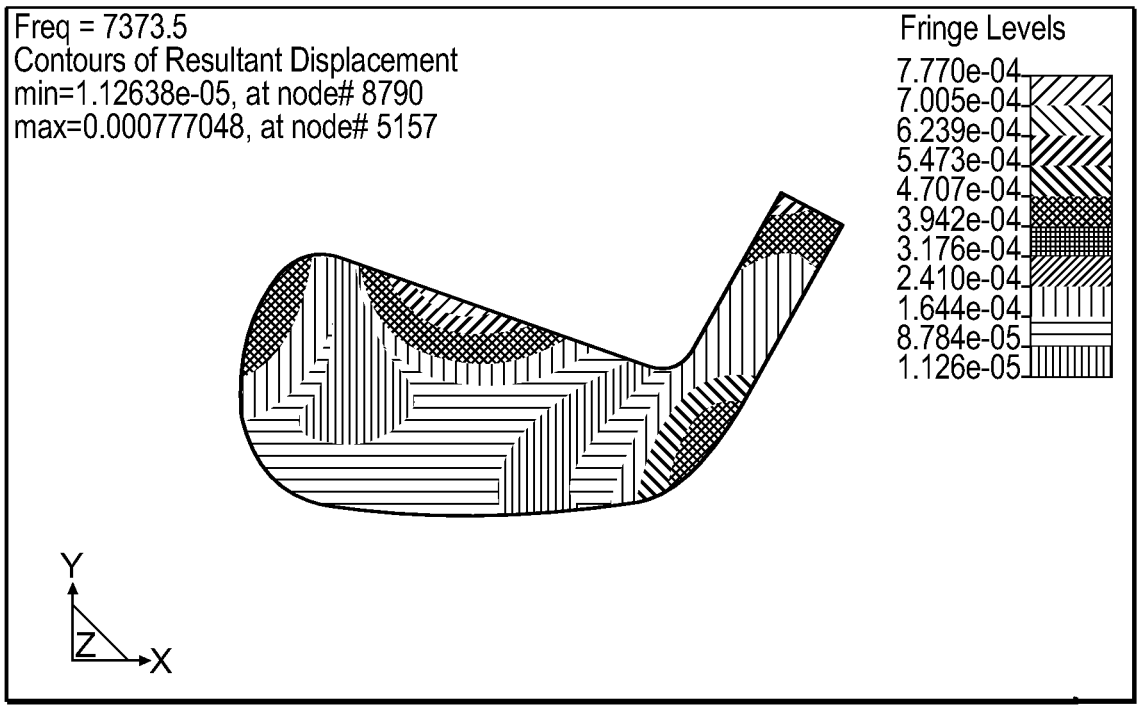
FIGS. 17A-17C illustrate third mode shapes for a conventional iron-type golf club and embodiments of the iron-type golf club according to the present invention.
Figure 17B:
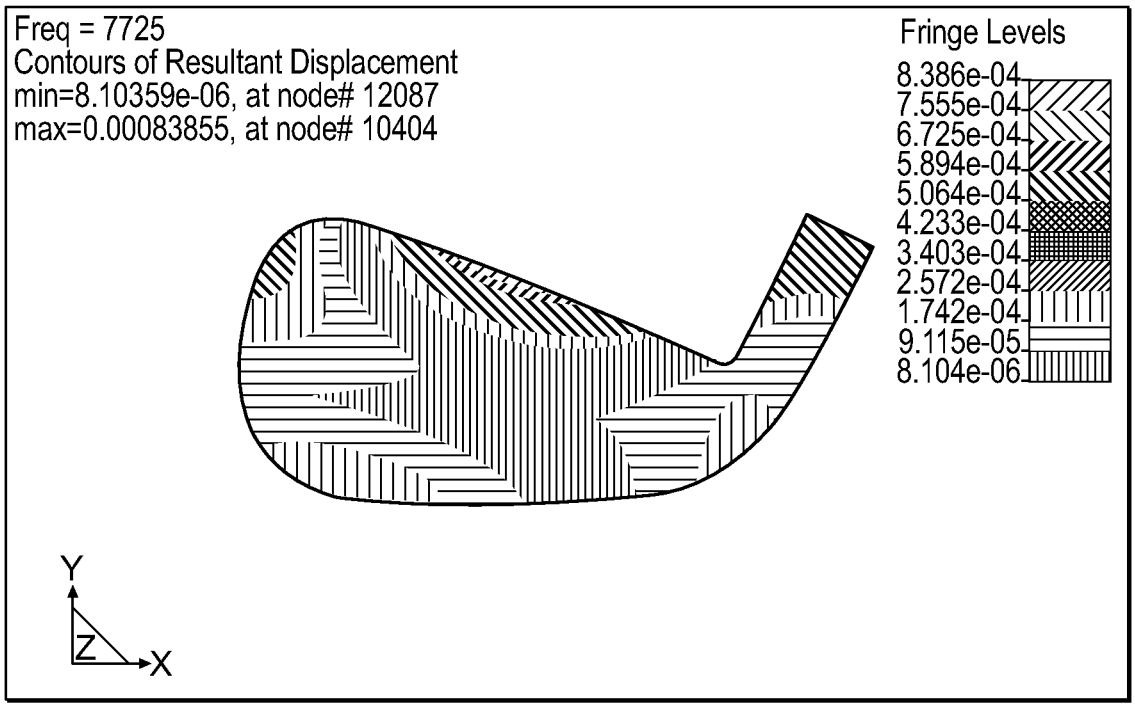
Figure 17C:
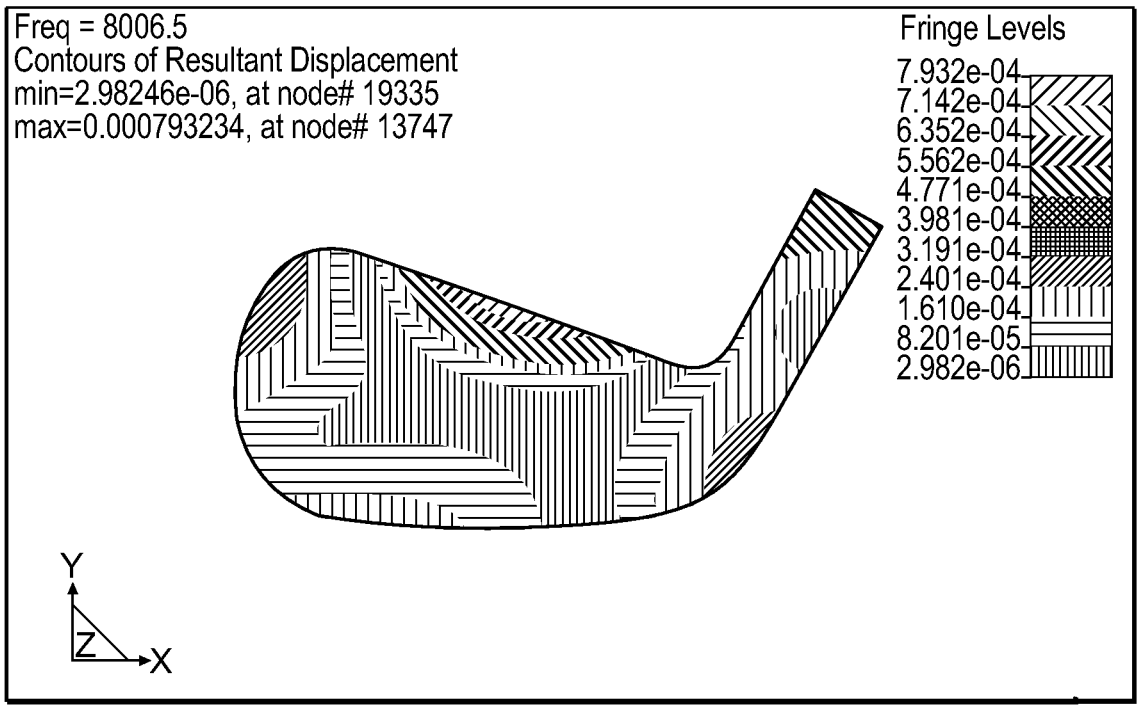

Referring to FIGS. 17A-17C, in the third vibration mode, the mode shape of the embodiments of the present invention deviate from the third mode shape of the conventional iron-type golf club. Unlike the conventional iron-type golf club, the embodiments of the present invention include a single minimum deflection region that extends generally across the hitting face of the golf club in a heel to toe direction. The conventional golf club includes a pair of minimum deflection regions that are spaced from one another in a heel to toe direction, as shown in FIG. 17A. As a result, in the third vibration mode, the center of the hitting face of the conventional golf club has a larger amplitude of displacement than the center of the hitting face of golf clubs in accordance with the present invention.

Additionally, the frequency values of the third vibration mode of Embodiments A and B are increased over that of the conventional iron-type golf club. The frequency value of the third vibration mode of Embodiment A is 7725 Hz, which is approximately a 5% increase over the frequency value of the conventional iron at 7373.5 Hz. Embodiment B has a third mode frequency value of 8006.5, which is approximately a 9% increase over the frequency value of the conventional iron.

Figure 18A:
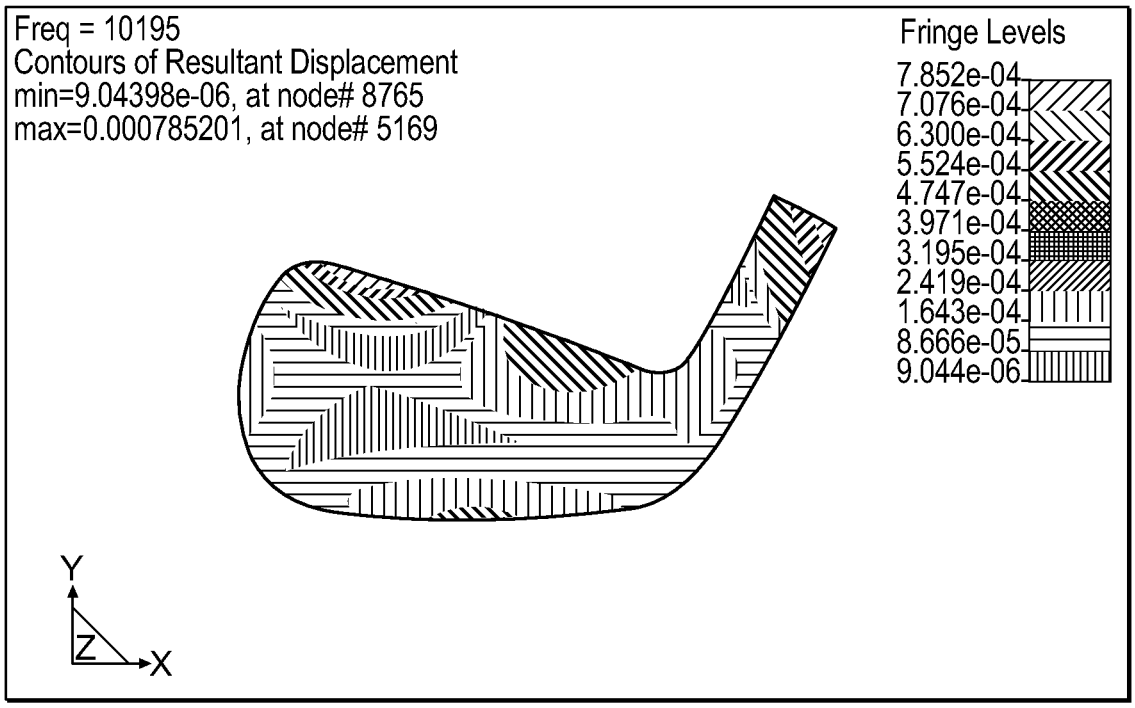
FIGS. 18A-18C illustrate fourth mode shapes for a conventional iron-type golf club and embodiments of the iron-type golf club according to the present invention.
Figure 18B:
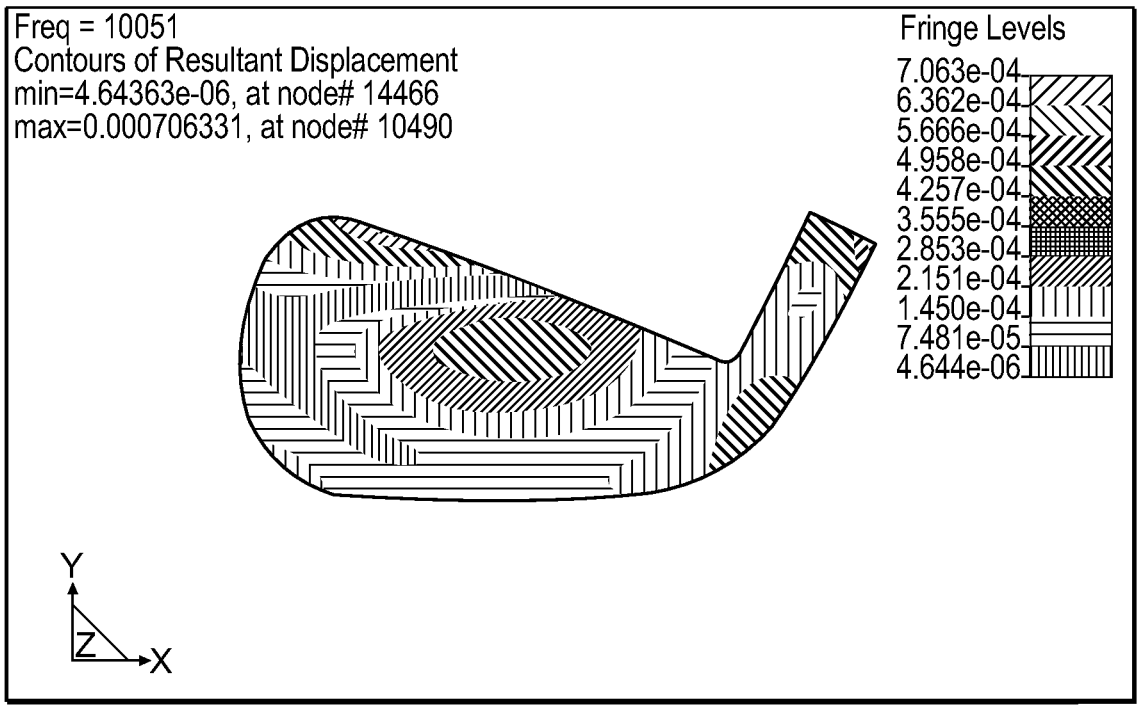
Figure 18C:
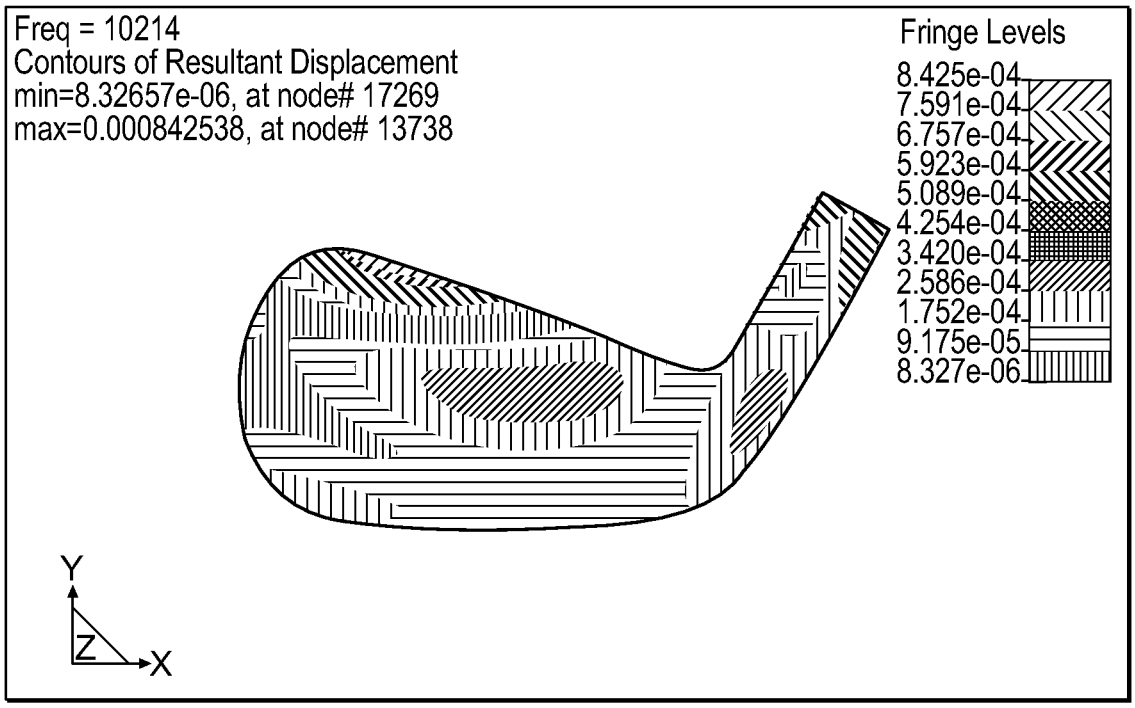

Referring to FIGS. 18A-18C, the fourth mode frequency values of the conventional iron-type golf club head and Embodiments A and B are similar but the mode shape of Embodiments A and B differ from the shape of the conventional golf club. In particular, the minimum deflection regions of Embodiments A and B are disposed further toward the toe than the regions of minimum deflection of the conventional iron-type golf club. Additionally, each of Embodiments A and B includes a region of maximum deflection that is disposed approximately adjacent the center of the hitting face of the respective golf club.

Figure 19A:
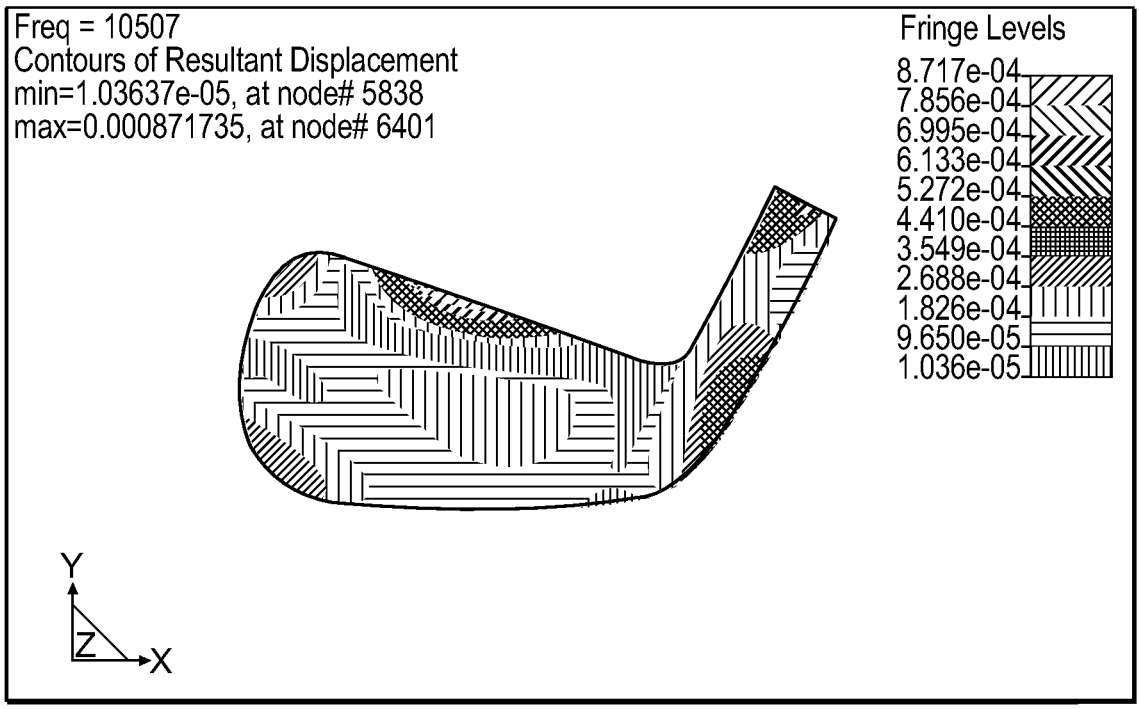
FIGS. 19A-19C illustrate fifth mode shapes for a conventional iron-type golf club and embodiments of the iron-type golf club according to the present invention.
Figure 19B:
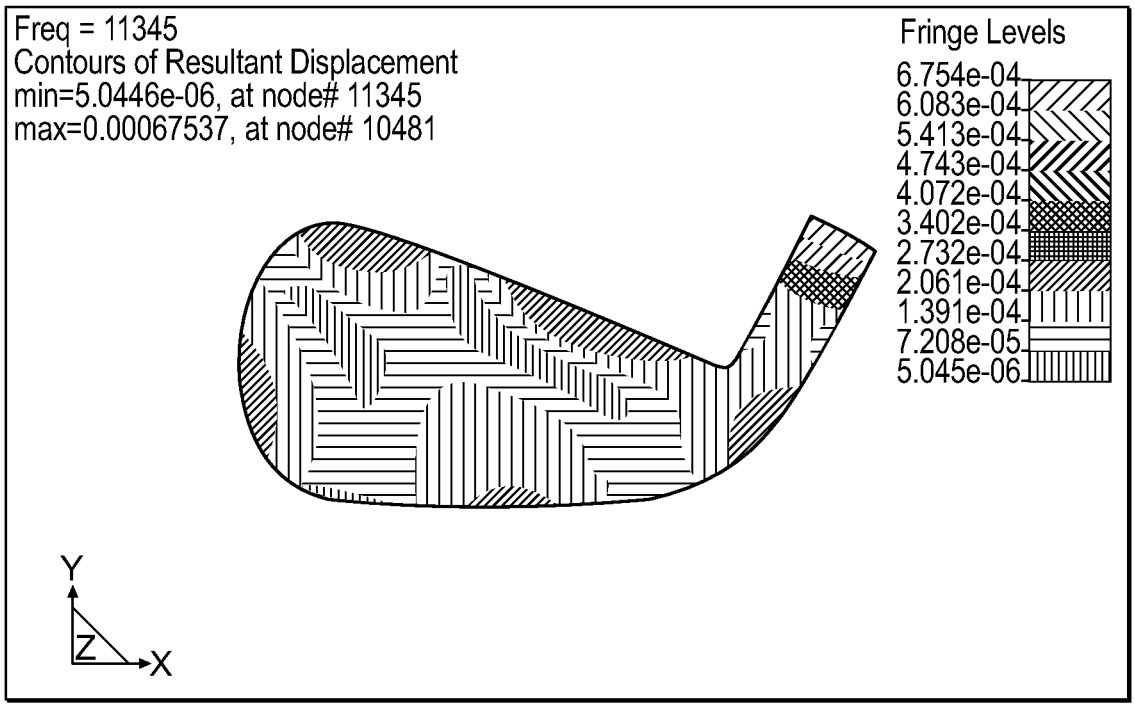
Figure 19C:
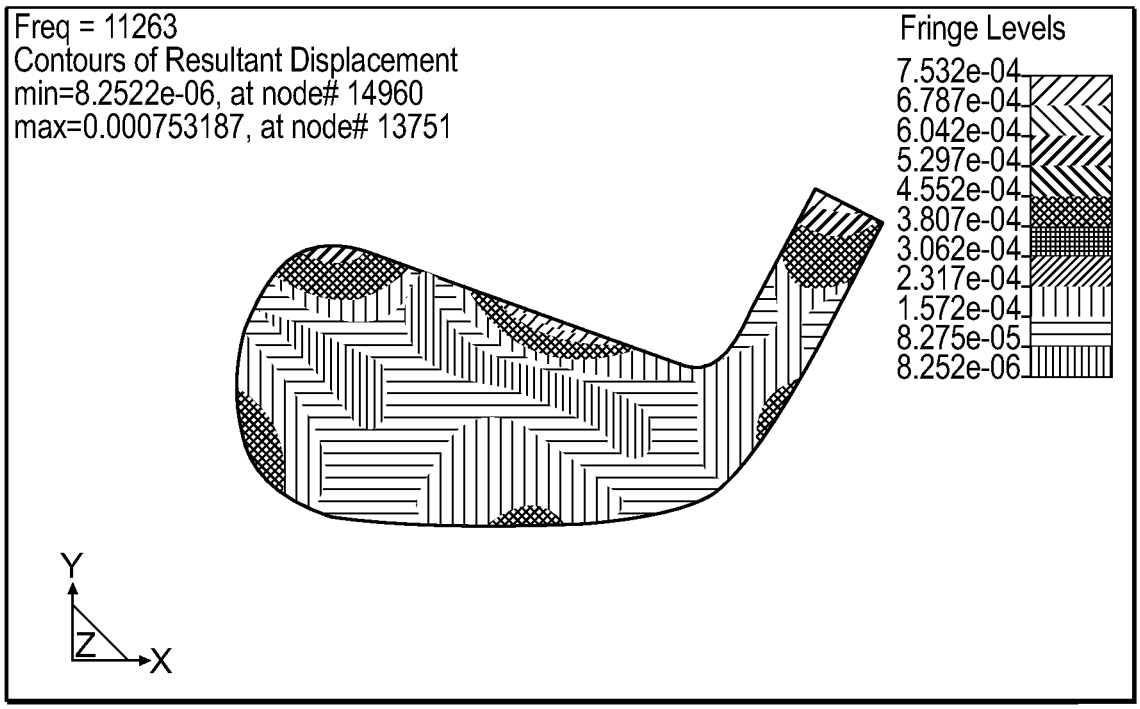

In the fifth vibration mode, the embodiments of the present invention provide increased frequency values in addition to different mode shapes as compared to the conventional iron-type golf club. The fifth mode frequency value of Embodiment A is 11345 Hz, which is approximately an 8% increase over the fifth mode frequency value of the conventional iron-type golf club at 10507 Hz. Similarly, the fifth mode frequency value of Embodiment B is 11263 Hz, which is approximately a 7% increase over the fifth mode frequency value of the conventional golf club. Additionally, the embodiments of the present invention have regions of high deflection that are disposed toward the sole from the center of the club face, while the conventional golf club includes a region of high deflection that is located approximately at the center of the hitting face of the golf club, as shown in FIGS. 19A-19C.

Figure 20A:
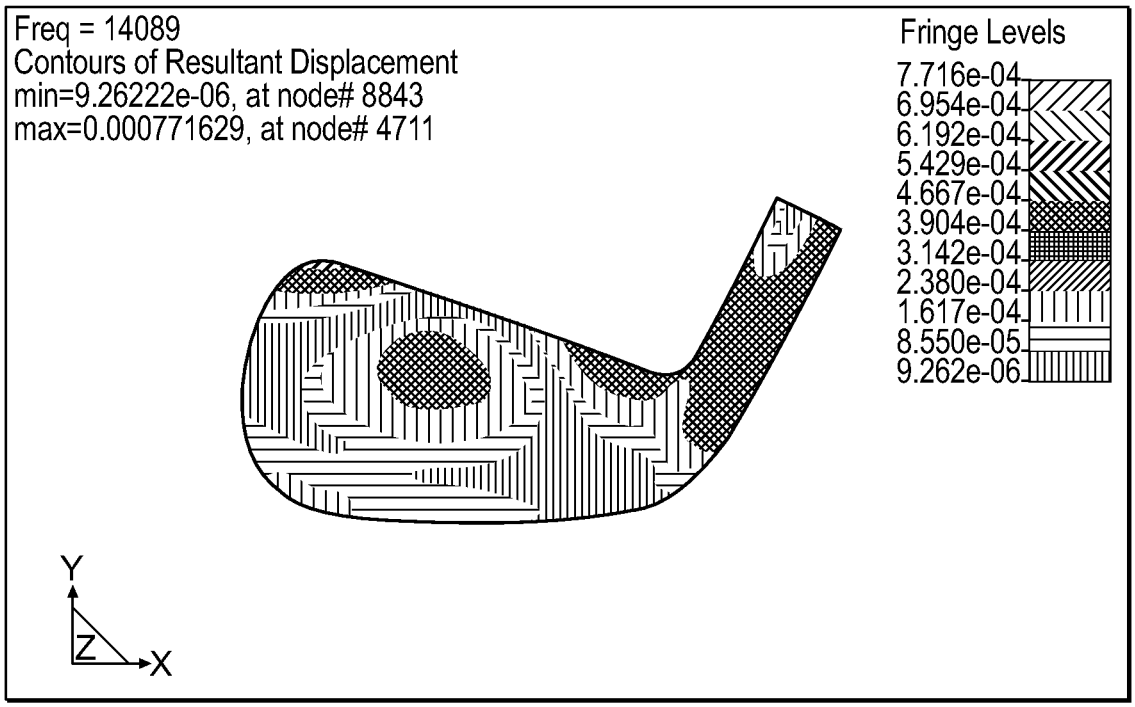
FIGS. 20A-20C illustrate sixth mode shapes for a conventional iron-type golf club and embodiments of the iron-type golf club according to the present invention.
Figure 20B:
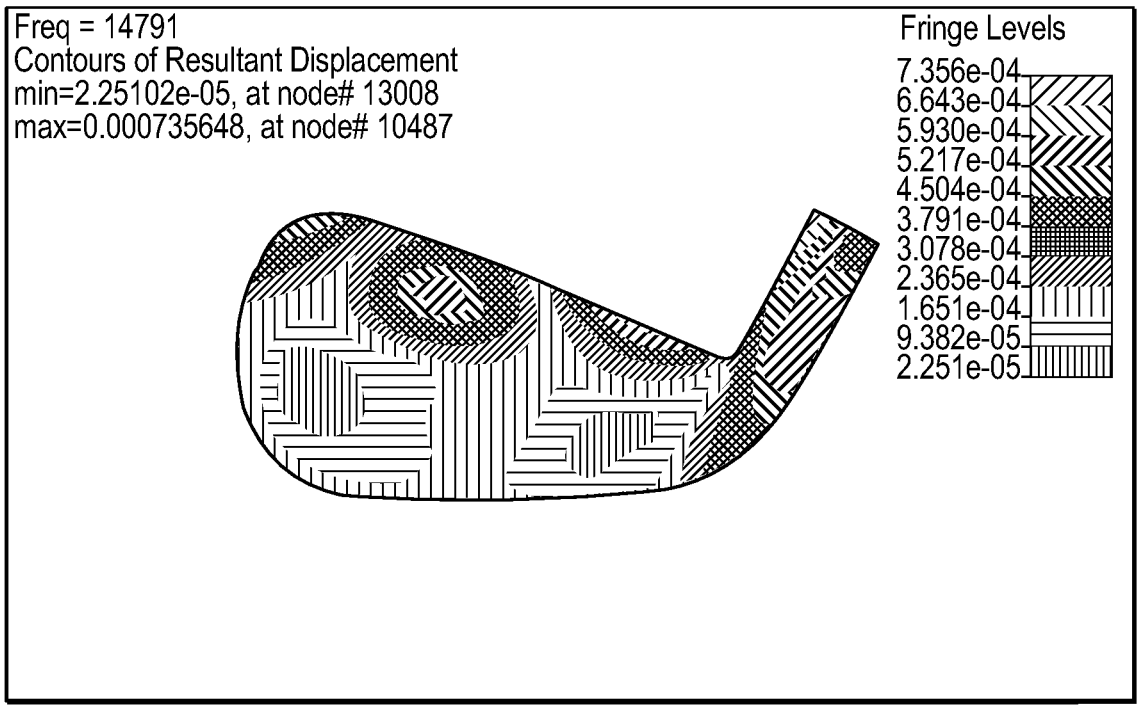
Figure 20C:
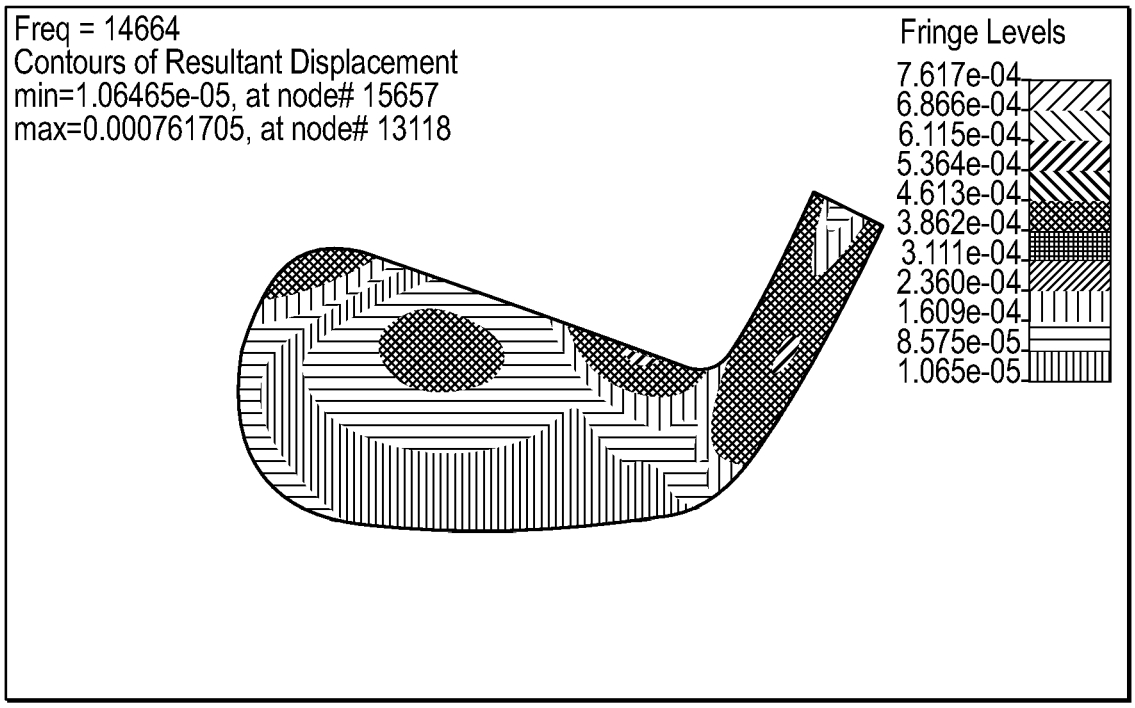

Referring to FIGS. 20A-20C, the sixth vibration mode shapes of Embodiments A and B and the conventional iron-type golf club are similar, however, the frequency values of that mode are greater for the embodiments of the present invention than the frequency value for the conventional iron-type golf club. Embodiment A exhibited a frequency value of 14791 Hz which is 5% greater than the frequency value of the conventional iron-type golf club, at 14089 Hz. Similarly, Embodiment B exhibited a frequency value of 14664 Hz, which is a 4% increase over that of the conventional iron-type golf club.

Figure 21A:
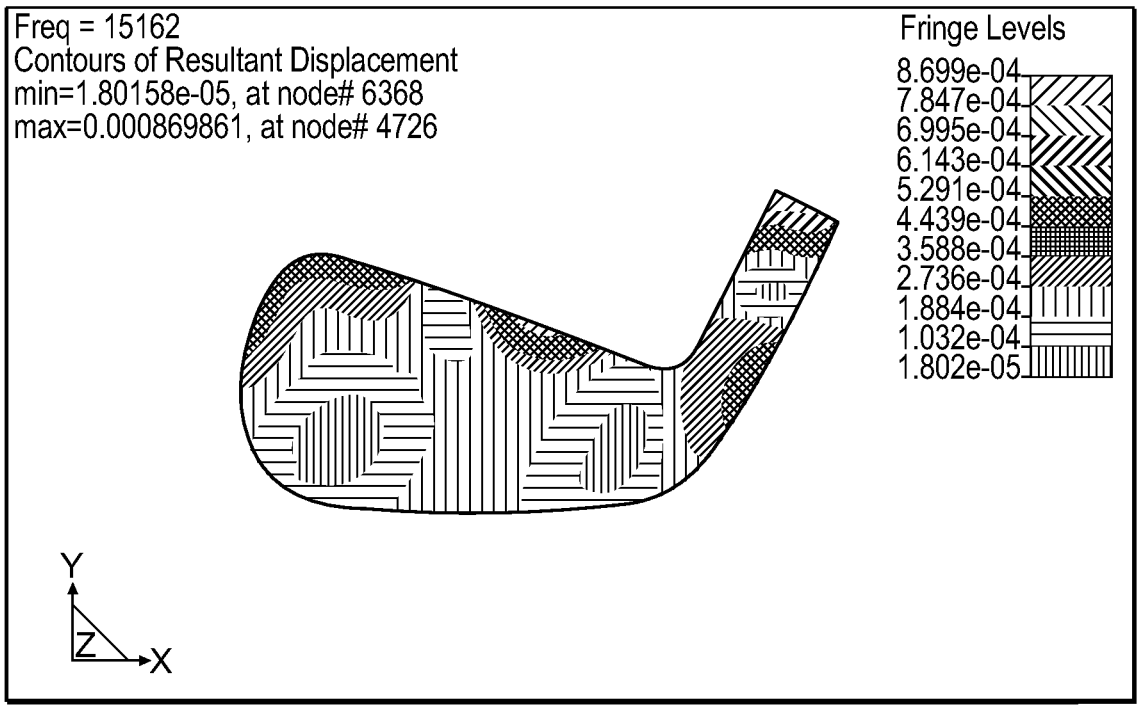
FIGS. 21A-21C illustrate seventh mode shapes for a conventional iron-type golf club and embodiments of the iron-type golf club according to the present invention.
Figure 21B:
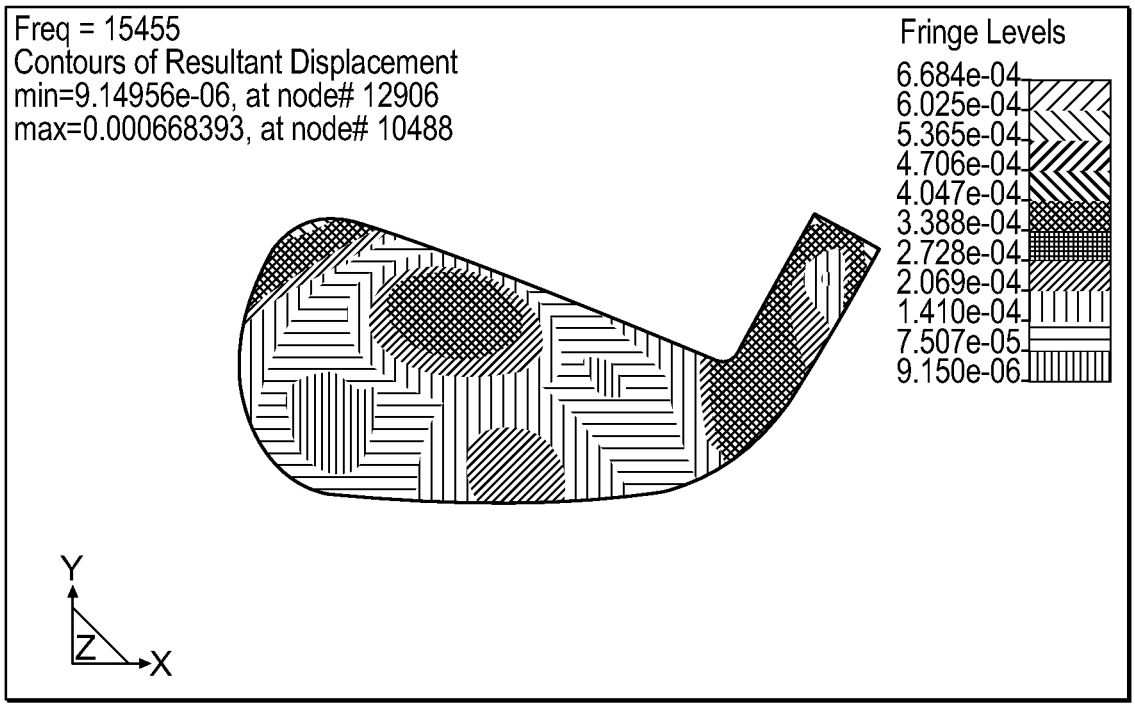
Figure 21C:
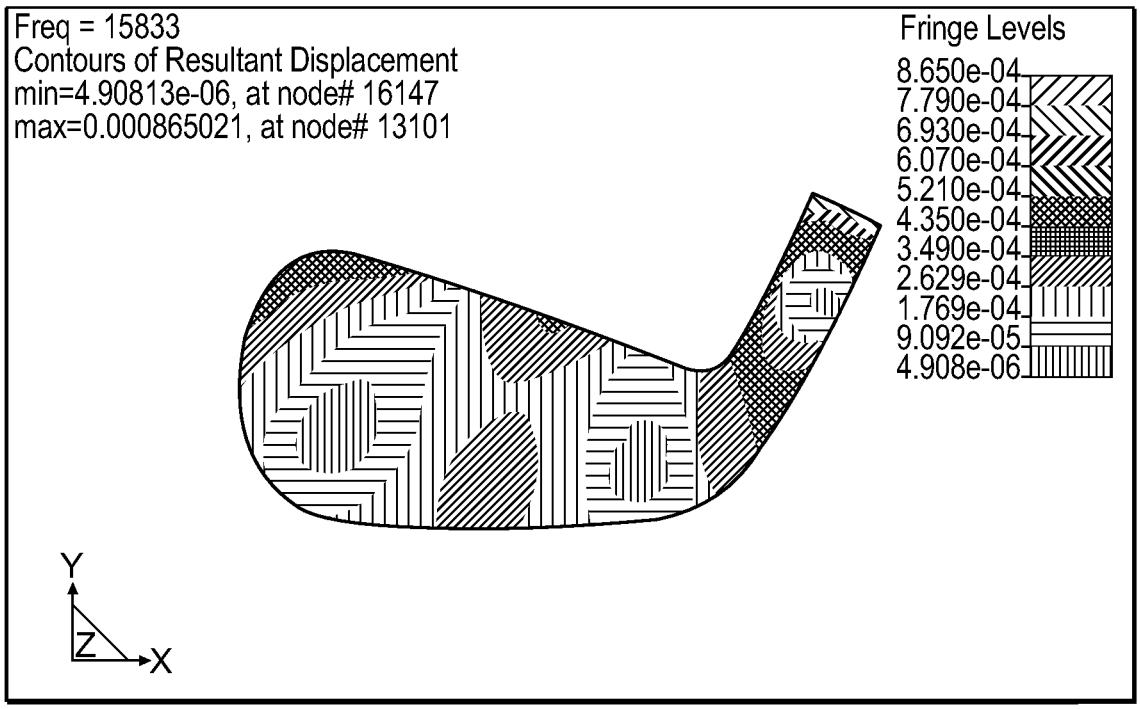

Referring to FIGS. 21A-21C, the seventh vibration mode shape of Embodiments A and B and the conventional iron-type golf club head are similar, however, the frequency values of that mode are greater for the embodiments of the present invention than the frequency value for the conventional iron-type golf club. Embodiment A exhibited a frequency value of 15455 Hz which is 2% greater than the frequency value of the conventional iron-type golf club, at 15162 Hz. Similarly, Embodiment B exhibited a frequency value of 15833 Hz, which is a 4% increase over that of the conventional iron-type golf club.

Figure 22A:
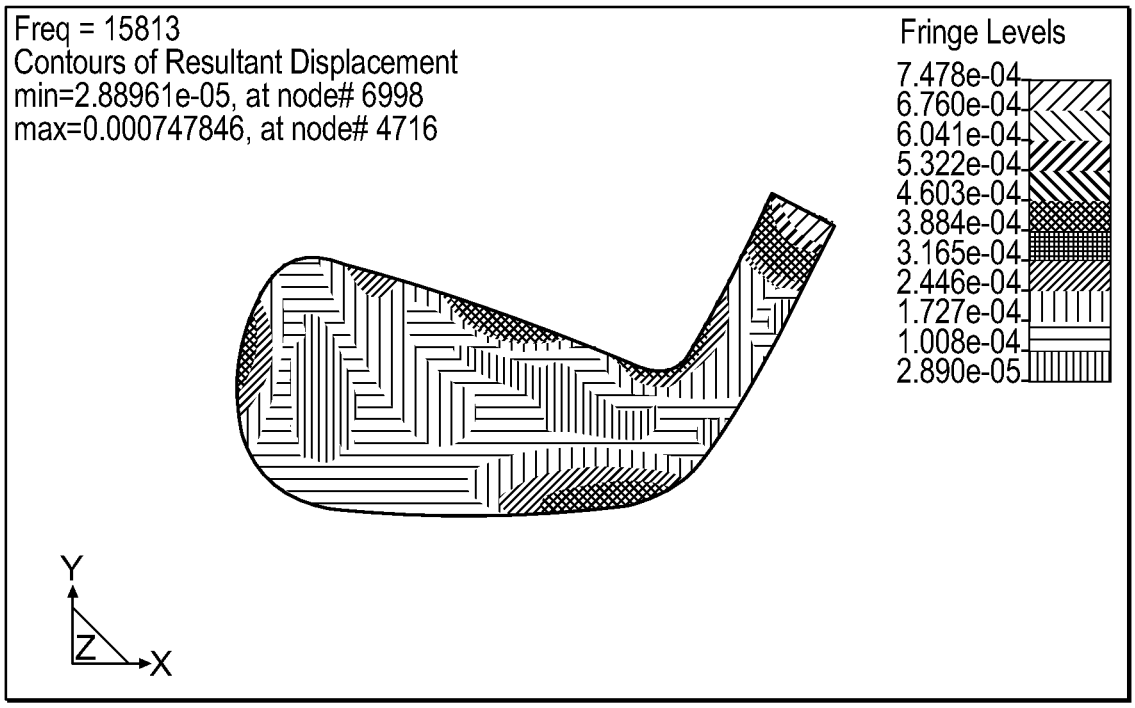
FIGS. 22A-22C illustrate eighth mode shapes for a conventional iron-type golf club and embodiments of the iron-type golf club according to the present invention.
Figure 22B:
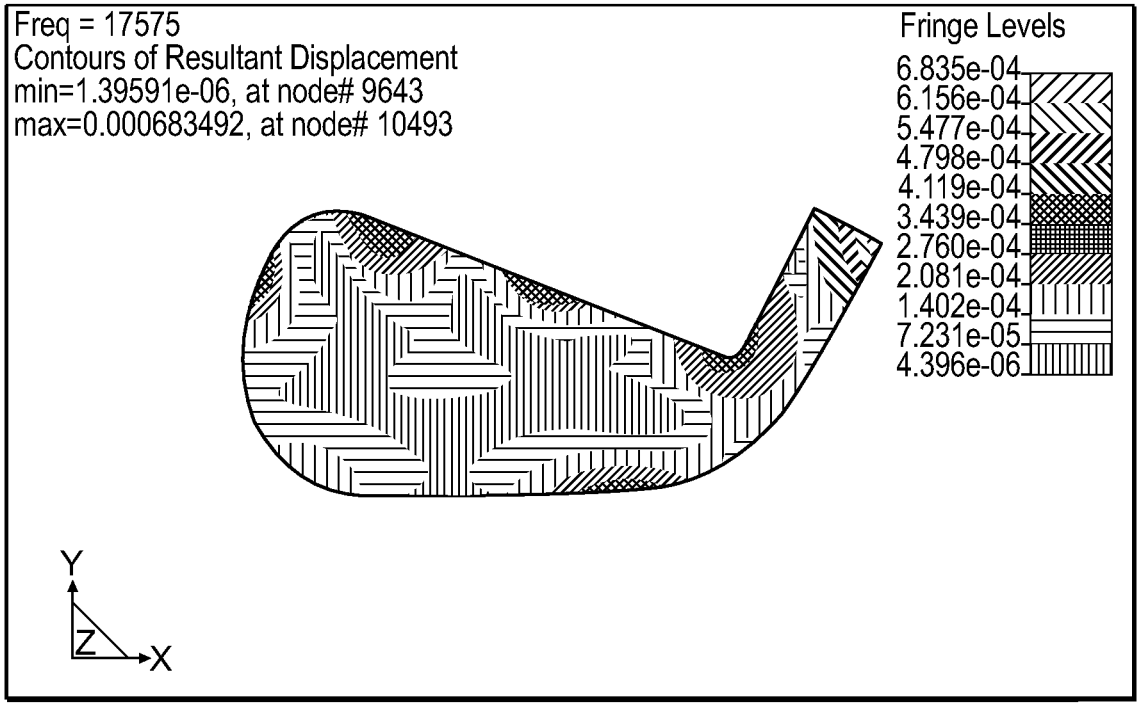
Figure 22C:
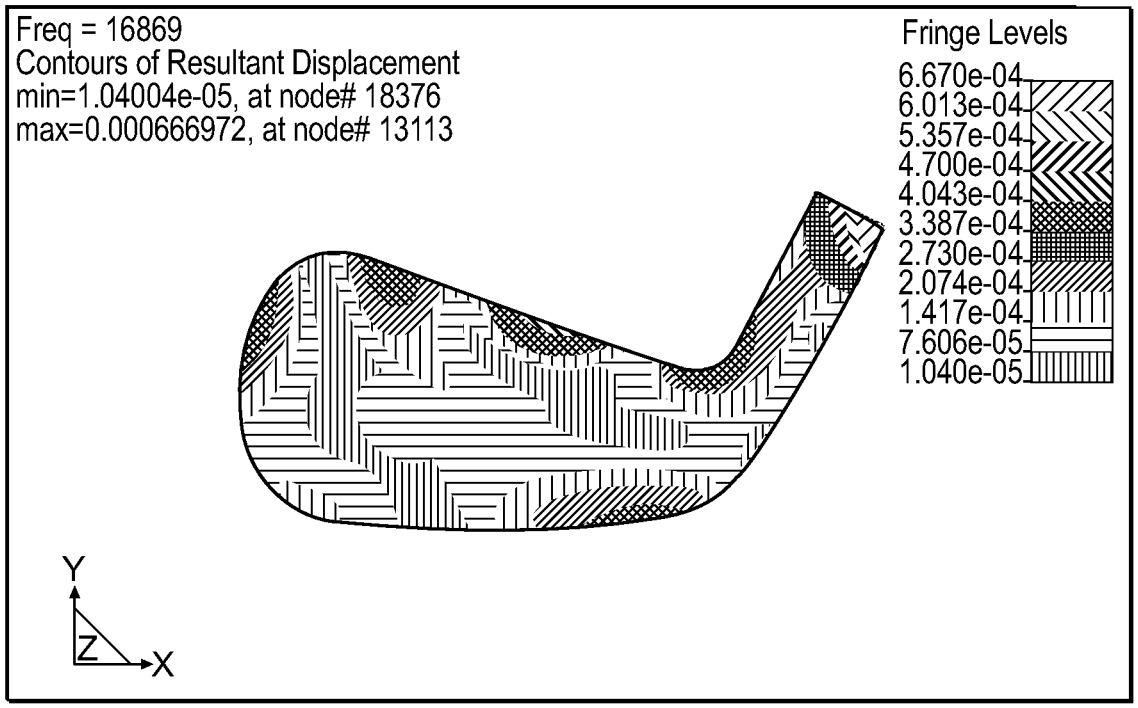

Referring to FIGS. 22A-22C, the eighth vibration mode shape of Embodiments A and B and the conventional iron-type golf club head are similar, however, the frequency values of that mode are greater for the embodiments of the present invention than the frequency value for the conventional iron-type golf club. Embodiment A exhibited a frequency value of 17575 Hz which is 11% greater than the frequency value of the conventional iron-type golf club, at 15813 Hz. Similarly, Embodiment B exhibited a frequency value of 16869 Hz, which is a 7% increase over that of the conventional iron-type golf club.

Figure 23A:
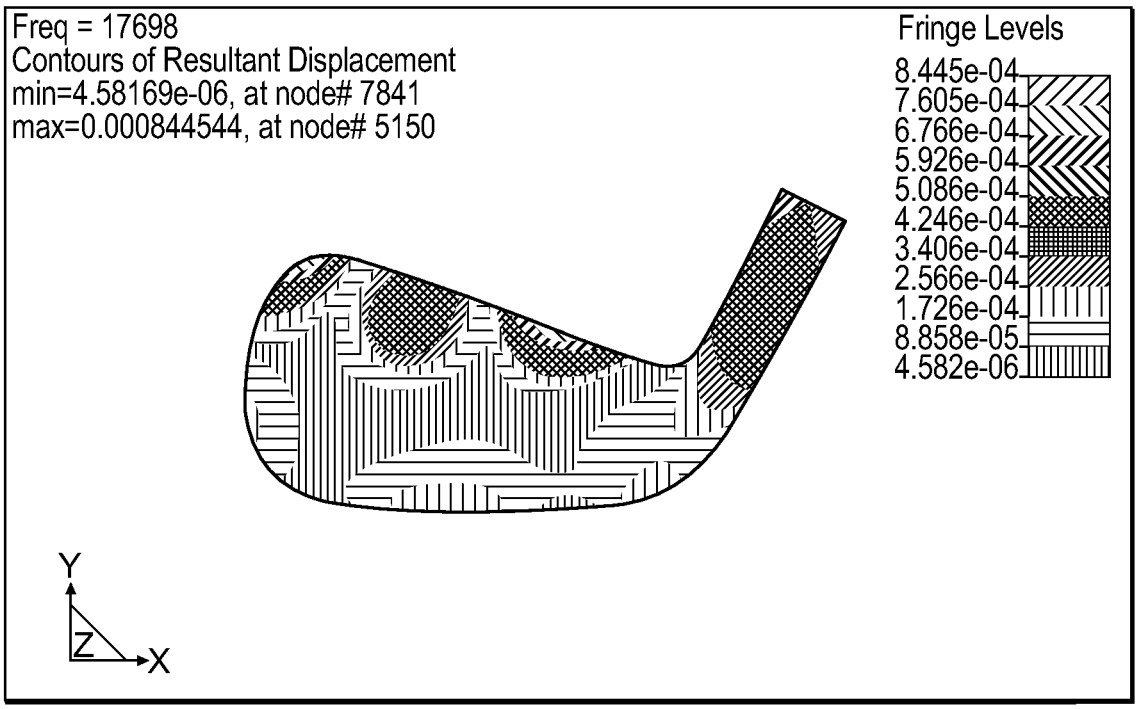
FIGS. 23A-23C illustrate ninth mode shapes for a conventional iron-type golf club and embodiments of the iron-type golf club according to the present invention.
Figure 23B:
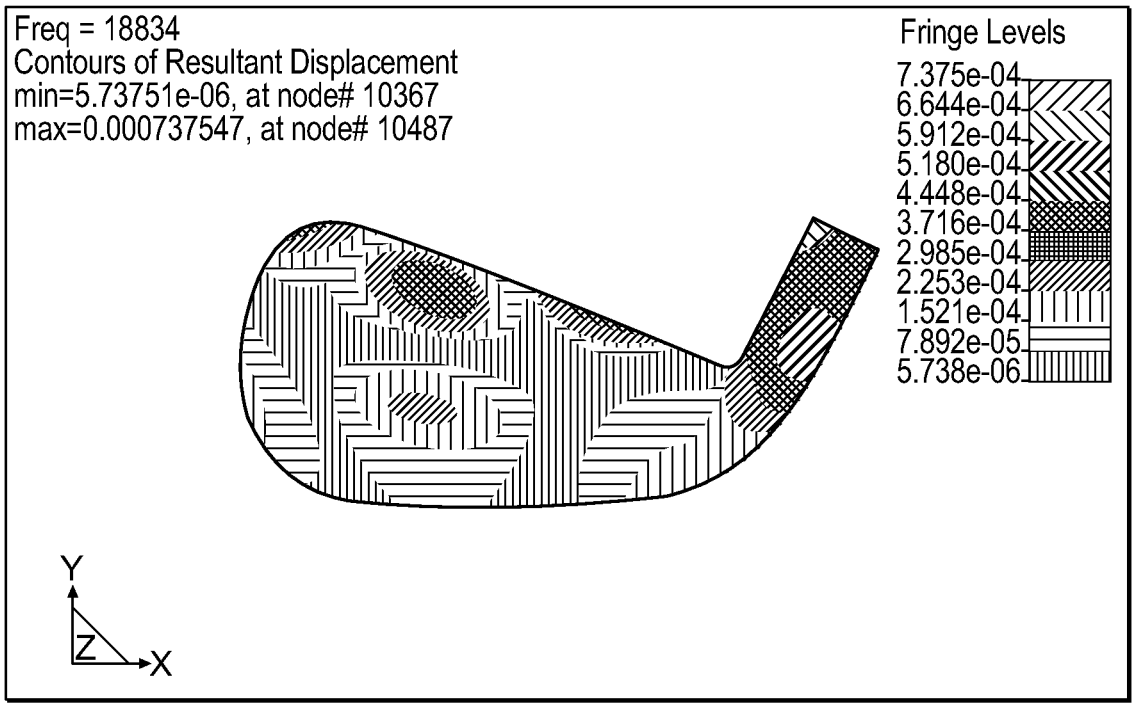
Figure 23C:
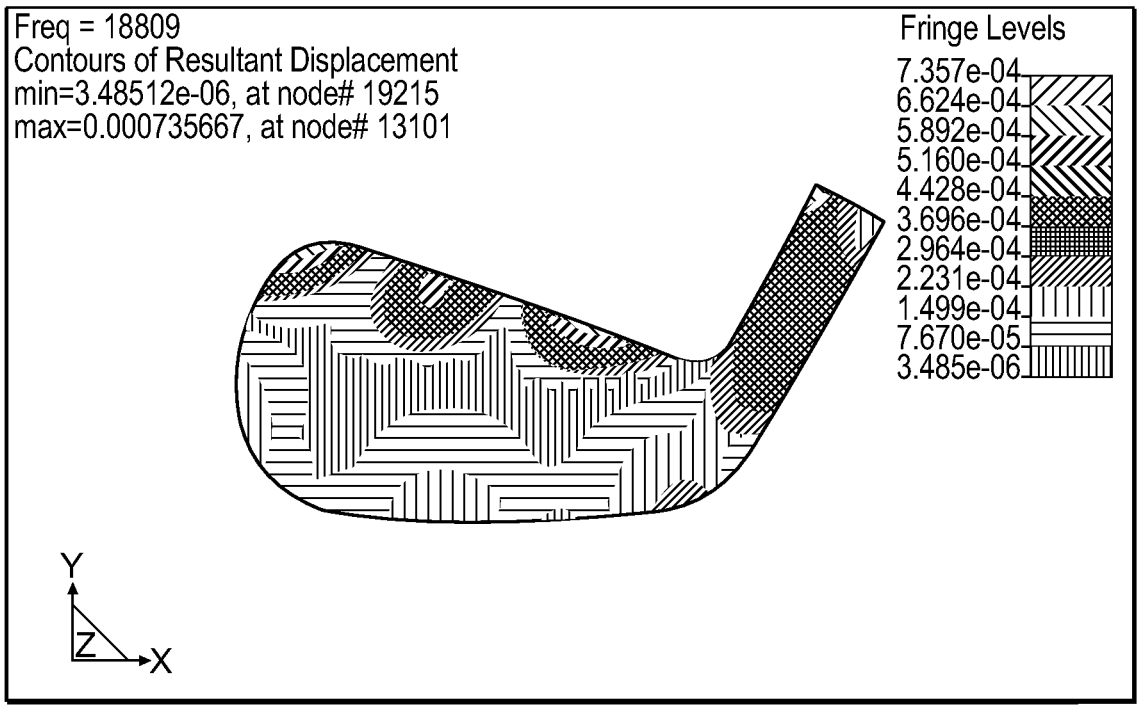

Referring to FIGS. 23A-23C, the ninth vibration mode shape of Embodiments A and B and the conventional iron-type golf club head are similar, however, the frequency values of that mode are greater for the embodiments of the present invention than the frequency value for the conventional iron-type golf club. Embodiment A exhibited a frequency value of 18834 Hz which is 6% greater than the frequency value of the conventional iron-type golf club, at 17698 Hz. Similarly, Embodiment B exhibited a frequency value of 18809 Hz, which is a 6% increase over that of the conventional iron-type golf club.

Figure 24A:
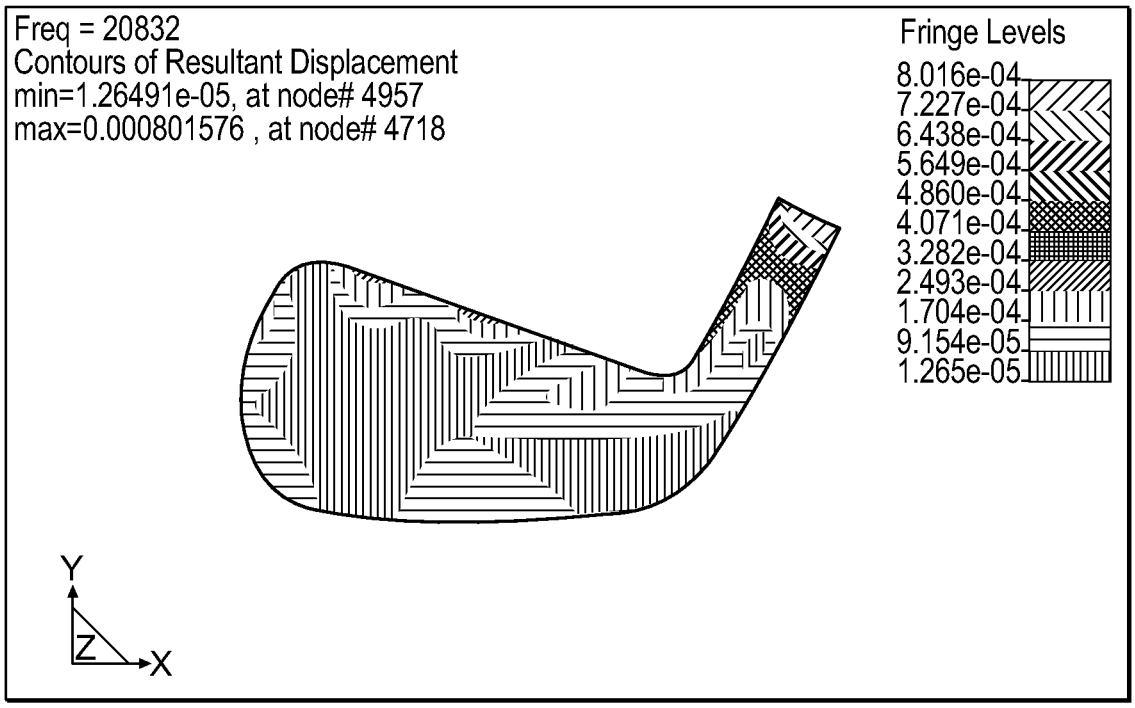
FIGS. 24A-24C illustrate tenth mode shapes for a conventional iron-type golf club and embodiments of the iron-type golf club according to the present invention.
Figure 24B:
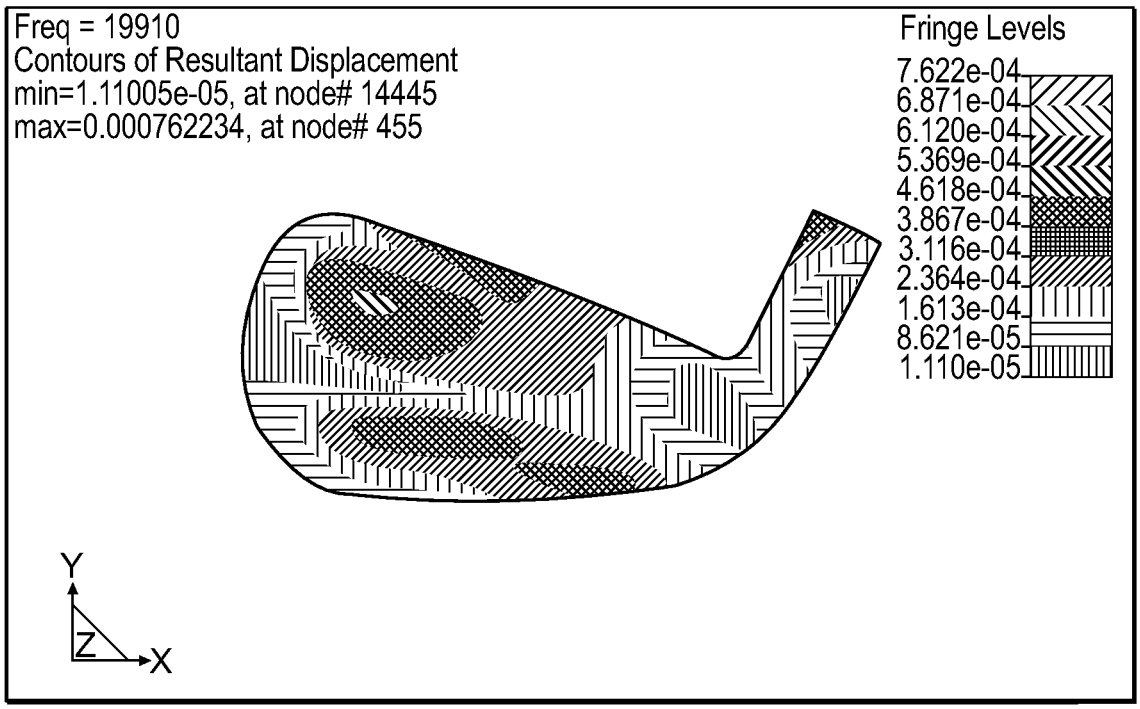
Figure 24C:
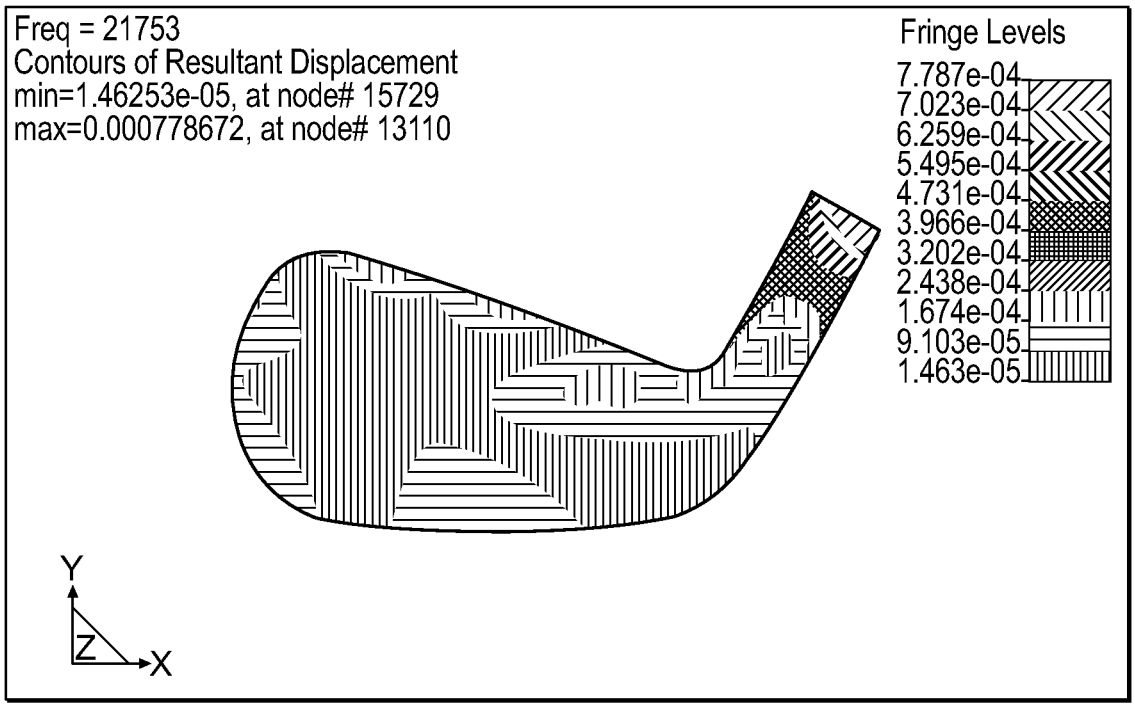

Finally, referring to FIGS. 24A-24C, the tenth vibration mode shape of Embodiment B and the conventional iron-type golf club are similar while the mode shape for Embodiment A differs. In particular, Embodiment B and the conventional golf club exhibit a mode shape in which a large portion of the face is encompassed by a region of minimum displacement. Embodiment A, on the other hand, exhibits a mode shape wherein small regions of minimum displacement are disposed at the heel and toe, but the majority of the face is encompassed by regions of maximum displacement. Additionally, the frequency value for that mode of Embodiment A is lower than that of the conventional iron, while the frequency value of Embodiment B is 21753 Hz, which is approximately 4% higher than that of the conventional iron, at 20832 Hz.

While it is apparent that the illustrative embodiments of the invention disclosed herein fulfill the objectives stated above, it is appreciated that numerous modifications and other embodiments may be devised by those skilled in the art. Therefore, it will be understood that the appended claims are intended to cover all such modifications and embodiments, which would come within the spirit and scope of the present invention.

We claim:

1. A golf club head, comprising:

a club head main body, wherein the club head main body comprises a hitting face that defines a forward ball-striking surface and a rear surface that is spaced from the ball-striking surface by a face thickness;

a frame coupled to a lower portion of the club head main body, wherein the frame comprise a sole portion, a back flange and a support extension, wherein the sole portion of the frame forms at least a portion of a sole surface of the golf club head, wherein the back flange extends upward from a rearward end of the sole portion, and wherein the support extension is disposed at an upward end of the back flange; and an extension member that extends between the main body and the frame, wherein the extension member abuts a portion of the main body so that a force is applied to a rear side of the hitting face.

2. The golf club head of claim 1, wherein the extension member is movably coupled to the support extension.

3. The golf club head of claim 2, wherein the extension member is threaded to the support extension.

4. The golf club head of claim 1, wherein the frame is coupled to the main body by welding.

5. The golf club head of claim 1, wherein the club head main body further comprises a partial sole extending rearward from a lower end of the hitting face.

6. The golf club head of claim 1, further comprising a plurality of extension members extending between the support extension of the frame and the hitting face.

7. The golf club head of claim 6, wherein each of the plurality of extension members abuts a rear side of the hitting face so that force is applied to the hitting face by each of the plurality of extension members.

8. The golf club head of claim 6, wherein each of the plurality of extension members is movably coupled to the support extension.

9. The golf club head of claim 8, wherein each of the plurality of extension members is threaded to the support extension.

10. The golf club head of claim 6, wherein the plurality of extension members are spaced from each other in a heel to toe direction across the golf club head.

11. The golf club head of claim 1, wherein the extension member is disposed at a location central in a heel to toe direction across the golf club head.

12. A golf club head, comprising:

a club head main body, wherein the club head main body comprises a hitting face that defines a forward ball-striking surface and a rear surface that is spaced from the ball-striking surface by a face thickness;

a frame coupled to a lower portion of the club head main body, wherein the frame comprises a sole portion, a back flange and a support extension, wherein the sole portion of the frame forms at least a portion of a sole surface of the golf club head, wherein the back flange extends upward from a rearward end of the sole portion, and wherein the support extension is disposed at an upward end of the back flange; and at least one extension member disposed toeward of the geometric center of the club head main body and extends between the main body and the frame, wherein the extension member abuts a portion of the main body so that a force is applied to a rear side of the hitting face.

13. The golf club head of claim 12, wherein the at least one extension member is movably coupled to the support extension.

14. The golf club head of claim 13, wherein the at least one extension member is threaded to the support extension.

15. The golf club head of claim 12, wherein the frame is welded to the main body.

16. The golf club head of claim 12, wherein the club head main body further comprises a partial sole extending rearward from a lower end of the hitting face.

17. The golf club head of claim 12, wherein at least one of the main body and the frame is constructed from a non-metallic material.

18. A golf club head, comprising:

a club head main body, wherein the club head main body comprises a hitting face and a sole, wherein the club head main body defines a forward ball-striking surface and a rear surface that is spaced from the ball-striking surface by a face thickness, wherein the sole portion extends rearward from a lower edge of the hitting face where it forms a leading edge of the golf club head; and a frame coupled to the club head main body, wherein the frame extends between a trailing edge of the main body and a rear side of the hitting face, wherein the frame is sized so that the frame is in compression between the trailing edge and the rear side of the hitting face of the main body so that a force is applied to the rear side of the hitting face, and wherein the frame comprises a back flange that extends upward from the sole portion and a support extension that extends between an upper end of the back flange and the face support.

19. The golf club head of claim 18, wherein the club head main body is a forged component.

* * * * *